US009989269B2

(12) United States Patent
Park et al.

(10) Patent No.: US 9,989,269 B2
(45) Date of Patent: Jun. 5, 2018

(54) DEHUMIDIFIER

(71) Applicant: LG ELECTRONICS INC., Seoul (KR)

(72) Inventors: Jeongtaek Park, Changwon-si (KR); Hyukju Kwon, Changwon-si (KR); Seungkwon Ahn, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 583 days.

(21) Appl. No.: 14/477,315

(22) Filed: Sep. 4, 2014

(65) Prior Publication Data

US 2015/0082827 A1 Mar. 26, 2015

(30) Foreign Application Priority Data

Sep. 5, 2013 (KR) ..... 10-2013-0106732

(51) Int. Cl.
*F24F 3/14* (2006.01)

(52) U.S. Cl.
CPC .... *F24F 3/1405* (2013.01); *F24F 2003/1446* (2013.01)

(58) Field of Classification Search
CPC . F24F 2003/1446; F24F 3/1405; F24F 1/0022
USPC ..... 62/272
See application file for complete search history.

(56) References Cited

U.S. PATENT DOCUMENTS 2,724,247 A * 11/1955 Kurtz ..... F24F 1/02 62/325
3,938,348 A * 2/1976 Rickert ..... F24F 1/027 62/122
4,135,370 A 1/1979 Hosoda et al. ..... 62/274
(Continued)

FOREIGN PATENT DOCUMENTS

CN 1590903 3/2005
CN 1699851 11/2005
CN 102135296 7/2011
(Continued)

OTHER PUBLICATIONS

International Search Report issued in application No. PCT/KR2014/008429 dated Jan. 14, 2015.
(Continued)

*Primary Examiner* — Henry Crenshaw
(74) *Attorney, Agent, or Firm* — Ked & Associates, LLP

(57) ABSTRACT

Disclosed is a dehumidifier, having a compressor, a condenser, an expansion device, and an evaporator through which refrigerant is circulated, including a casing having an air inlet and an air outlet formed therein, a first passage for drawing air through the air inlet, and discharging the air through the air outlet after passed through the evaporator, the condenser, a first fan, and a second fan in succession, and a second passage for drawing the air through the air inlet and discharging the air through the air outlet after passed through the second fan, thereby, not only increasing the flow rate of the air passing through the condenser enabling to reduce a condensing temperature, but also discharging the air passed
(Continued)

through the condenser mixed with the air drawn into the second passage enabling to drop the temperature of the air being discharged to the air outlet, permitting to resolve user's inconvenience.

19 Claims, 31 Drawing Sheets

(56) References Cited

U.S. PATENT DOCUMENTS

| | | | | |
|---|---|---|---|---|
| 5,147,420 | A * | 9/1992 | Claesson | B01D 53/261 95/113 |
| 2002/0085915 | A1 * | 7/2002 | Barry | F04D 25/082 416/175 |

FOREIGN PATENT DOCUMENTS

| | | | | |
|---|---|---|---|---|
| JP | 06-257786 | A | 9/1994 | |
| JP | 09-089297 | A | 4/1997 | |
| JP | 2000-028159 | | 1/2000 | |
| JP | 2000-234761 | | 8/2000 | |
| JP | 2002-188827 | A | 7/2002 | |
| JP | 2004-028382 | A | 1/2004 | |
| JP | 2008-200615 | | 9/2008 | |
| JP | 2009248071 | A * | 10/2009 | |
| WO | WO 2008084552 | A1 * | 7/2008 | B01D 53/265 |

OTHER PUBLICATIONS

Chinese Office Action dated Dec. 7, 2016 issued in Application. No. 201410449868.X (English translation attached).

* cited by examiner

DEHUMIDIFIER

CROSS-REFERENCE TO RELATED APPLICATION

This application claims priority under 35 U.S.C. § 119 to Korean Application No. 10-2013-0106732 filed on Sep. 5, 2013, whose entire disclosure is hereby incorporated by reference.

BACKGROUND

1. Field

The present invention relates to a dehumidifier. More specifically, the present invention relates to a dehumidifier having a plurality of fans mounted thereto.

2. Background

In general, the dehumidifier removes moisture from humid room air by making the room air to pass a heat exchanger having an evaporator and a condenser, through which refrigerant flows, to reduce humidity of the room air, and to discharge the air dehumidified thus to the room, again.

In order to increase moisture removal efficiency of the room air, there is a case in which a separate fan is used together with the dehumidifier. If the fan is used together with the dehumidifier, the fan increases circulation of the air discharged from the dehumidifier to increase the dehumidifying efficiency. However, if the fan is used together with the dehumidifier, utilization of a room space in which the dehumidifier is installed is liable to be poor, and there is inconvenience of handling the dehumidifier and the fan, individually.

And, the air being discharged from the dehumidifier to the room has a temperature thereof elevated at the condenser. If high temperature air is discharged from the dehumidifier, the user is liable to feel inconvenience.

SUMMARY OF THE INVENTION

Accordingly, the present invention has been made in an effort to solve the aforementioned problems, and it is an object of the present invention to provide a dehumidifier which can enhance utilization of a room space and convenience of handling.

It is another object of the present invention to provide a dehumidifier which can drop a temperature of air being discharged from an air outlet to resolve the user's inconvenience.

The present invention provides a dehumidifier, having a compressor, a condenser, an expansion device, and an evaporator through which refrigerant is circulated, including a casing having an air inlet and an air outlet formed therein, a first passage for drawing air through the air inlet, and discharging the air through the air outlet after passed through the evaporator, the condenser, a first fan, and a second fan in succession, and a second passage for drawing the air through the air inlet and discharging the air through the air outlet after passed through the second fan.

The second passage may join with the first passage between the first fan and the second fan, the first fan may be positioned between the condenser and the second fan in an air flow direction of the first passage, and the second fan may be positioned between the first fan and the air outlet in the air flow direction of the first passage.

The dehumidifier may further include a non-dehumidifying air inlet formed therein for making the air drawn into the second passage to be drawn into the second fan without passed through the evaporator and the condenser.

The dehumidifier may further include an air guide arranged between an outlet portion of the first fan and the casing for guiding the air discharged to the air outlet.

The dehumidifier may further include a flow passage guide which makes a first fan suction flow passage of the first passage and a second fan suction flow passage of the second passage partitioned.

The first fan is a centrifugal fan or a mixed flow fan, and the second fan may include an axial fan.

The air inlet may include a first air inlet for drawing the air into the first passage, and a second air inlet for drawing the air into the second passage.

The second fan may have a rotation center axis parallel to the rotation center axis of the first fan, and the air outlet may be opened in the casing in a front/rear direction thereof.

In another aspect of the present invention, a dehumidifier, having a compressor, a condenser, an expansion device, and an evaporator through which refrigerant is circulated, includes a casing having a first air inlet and a second air inlet and a first air outlet and a second air outlet formed therein, a first passage for drawing air through the first air inlet, and discharging the air through the first air outlet after passed through the evaporator, the condenser, a first fan, and a second fan in succession, a second passage for drawing the air through the second air inlet and discharging the air through the first air outlet after passed through the second fan, and a third passage for drawing the air through the first air inlet and discharging the air through the second air outlet passed through the evaporator, the condenser, and the first fan in succession.

The third passage may be separated from the first passage between the first fan and the second fan, and the second passage may join with the first passage between the first fan and the second fan.

The first fan may be positioned between the condenser and the second fan in an air flow direction of the first passage as well as between the condenser and the second air outlet in an air flow direction of the third passage. The second fan may be positioned between the first fan and the first air outlet in the air flow direction of the first passage as well as between the second air inlet and the first air outlet in the air flow direction of the second passage.

The dehumidifier may further include a second air outlet air guide positioned between the first fan and the second air outlet.

The dehumidifier may further include a communication opening positioned between the first fan and the second fan in an air flow direction of the air drawn into the first air inlet.

The dehumidifier may further include a flow passage control device for opening the communication opening while closing the second air outlet, and for closing the communication opening while opening then second air outlet.

The second fan may have a rotating center axis parallel to the rotating center axis of the first fan, the first air outlet may be opened in the casing in a front/rear direction thereof, and the second air outlet may be formed in the casing to discharge the air in a direction different from the first air outlet.

The first air outlet may face a fan housing of the first fan.

In another aspect of the present invention, a dehumidifier, having a compressor, a condenser, an expansion device, and an evaporator through which refrigerant is circulated, includes a casing having a first air inlet and a second air inlet and a first air outlet and a second air outlet formed therein, a fan having a first impeller and a second impeller to be rotated by one common motor, a first passage for drawing air through the first air inlet, and discharging the air through the first air outlet after passed through the evaporator, the condenser, a first impeller, and a second impeller in succession, a second passage for drawing the air through the second air inlet and discharging the air through the first air outlet after passed through the second impeller, and a third passage for drawing the air through the first air inlet and discharging the air through the second air outlet passed through the evaporator, the condenser, and the first impeller in succession.

The first impeller may be positioned between the condenser and the second impeller in an air flow direction of the first passage and between the condenser and the second air outlet in an air flow direction of the third passage. The second impeller may be positioned between the first impeller and the first air outlet in the air flow direction of the first passage and between the second air inlet and the first air outlet in the air flow direction of the second passage.

The dehumidifier may further include a communication opening positioned between the first impeller and the second impeller in an air flow direction of the air drawn into the first air inlet.

The dehumidifier may further include a flow passage control device for opening the communication opening while closing the second air outlet, and for closing the communication opening while opening then second air outlet.

The dehumidifier of the present invention has an advantage in that the dehumidifier, not only increases the flow rate of the air passing through the condenser enabling to reduce a condensing temperature, but also discharges the air passed through the condenser mixed with the air drawn into the second passage enabling to drop the temperature of the air being discharged to the air outlet, permitting to resolve user's inconvenience.

The dehumidifier of the present invention has an advantage in that the dehumidifier can pass a higher flow rate of air through the condenser to drop the condensing temperature than a case when only the first fan of the first fan and the second fan is mounted, and power consumption can be reduced owing to the drop of the condensing temperature.

The dehumidifier of the present invention has an advantage in that the dehumidifier can secure a higher flow rate than a case when only the first fan of the first fan and the second fan is mounted, and can be used in a function of a fan or a function of an cleaning unit owing to the higher flow rate in comparison to the case when only the first fan is mounted.

The dehumidifier of the present invention has an advantage in that one apparatus is made to serve as a dehumidifier and a fan.

The dehumidifier of the present invention has an advantage in that the dehumidifier permits to enhance utilization of a room space the dehumidifier is installed therein.

The dehumidifier of the present invention has an advantage in that the dehumidifier makes one fan to blow dehumidified air and non-dehumidified air in directions different from one another.

BRIEF DESCRIPTION OF THE DRAWINGS

The embodiments will be described in detail with reference to the following drawings in which like reference numerals refer to like elements wherein.

DETAILED DESCRIPTION

Embodiments may be described with reference to appended drawings. For the description of the embodiments, same names and symbols may be used for the same structure and an additional description according thereto may not be provided below.

Figure 1:
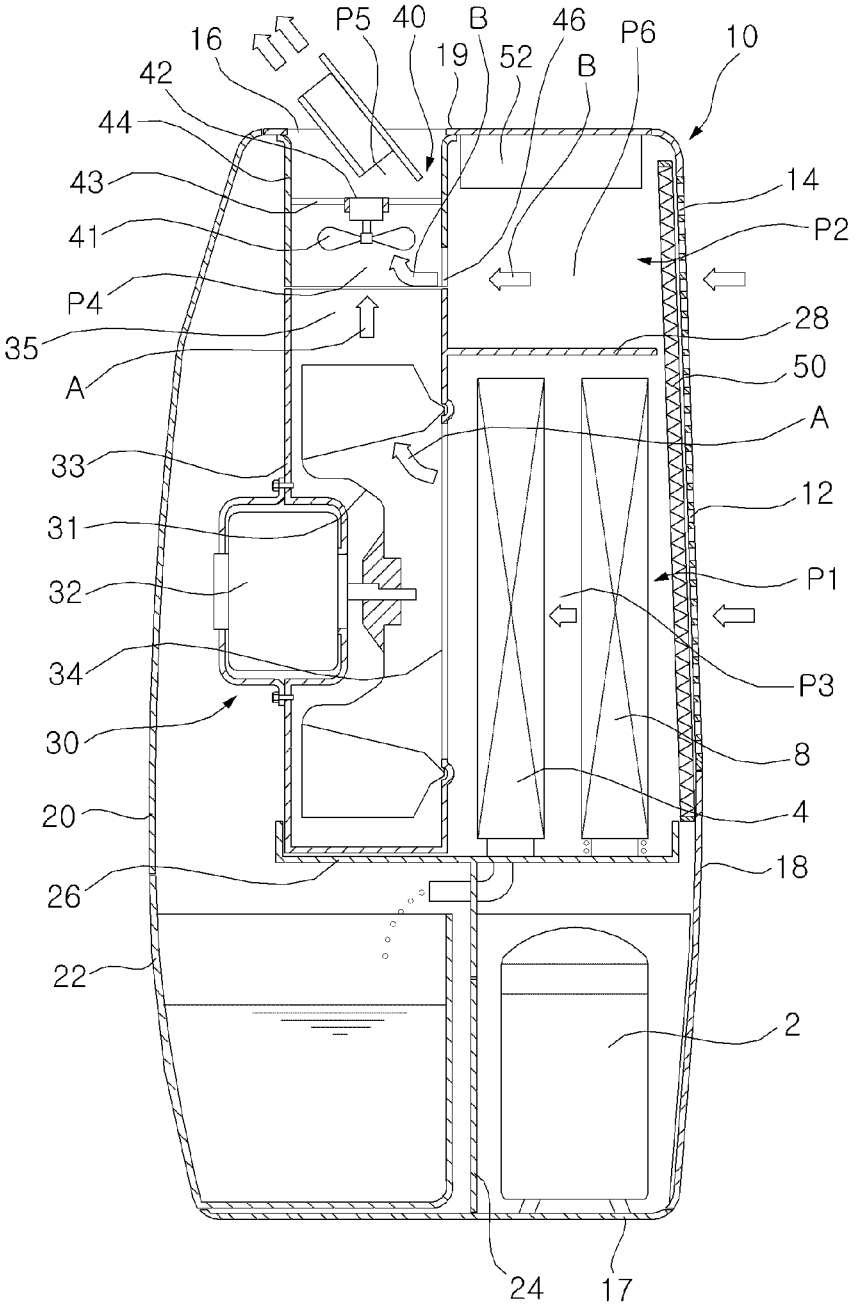
FIG. 1 is a schematic view illustrating a dehumidifier in accordance with a first preferred embodiment of the present invention, showing an air flow when all of a compressor, a first fan and a second fan are driven.
Figure 2:
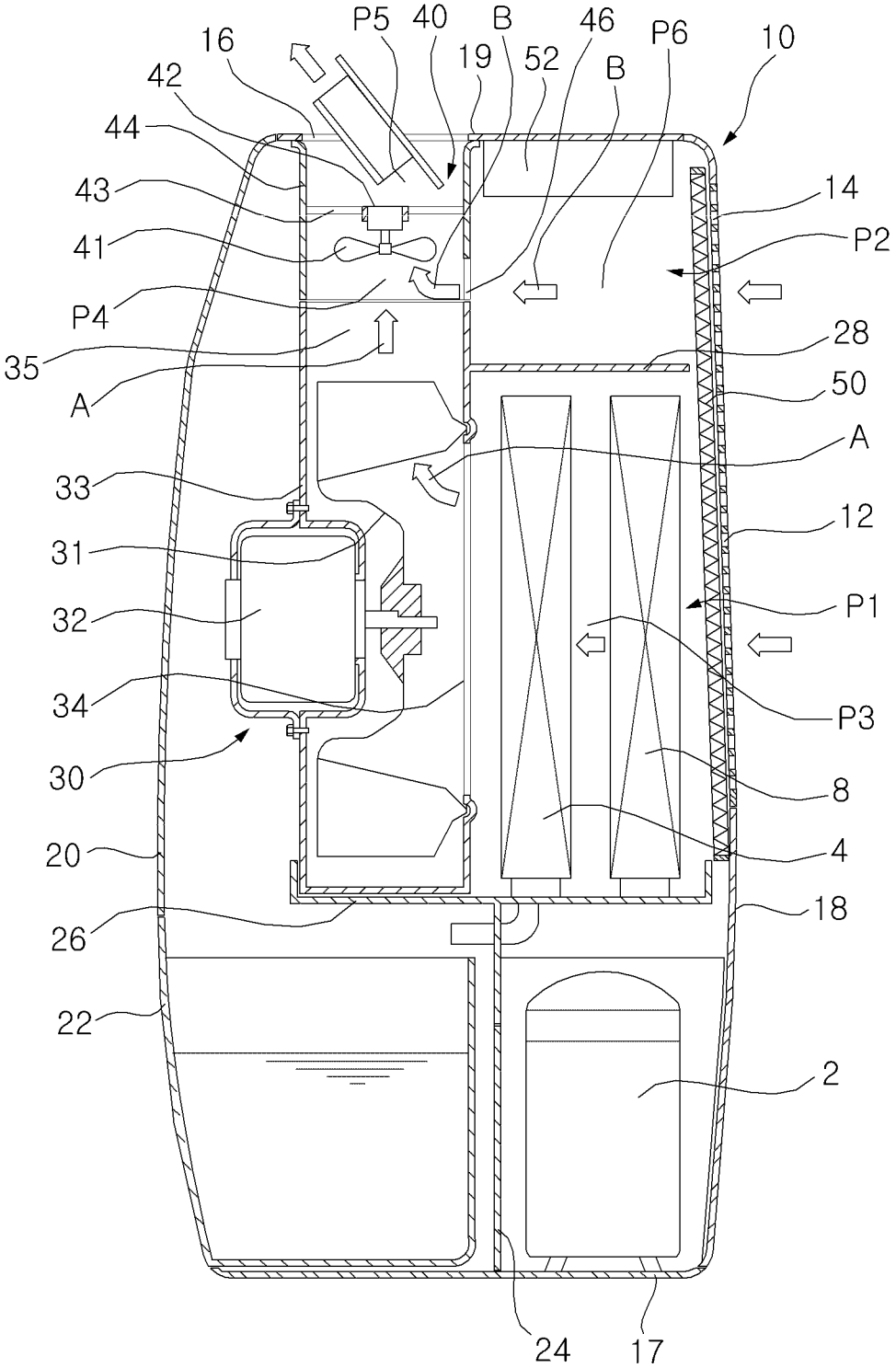
FIG. 2 is a schematic view illustrating a dehumidifier in accordance with a first preferred embodiment of the present invention, showing an air flow when a compressor and a first fan are stopped, and a second fan is driven.
Figure 3:
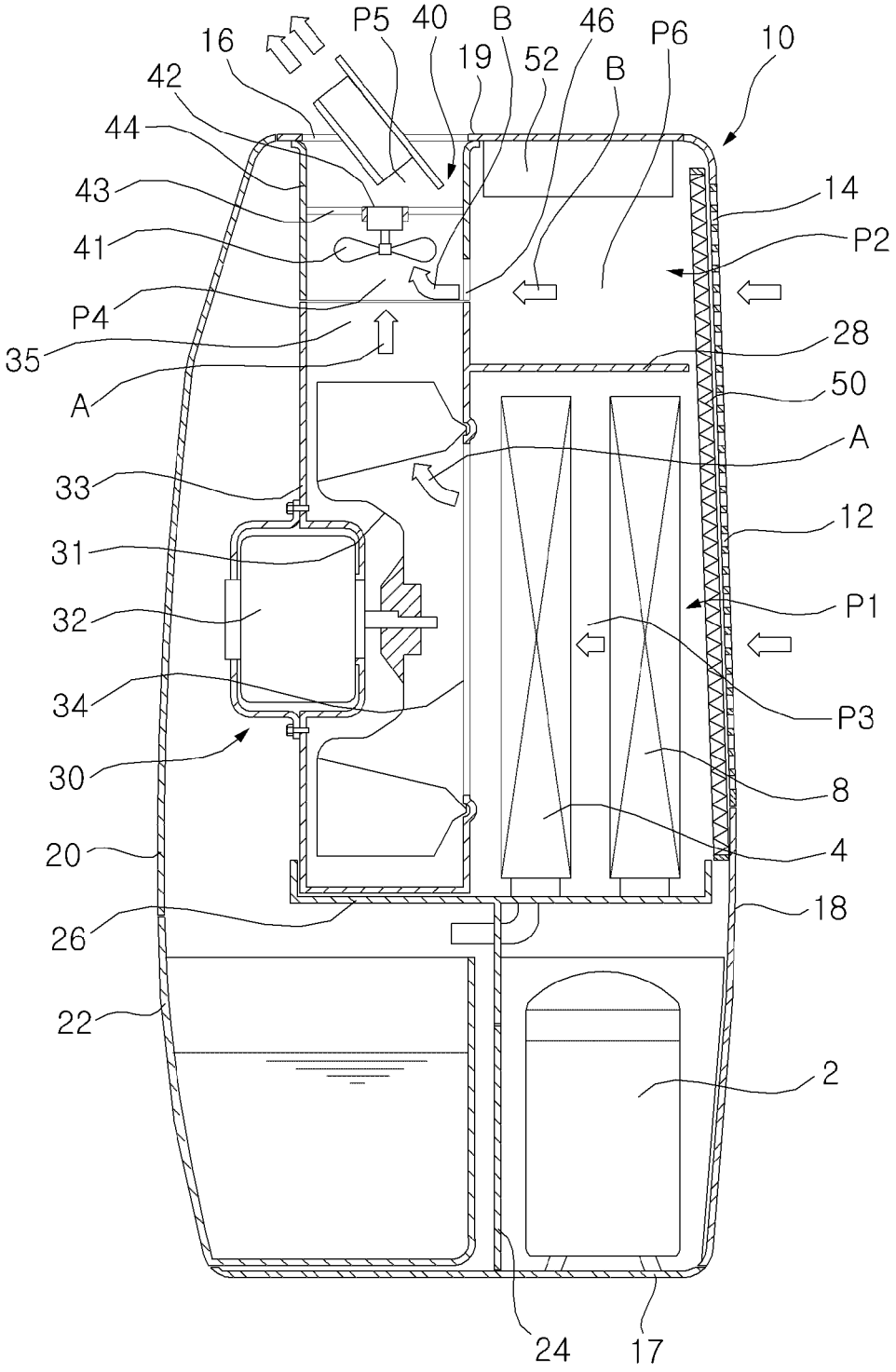
FIG. 3 is a schematic view illustrating a dehumidifier in accordance with a first preferred embodiment of the present invention, showing an air flow when a compressor is stopped and both a first fan and a second fan are driven.
Figure 4:
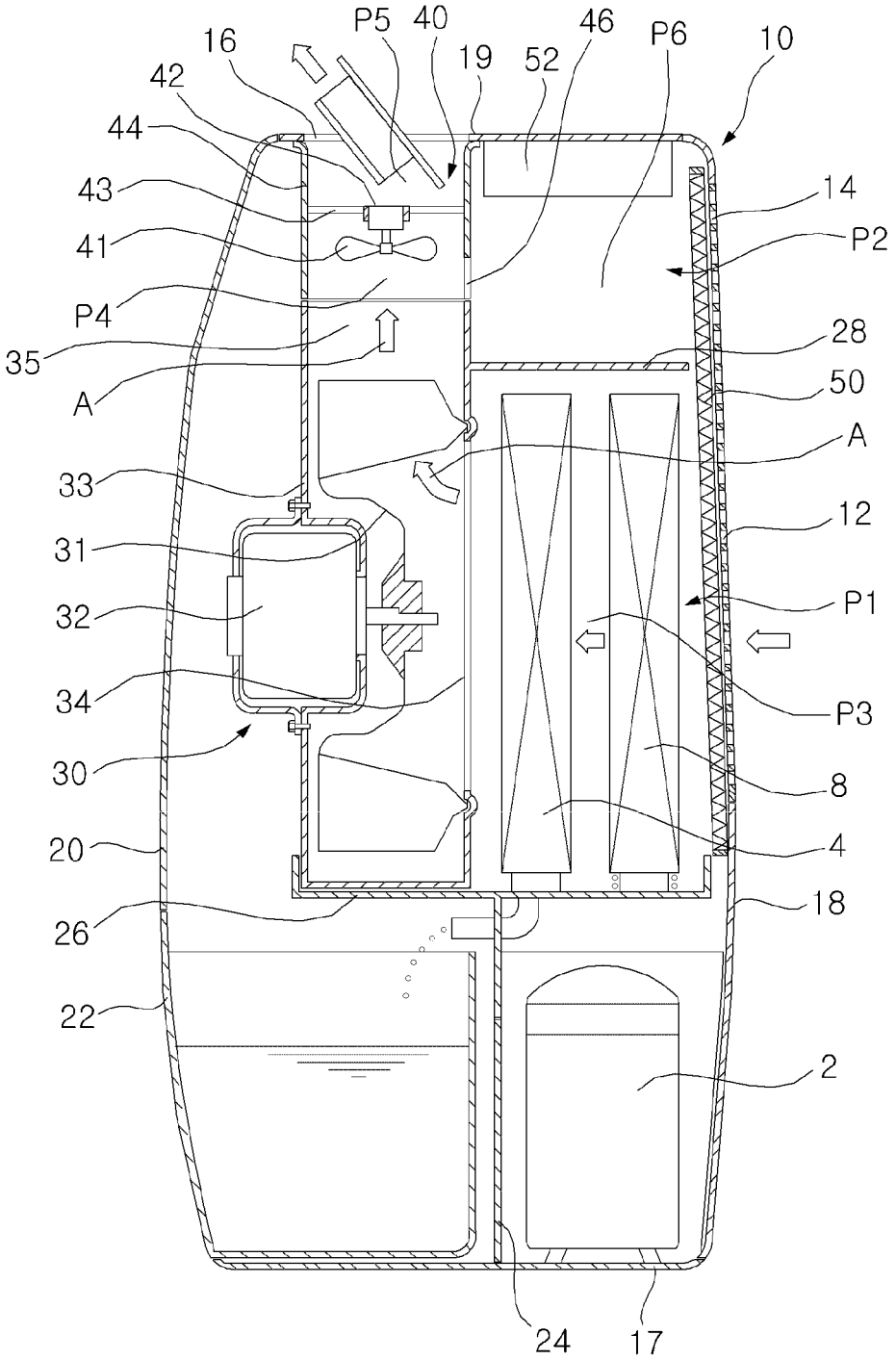
FIG. 4 is a schematic view illustrating a dehumidifier in accordance with a first preferred embodiment of the present invention, showing an air flow when a compressor and a first fan are driven and a second fan is stopped.
Figure 5:
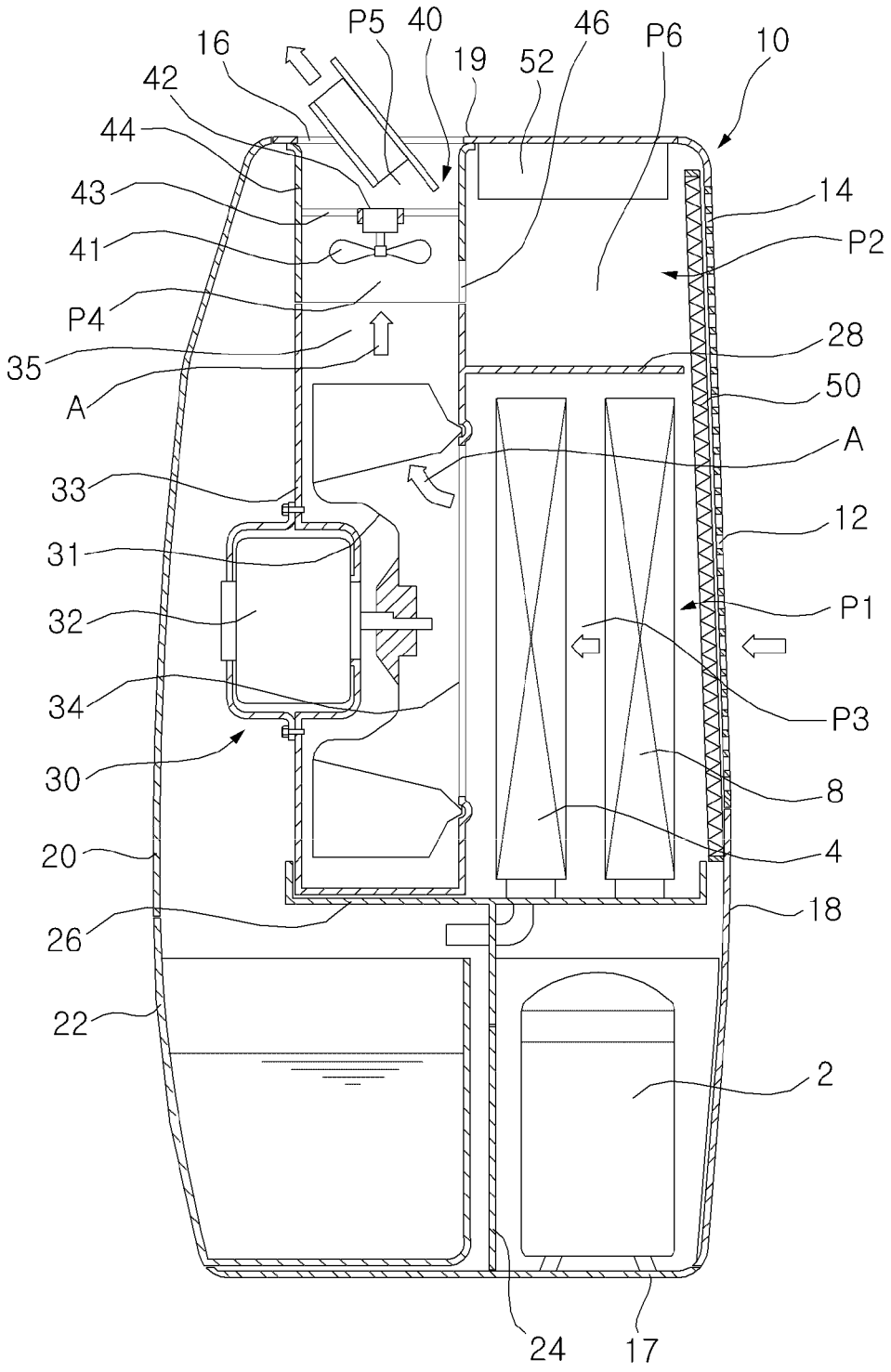
FIG. 5 is a schematic view illustrating a dehumidifier in accordance with a first preferred embodiment of the present invention, showing an air flow when a compressor and a second fan are driven and a first fan is driven.

FIG. 1 is a schematic view illustrating a dehumidifier in accordance with a first preferred embodiment of the present invention, showing an air flow when both a compressor, a first fan and a second fan are driven, FIG. 2 is a schematic view illustrating a dehumidifier in accordance with a first preferred embodiment of the present invention, showing an air flow when both a compressor and a first fan are stopped, and a second fan is driven, FIG. 3 is a schematic view illustrating a dehumidifier in accordance with a first preferred embodiment of the present invention, showing an air flow when a compressor is stopped and both a first fan and a second fan are driven, FIG. 4 is a schematic view illustrating a dehumidifier in accordance with a first preferred embodiment of the present invention, showing an air flow when a compressor and a first fan are driven and a second fan is stopped, and FIG. 5 is a schematic view illustrating a dehumidifier in accordance with a first preferred embodiment of the present invention, showing an air flow when a compressor and a second fan are stopped and a first fan is driven.

The dehumidifier includes a compressor 2, a condenser 4, an expansion device (Not shown), and an evaporator 8, through which the refrigerant circulates. The compressor 2 may compress the refrigerant. The compressor 2 may be mounted between the evaporator 8 and the condenser 4 in a refrigerant flow direction for compressing the refrigerant evaporated at the evaporator 8 and making the refrigerant to flow to the condenser 4. The refrigerant compressed at the compressor 2 may be condensed as the refrigerant heat exchanges with the air while the refrigerant passes through the condenser 4. The refrigerant condensed at the condenser 4 thus may be expanded by the expansion device, and may be evaporated while the refrigerant expanded thus at the expansion device passes through the evaporator 8 as the refrigerant heat exchanges with the air.

The dehumidifier may include a casing 10 having an air inlet and an air outlet formed therein. The casing 10 may have at least one air inlet 12 and 14 formed therein. The casing 10 may have at least one air outlet 16 formed therein. The dehumidifier may have one air inlet 12 and one air outlet 16 formed therein. It may also possible that the dehumidifier has a plurality of air inlets 12 and 14 and one air outlet 16 formed therein. It is possible that the dehumidifier has the air passed through one area of one air inlet 12 to flow toward the evaporator 8, and the air passed through the other area of the one air inlet 12 not to flow toward the evaporator 8. It is possible that the dehumidifier has the air passed through one of the plurality of air inlets 12 and 14 to flow toward the evaporator 8, and the air passed through the other one 14 of the air inlet 12 and 14 not to flow toward the evaporator 8. The air outlet 16 may be formed to be opened in a front/rear direction or an up/down direction. The casing 10 may include a suction panel 18 having a base 17 and the air inlet 12 and 14 formed thereon, and a discharge panel having the air outlet 16 formed therein. The casing 10 may include a top panel 19 and a front panel 20. The top panel 19 may be mounted on the suction panel 18 and the front panel 20. The top panel 19 may be formed separate from the suction panel 18 and the front panel 20, and fastened to the suction panel 18 and the front panel 20. The top panel 19 may be formed as one unit with one of the suction panel 18 and the front panel 20. The casing 10 may have the top panel 19 having the air outlet 16 formed therein and the front panel 20 having an opening formed therein for in/out of a bucket 22 to be described later. In this case, the top panel 19 may be an outlet panel. The casing 20 may have the front panel 20 having the air outlet 16 formed therein, and may also have the opening formed therein for in/out of the bucket 22. In this case, the front panel may be an outlet panel.

The dehumidifier may further include a bucket 22 for holding condensed water dropped from a surface of the evaporator 8. The bucket 22 may be moved in/out of the casing 10 through the opening formed in the casing 10. The dehumidifier may include a barrier 24 for partitioning a lower side of an inside of the casing 10. The barrier 24 may be mounted on the base 17. The barrier 24 may partition the lower side of the inside of the casing 10 into a bucket housing room for in/out of the bucket 22 and a machinery room for placing the compressor 2 therein.

The dehumidifier may further include a drain pan 26 for receiving the condensed water dropped from the evaporator 8 and guiding the condensed water to the bucket 22. The drain pan 26 may be positioned in the casing 10. The drain pan 26 may be arranged on the barrier 24, horizontally. The condenser 4 and the evaporator 8 may be mounted on the drain pan 26. A first fan 30 may be mounted on the drain pan 26. The first fan 30, the condenser 4 and the evaporator 8 may be arranged on the drain pan 26, together.

The dehumidifier may include a first passage P1 and a second passage P2 . The first passage P1 may be a passage through which the air is drawn and discharged to an outside of the dehumidifier after passed through the evaporator 8, the condenser 4, the first fan 30, and a second fan 40 in succession. The second passage P2 may be a passage through which the air is drawn and discharged to the outside after passed through the second fan 40.

The first passage P1and the second passage P2may be formed in the casing 10. The first passage P1 and the second passage P2may join together between the first fan 30 and the second fan 40.

If the dehumidifier has one air inlet 12 formed therein, one area of the air inlet 12 may be in communication with the first passage P1, and the other area of the air inlet 12 may be in communication with the second passage P2. In this case, the one area of the one air inlet 12 may be an inlet to the first passage P1 and the other area of the one air inlet 12 may be an inlet to the second passage P2.

If the dehumidifier has a plurality of air inlets 12 and 14, the first air inlet 12 which is one of the plurality of the air inlets 12 and 14 may be in communication with the first passage P1, such that the air may be drawn into the first passage P1 from an outside of the dehumidifier through the first air inlet 12. If the dehumidifier has the plurality of air inlets 12 and 14, the second air inlet 14 which is the other one of the plurality of the air inlets 12 and 14 may be in communication with the second passage P2 , such that the air may be drawn into the second passage P2 from an outside of the dehumidifier through the second air inlet 14. In this case, the first air inlet 12 may be an inlet to the first passage P1 and the second air inlet 14 may be an inlet to the second passage P2.

The first fan 30 may be positioned between the condenser 4 and the air outlet 16 in the air flow direction of the first passage P1. The first fan 30 may be arranged to the condenser 4 closer than the second fan 40. The first fan 30 may have at least a portion mounted to face the condenser 4. The first fan 30 may be mounted to be positioned in front of the condenser 4. The first fan 30 may be positioned between the condenser 4 and the second fan 40 in the air flow direction of the first passage P1, such that the air may be blown from the first fan 30 to the second fan 40 after passed through the evaporator 8, the condenser 4, and the first fan 30 in succession. It is preferable that the first fan 30 is a high static pressure fan having a high static pressure for the air to pass the evaporator 8 and the condenser 4, such as a centrifugal fan like a turbo fan and a sirocco fan, or a mixed flow fan. The first fan 30 may include an impeller 31, a motor 32 for rotating the impeller 31, a fan housing 33 which surrounds the impeller 31 for guiding the air when the impeller 31 rotates, and an orifice 34 for guiding the air being drawn into the fan housing 33. The motor 32 may be mounted to one of sides of the fan housing 33 and the orifice 34. The fan housing 33 may be mounted in rear of the front panel 10 to face the front panel 10. The fan housing 33 may have an outlet portion formed therein for discharging the air blown from the impeller 31 to an outside of the first fan 30. The outlet portion of the fan housing 33 may be formed in a shape of a duct. The outlet portion of the fan housing 33 may be formed to face upward. The outlet portion in the fan housing 33 may face the air outlet 16. The orifice 34 may be mounted to the fan housing 33 to be positioned between the fan housing 33 and the condenser 4.

The second fan 40 may be positioned on the first passage P1, arranged in series with the first fan 30 in the flow direction of the air passing through the first passage P1 . The second fan 40 may be positioned between the first fan 30 and the air outlet 16 in an air flow direction passing through the first passage P1 . The first fan 30 and the second fan 40 may blow the air in multiple stages. If the first fan 30 and the second fan 40 are driven together, a higher flow rate of the air may pass through the evaporator 8 and the condenser 4 than a case the first fan 30 is driven, singly. The second fan 40 may be arranged closer to the air outlet 16 than the first fan 30. The second fan 40 may be arranged between the first fan 30 and the air outlet 16 to make the air to flow to be discharged through the air outlet 16 after passed through the evaporator 8, the condenser 4, the first fan 30, and the second fan 40 in succession. The second fan 40 may be arranged between the first fan 30 and the air outlet 16 to make the air to flow to be discharged through the air outlet 16 after bypassing all of the evaporator 8, the condenser 4, and the first fan 30.

It is preferable that the second fan 40 is a high flow rate fan having a high flow rate. It is preferable that the second fan 40 is an axial fan, such as a propeller fan, a tube axial fan, and a vane axial fan. The second fan 40 may include an impeller 41, and a motor 42 for rotating the impeller 41. The second fan 40 may further include a motor mounter 43 for mounting the motor 42. The second fan 40 may be mounted to be positioned over the first fan 30. The second fan 40 may be mounted to be positioned between the first fan 30 and the top panel 19.

The dehumidifier may further include an air guide 44 for guiding the air blown by the second fan 40. If the dehumidifier further includes the air guide 44, the air guide 44 may have at least a portion thereof positioned between the first fan 30 and the second fan 40. The air guide 44 may guide the air flowing from the first fan 30 to the second fan 40. The air guide 44 may have at least a portion thereof positioned between the second fan 40 and the air outlet 16. The air guide 44 may guide the air flowing to the air outlet 16 from the second fan 40. The air guide 44 may be arranged between the outlet portion 34 of the first fan 30 and the casing 10 for guiding the air being discharged to the air outlet 16. The air guide 44 may have at least a portion thereof mounted to be positioned between the first fan 30 and the air outlet 16. The air guide 44 may guide the air flowing to the second fan 40 from the first fan 30, and may guide the air flowing to the air outlet 16 from the second fan 40. The air guide 44 may be positioned between the first fan 30 and the top panel 19.

The air guide 44 may be formed in a hollow cylindrical shape, having an air passage formed therein. The air guide 44 may have a lower end facing the outlet portion 35 of the first fan 30. The air guide 44 may have a top end facing the top panel 19.

The second fan 40 may be mounted in the outlet portion 35 of the first fan 30, for generating suction force toward an inside of the first fan 30 from an inside of the outlet portion 35 of the first fan 30.

It is possible that the second fan 40 is mounted to an outside of the outlet portion 35 of the first fan 30 for generating suction force toward the inside of the first fan 30 from the outside of the first fan 30. In this case, the second fan 40 may be mounted to the casing 10 or the air guide 44 to be positioned in the air guide 44.

The dehumidifier may have a non-dehumidifying air inlet 46 formed therein for passing of the air B which does not pass the evaporator 8 and the condenser 4 so as to be drawn into the second fan 40. The non-dehumidifying air inlet 46 may be positioned in the dehumidifier. The non-dehumidifying air inlet 46 may be a second fan air inlet for the air to pass therethrough for being drawn into the second fan 40. The non-dehumidifying air inlet 46 may be a bypass inlet for the air drawn into the dehumidifier from an outside of the dehumidifier to be drawn into the second fan 40 bypassing the evaporator 8 and the condenser 4.

The non-dehumidifying air inlet 46 may be formed in the outlet portion 35 of the first fan 30. If the second fan 40 is mounted in the outlet portion 35 of the first fan 30, the non-dehumidifying air inlet 46 may be formed at the outlet portion 35 of the first fan 30 for air to be drawn to the outlet portion 35 of the first fan 30.

It is possible that the non-dehumidifying air inlet 46 is formed between the first fan 30 and the second fan 40. If the second fan 40 is mounted on the outside of the first fan 30, a gap may be formed between the outlet portion 35 of the first fan 30 and the second fan 40, and the gap may be the non-dehumidifying air inlet 46.

If the dehumidifier includes the air guide 44, the non-dehumidifying air inlet 46 may be formed between the first fan 30 and the air guide 44. If the dehumidifier includes the air guide 44, it is possible that the non-dehumidifying air inlet 46 is formed in the air guide 44. The air guide 44 may be formed to be in communication with the outlet portion 35 of the first fan 30, and the non-dehumidifying air inlet 46 may be formed to be open in one side of the air guide 44. It is possible that the air guide 44 has an opened lower end to be in communication with the outlet portion 35 of the first fan 30, and the non-dehumidifying air inlet 46 may be an opening formed in one of front, rear, left, and right sides of the air guide 44.

The non-dehumidifying air inlet 46 may be formed at the outlet portion of the first fan 30, between the first fan 30 and the second fan 40, between the first fan 30 and the air guide 44, or at the air guide 44.

The dehumidifier may have the air drawn from a rear side thereof and discharged upward. In this case, the first fan 30 may have a horizontal rotating central axis, and the second fan 40 may have a vertical rotating central axis. The first fan 30 may have the rotating central axis arranged horizontally enabling to draw the air in a front/rear direction and to blow the air upward. The second fan 40 may have the rotating central axis arranged vertically enabling to blow the air from a lower side to an upper side. In this case, the air blown to upward by the first fan 30 may be blown to the upper side of the second fan 40.

The first passage P1 may be a passage for dehumidifying the air drawn from the outside of the dehumidifier as the air passes through the heat exchangers of the evaporator 8 and the condenser 4. The first passage P1 may be a dehumidifying passage for the air drawn from the outside of the dehumidifier to be discharged after dehumidified.

The first passage P1 may include, in a flow direction of the air passing through the first passage P1 , a first fan suction flow passage P3 between the air inlet 12 and the first fan 30, a fan connection flow passage P4 between the first fan 30 and the second fan 40, and a common discharge flow passage P5 between the second fan 40 and the air outlet 16. The first passage P1 may include a first fan inside flow passage formed in the first fan 30. The air may be discharged through the air outlet 16 after passed through the first fan suction flow passage P3, the first fan inside flow passage, the fan connection flow passage P4 and the common discharge flow passage P5 in succession.

The first fan suction flow passage P3 may have the evaporator 8 and the condenser 4 arranged in a flow direction of the air to be flowed by the first fan 30. The first fan suction flow passage P3 may be formed between the air inlet 12 and the orifice 34 in an air flow direction. The first fan suction flow passage P3 may be formed between the drain pan 26 and a flow passage guide 28 to be described later. The air may be drawn into the first fan 30 passed through the drain pan 26 and the flow passage guide 28.

The first fan inside flow passage may be formed between the orifice 34 and the fan housing 33.

If the second fan 40 is mounted to the outside of the first fan 30, the fan connection flow passage P4 may be positioned between the outlet portion 35 of the first fan 30 and the second fan 40. If the second fan 40 is positioned in the air guide 44, the fan connection flow passage P4 may be formed at the air guide 44. If the second fan 40 is mounted to an inside of the outlet portion 35 of the first fan 30, the fan connection flow passage P4 may be positioned in the outlet portion 35 of the first fan 30. The common discharge flow passage P5 may be formed between the second fan 40 and the air outlet 16 in the air flow direction. The common discharge flow passage P5 may be formed at the air guide 44.

The second passage P2 may be a passage through which the air drawn from the outside of the dehumidifier does not pass through the evaporator 8 and the condenser 4. The second passage P2 may be a non-dehumidifying passage (Or, heat exchange bypass passage) through which the air drawn from the outside of the dehumidifier is discharged after bypassing the evaporator 8 and the condenser 4. The second passage P2 may be a passage in which the air A passed through the evaporator 8 and the condenser 4 in the first passage P1 is mixed with the air B which does not pass through the evaporator 8 and the condenser 4. The second passage P2 may join with the first passage P1 between the first fan 30 and the second fan 40. The second passage P2 may include a second fan suction flow passage P6 between the air inlet 14 and the second fan 40, and the common discharge flow passage P5 between the second fan 40 and the air outlet 16 in an air flow direction passing through the second flow passage P2. The second passage P2 may have the second fan suction flow passage P6 connected to the fan connection flow passage P4 of the first passage P1. The second fan suction flow passage P6 may be connected to the fan connection flow passage P4 of the first passage P1 at a position before the second fan 40 in an air flow direction to be flowed by the second fan 40. The second fan suction flow passage P6 may be formed between the air inlet 14 and the non-dehumidifying air inlet 46 in an air flow direction passing through the second passage P2. The second fan suction flow passage P6 may be formed between the top panel 19 and the flow passage guide 28 in an air flow direction passing through the second fan suction flow passage P6.

The dehumidifier may further include the flow passage guide 28 positioned between the first passage P1 and the second passage P2. The flow passage guide 28 may be arranged in the casing 10. The flow passage guide 28 may be arranged to make the first fan suction flow passage P3 and the second fan suction flow passage P6 partitioned. The flow passage guide 28 may have one side which forms the first fan suction flow passage P3, and the other side which forms the second fan suction flow passage P6. The flow passage guide 28 may be arranged at the first fan 30 so as to be positioned over the evaporator 8 and the condenser 4. The flow passage guide 28 may partition a space between the drain pan 26 and the top panel 19 into the first fan suction flow passage P3 and the second fan suction flow passage P6 in a vertical direction. The flow passage guide 28 may be arranged to be projected from one side of the orifice 34 toward the suction panel 18, such that an upper side thereof forms the second fan suction flow passage P6 and a lower side thereof forms the first fan suction flow passage P3.

The dehumidifier may have all of the first fan suction flow passage P3, the first fan inside flow passage, the fan connection flow passage P4, the second fan suction flow passage P6, and the common discharge flow passage P5 formed therein. The air drawn to the inside of the dehumidifier from the outside of the dehumidifier may be discharged to the outside of the dehumidifier after passed through the first fan suction flow passage P3, the first fan 30, the fan connection flow passage P4, the second fan 40, and the common discharge flow passage P5 in succession. The air drawn to the inside of the dehumidifier from the outside of the dehumidifier may be discharged to the outside of the dehumidifier after passed through the second fan suction flow passage P6, the second fan 40, and the common discharge flow passage P5 in succession. The air drawn to the inside of the dehumidifier from the outside of the dehumidifier may have a portion thereof discharged to the outside of the dehumidifier after passed through the first fan suction flow passage P3, the first fan 30, the fan connection flow passage P4, the second fan 40, and the common discharge flow passage P5 in succession, and the other portion thereof discharged to the outside of the dehumidifier after passed through the second fan suction flow passage P6, the second fan 40, and the common discharge flow passage P5 in succession.

The dehumidifier may further include a cleaning unit 50 for cleaning the air being drawn into the dehumidifier from the outside of the dehumidifier. It is possible that the cleaning unit 50 is mounted to be positioned, not at the second passage P2, but at the first passage P1, and not at the first passage P1, but at the second passage P2, or the first passage P1 and the second passage P2. It is possible that the cleaning unit is a filter for filtering out foreign matter, such as dust, as the air passes through the filter. The cleaning unit 50 may be a high performance filter, such as a HEPA filter. It is possible that the cleaning unit 50 is an electric dust collector, or an ionizer. It is possible that, if the cleaning unit 50 is the electric dust collector, or the ionizer, the cleaning unit 50 is turned on when the first fan 30 is driven, and turned on when the second fan 40 is driven. It is possible that the cleaning unit 50 is mounted to only any one of the first passage P1 and the second passage P2, to each of the first passage P1 and the second passage P2, or may be arranged over the first passage P1 and the second passage P2.

If the cleaning unit 50 is positioned, not at the second passage P2, but at the first passage P1, the air flowing toward the evaporator 8 may flow toward the evaporator 8 after being cleaned at the cleaning unit 50, and the air which flows toward the second fan 40 without passed through the evaporator 8 and the condenser 4 may flow toward the second fan 40 without being cleaned at the cleaning unit 50. In this case, the first passage P1 may function as a cleaning and dehumidifying flow passage which may perform air cleaning and air dehumidifying, and the second passage P2 may function as an air blowing flow passage which may guide the non-dehumidifying air that does not pass through the evaporator 8 and the condenser 4 to the second fan 40.

If the cleaning unit 50 is positioned, not at the first passage P1, but at the second passage P2, the air flowing toward the evaporator 8 may pass, not through the cleaning unit 50, but toward the evaporator 8, and the air flowing toward the second fan 40 without passed through the evaporator 8 and the condenser 4 may flow toward the second fan 40 after cleaned at the cleaning unit 50. The first passage P1 may function as a dehumidifying flow passage which can perform dehumidification of the air, and the second passage P2 may function as a cleaning and air blowing flow passage which can perform air cleaning and air blowing.

If the cleaning unit 50 is positioned at the first passage P1 and at the second passage P2, the air flowing toward the evaporator 8 may flow toward the evaporator 8 after cleaned at the cleaning unit 50, and the air flowing toward the second fan 40 without passed through the evaporator 8 and the condenser 4 may flow toward the second fan 40 after cleaned at the cleaning unit 50. The first passage P1 may function as a cleaning and dehumidifying flow passage which can perform air cleaning and air dehumidification, and the second passage P2 may function as a cleaning and air blowing flow passage which can perform air cleaning and air blowing.

The second fan 40 may be driven while the compressor 2 is not driven in a state the cleaning unit 50 is positioned only at the second passage P2 or both at the first passage P1 and the second passage P2. In this case, the air drawn to the second passage P2 by the second fan 40 may be discharged to the air outlet 16 in a state cleaned by the cleaning unit 50. In this case, the dehumidifier may function as an air cleaner which does not dehumidify the room air.

The compressor 2 may not be driven and the second fan 40 may be driven in a state the cleaning unit 50 is positioned only at the first passage P1. In this case, the air drawn to the second passage P2 by the second fan 40 may be discharged to the air outlet 16 in a state the air is not cleaned by the cleaning unit 50. In this case, the dehumidifier may function as a fan which does not dehumidify the room air.

The dehumidifier may further include an input unit (Not shown) for applying a user's order thereto. The dehumidifier may further include a control unit 52 for controlling various electric components mounted to the dehumidifier. The control unit 52 may control the compressor 2, the first fan 30, and the second fan 40. The input unit may be a remote controller for controlling the dehumidifier remotely, or a control panel mounted to the casing 10. The input unit may have an operation mode of the dehumidifier applied thereto, and the control unit 52 may control the compressor 2, the first fan 30, and the second fan 40 according to the operation mode received through the input unit. The control unit may be mounted to be positioned in the casing 10. The control unit 52 may be positioned at the second passage P2 for guiding the air passing through the second passage P2. The control unit 52 may have heat thereof dissipated by the air passing through the second passage P2. The control unit 52 may be positioned between the top panel 19 and the flow passage guide 28, the control unit 52 may form the second fan suction flow passage P6, and the second fan suction flow passage P6 may be formed between the control unit 52 and the flow passage guide 28.

If flow rates of the first fan 30 and the second fan 40 are the same or close to each other, The flow rate of the dehumidifier may be classified into two stages, by driving and stopping the first fan 30 and the second fan 40, to have a high flow rate mode in which both of the first fan 30 and the second fan 40 are driven, and a low flow rate mode in which only one of the first fan 30 and the second fan 40 is driven and the other one of the first fan 30 and the second fan 40 is stopped.

If a difference of flow rates of the first fan 30 and the second fan 40 is large, the flow rate of the dehumidifier may be classified into three stages by driving, and stopping the first fan 30 and the second fan 40, to have a high flow rate mode in which both of the first fan 30 and the second fan 40 are driven, a medium flow rate mode in which a fan having a larger flow rate of the first fan 30 and the second fan 40 is driven while a fan having a smaller flow rate of the first fan 30 and the second fan 40 is stopped, and a low flow rate mode in which only the fan having the small flow rate of the first fan 30 and the second fan 40 is driven and the fan having the larger flow rate of the first fan 30 and the second fan 40 is stopped.

The dehumidifier may include at least two operation modes. The dehumidifier may have a plurality of operation modes, and may be operated in one mode selected from the plurality of the operation modes. The plurality of the operation modes may include a first mode in which the compressor 2, the first fan 30, and the second fan 40 are driven together. The plurality of the operation modes may include a second mode in which the compressor 2 and the first fan 30 are stopped, and the second fan 40 is driven. The plurality of the operation modes may further include a third mode in which the compressor 2 is stopped and the first fan 30 and the second fan 40 are driven, together. The plurality of the operation modes may include a fourth mode in which the compressor 2 and the first fan 30 are driven, and the second fan 40 is stopped. The plurality of the operation modes may include a fifth mode in which the compressor 2 and the second fan 40 are stopped, and the first fan 30 is driven.

The first mode is a mode in which the air is drawn from the outside of the dehumidifier, dehumidifies at the evaporator 8, and discharges to the air outlet 16, enabling to drop a temperature of the air to be discharged thus lower than a temperature of the air passed between the condenser 4 and the first fan 30 and to discharge the air at a high flow rate. The first mode may be a high flow rate dehumidifying mode. If the cleaning unit 50 is arranged at least one of the first passage P1 and the second passage P2, the first mode may be a high flow rate dehumidifying cleaning mode.

The second mode is a mode in which the air is drawn from the outside of the dehumidifier, and discharges without making the air to heat exchange with the evaporator 8 and the condenser 4. The second mode enables a portion of the air drawn from the outside of the dehumidifier to pass through the first passage P1 without heat exchange with the evaporator 8 and the condenser 4, and the other portion of the air drawn from the outside of the dehumidifier to pass through the second passage P2. If the flow rate of the dehumidifier is classified into two stages, the second mode may be a low flow rate air blowing mode, and, if the flow rate of the dehumidifier is classified into three stages and the second fan 40 has a flow rate higher than the flow rate of the first fan 30, the second mode may be a medium flow rate air blowing mode. If the flow rate of the dehumidifier is classified into three stages and the flow rate of the second fan 40 is lower than the flow rate of the first fan 30, the second mode may be a low flow rate air blowing mode. If the cleaning unit 50 is arranged at the second passage P2, or the first passage P1 and the second passage P2, the second mode may be a low flow rate cleaning mode, or a medium flow rate cleaning mode.

The third mode is a mode in which the air is drawn from the outside of the dehumidifier, and discharged without making the air to pass through the evaporator 8 and the condenser 4 to enable to discharge the air at a high flow rate. The third mode enables a portion of the air drawn from the outside of the dehumidifier to pass through the first passage P1 without heat exchange with the evaporator 8 and the condenser 4, and the other portion of the air drawn from the outside of the dehumidifier to pass through the second passage P2. The third mode may be a high flow rate air blowing mode having a flow rate higher than the second mode. If the cleaning unit 50 is arranged at least one of the first passage P1 and the second passage P2, the third mode may be a high flow rate cleaning mode.

The fourth mode may be a mode in which the air drawn from the outside of the dehumidifier is dehumidified at the evaporator 8, and discharged to enable to discharge the air at a flow rate lower than the first mode. The fourth mode may be a low flow rate dehumidifying mode having a flow rate lower than the first mode. If the cleaning unit 50 is arranged at the first passage P1, the fourth mode may be a low flow rate dehumidifying cleaning mode.

The fifth mode may be a mode in which the air is drawn from the outside of the dehumidifier, passed through the evaporator 8 and the condenser 4 without dehumidification and discharged enabling to discharge the air at a flow rate lower than the first mode. The fifth mode may be a low flow rate air blowing mode. If the cleaning unit 50 is arranged at the first passage P1, the fifth mode may be a low flow rate cleaning mode.

The dehumidifier may have the first fan 30 and the air guide 44 arranged together in rear of the front panel 20. The dehumidifier may have the condenser 4 arranged in rear of the first fan 30, and the evaporator 8 arranged in rear of the condenser 4. The dehumidifier may have the barrier 24 arranged in rear of the bucket 22, and the compressor 2 arranged in rear of the barrier 24.

The operation of the dehumidifier of the present invention having the forgoing configuration will be described.

If all of the compressor 2, the first fan 30, and the second fan 40 are driven, the air may be drawn from the outside of the dehumidifier to the dehumidifier distributed to the first passage P1 and the second passage P2. As shown in FIG. 1, a portion of the air drawn into the dehumidifier from the outside of the dehumidifier may be drawn into the first passage P1, and the other portion of the air drawn into the dehumidifier may be drawn into the second passage P2. The air drawn into the first passage P1 may pass through, and dehumidified at, the evaporator 8, and, then, may have a temperature thereof elevated when the air passes through the condenser 4 as the air heat exchanges with the refrigerant passed through the condenser 4. The air passed through the condenser 4 may be drawn into the first fan 30. The air drawn into the first fan 30 after passing through the condenser 4 thus may flow to the second fan 40 owing to air blowing force of the first fan 30 and suction force of the second fan 40. The air drawn into the second passage P2 may be drawn into the second fan 40 without passed through the evaporator 8 and the condenser 4, and may join with the air A blown from the first fan 30 to the second fan 40 after passed through the evaporator 8 and the condenser 4. Since the air B drawn into the second passage P2 does not pass through the condenser 4, the air B has a temperature lower than the air A blown from the first fan 30 to the second fan 40 after passed through the evaporator 8 and the condenser 4, and a temperature of the mixed air being discharged to the air outlet 16 from the second fan 40 may have a temperature lower than the temperature of the air A passed through between the condenser 4 and the first fan 30 after passed through the evaporator 8 and the condenser 4. The air discharged to the air outlet 16 after blown to the air outlet 16 from the second fan 40 may have a flow rate higher than a case in which only one of the first fan 30 and the second fan 40 is driven and the other one is not driven, and the dehumidifier may drop the temperature of the air discharged to the outside to be lower than a case when only the first fan 30 is driven and the second fan 40 is not driven. If it is a case when the dehumidifier does not include the cleaning unit 50, the dehumidifier may function as a dehumidifier, and, if it is a case when the dehumidifier includes the cleaning unit 50, the dehumidifier may function as a dehumidifier and air cleaning unit. In this case, the dehumidifier may be in a high flow rate dehumidifying mode, or in a high flow rate dehumidifying air cleaning mode.

In the meantime, if the compressor 2 and the first fan 30 are stopped, and the second fan 40 is driven, the air may be drawn from the outside of the dehumidifier to the dehumidifier distributed to the first passage P1 and the second passage P2. As shown in FIG. 2, a portion of the air drawn into the dehumidifier from the outside of the dehumidifier may be drawn into the first passage P1, and the other portion of the air drawn into the dehumidifier may be drawn into the second passage P2. The air drawn from the outside of the dehumidifier to the dehumidifier may be drawn into the second passage P2 mostly, and a flow rate of the air lower than the flow rate of the air being drawn into the second passage P2 may be drawn into the first passage P1. The air drawn into the first passage P1 from the outside of the dehumidifier may be drawn into the second fan 40 after passed through the evaporator 8, the condenser 4 and the first fan 30 in succession. The air drawn into the second passage P2 may be drawn into the second fan 40 bypassed the evaporator 8, the condenser 4, and the first fan 30. The air drawn into the first passage P1 may pass the evaporator 8 without heat exchange therewith, then may pass through the condenser 4 without heat exchange therewith, and may be drawn into the second fan 40 after passed through the first fan 30 by suction force acting from the second fan 40. The air B drawn into the second passage P2 may be drawn into the second fan 40 without passed through the evaporator 8 and the condenser 4, and may join with the air A drawn into the second fan 40 from the first fan 30 after passed through the evaporator 8 and the condenser 4. The air A passed through the evaporator 8 and the condenser 4 without heat exchange therewith and the air B bypassed the evaporator 8 and the condenser 4 may be blown to the air outlet 16 by the second fan 40, together. The air discharged to the air outlet 16 after blown to the air outlet 16 from the second fan 40 may have a flow rate lower than a case when both the first fan 30 and the second fan 40 are driven. If it is a case when the dehumidifier does not include the cleaning unit 50, the dehumidifier may function as a fan, and, if it is a case when the dehumidifier includes the cleaning unit 50, the dehumidifier may function as an air cleaning unit. In this case, the dehumidifier may be in a low flow rate air blowing mode, or in a low flow rate air cleaning mode.

In the meantime, if the compressor 2 is stopped and the first fan 30 and the second fan 40 are driven together, the air may be drawn from the outside of the dehumidifier to the dehumidifier distributed to the first passage P1 and the second passage P2. As shown in FIG. 3, a portion of the air drawn into the dehumidifier from the outside of the dehumidifier may be drawn into the first passage P1, and the other portion of the air drawn into the dehumidifier may be drawn into the second passage P2. The air drawn into the first passage P1 may be drawn into the second fan 40 after passed through the evaporator 8 and the condenser 4 in succession. The air drawn into the second passage P2 may be drawn into the second fan 40 bypassed the evaporator 8, the condenser 4, and the first fan 30. The air drawn into the first passage P1 may pass through the evaporator 8 without heat exchange therewith, and then may pass through the condenser 4 without heat exchange therewith. The air passed through the heat exchangers thus without heat exchange therewith may be drawn into the first fan 30. The air drawn into the first fan 30 after passed through the condenser 4 may flow to the second fan 40 by the air blowing force of the first fan 30 and the suction force of the second fan 40. The air B drawn into the second passage P2 may be drawn into the second fan 40 without passed through the evaporator 8 and the condenser 4, and may join with the air A blown to the second fan 40 from the first fan 30 after passed through the evaporator 8 and the condenser 4. The air A passed through the evaporator 8 and the condenser 4 without heat exchange therewith and the air B bypassed the evaporator 8 and the condenser 4 may be blown to the air outlet 16 by the second fan 40, together. The air discharged to the air outlet 16 after blown to the air outlet 16 from the second fan 40 may have a flow rate higher than a case in which only one of the first fan 30 and the second fan 40 is driven and the other one is not driven. If it is a case when the dehumidifier does not include the cleaning unit 50, the dehumidifier may function as a fan, and, if it is a case when the dehumidifier includes the cleaning unit 50, the dehumidifier may function as an air cleaning unit. In this case, the dehumidifier may be in a high flow rate air blowing mode, or in a high flow rate air cleaning mode.

In the meantime, if the compressor 2 and the first fan 30 are driven, and the second fan 40 is stopped, the air may be drawn from the outside of the dehumidifier, not into the second passage P2, but into the first passage P1. As shown in FIG. 4, the air drawn from the outside of the dehumidifier into the first passage P1 may be dehumidified as the air passes through the evaporator 8, and may have a temperature thereof elevated by the refrigerant passing through the condenser 4 as the air passes through the condenser 4. The air passed through the condenser 4 may be drawn into the first fan 30. The air drawn into the first fan 30 after passed through the condenser 4 thus may be blown toward the second fan 40 by air blowing force of the first fan 30, may be blown to the air outlet 16 passed through the second fan 40, and may be discharged to the outside of the dehumidifier through the air outlet 16. The air discharged to the air outlet 16 passed through the second fan 40 after blown by the first fan 30 may have a flow rate lower than a case when both the first fan 30 and the second fan 40 are driven. If it is a case when the dehumidifier does not include the cleaning unit 50, the dehumidifier may function as a dehumidifier, and, if it is a case when the dehumidifier includes the cleaning unit 50, the dehumidifier may function as a dehumidifier and air cleaning unit. In this case, the dehumidifier may be in a low flow rate dehumidifying mode, or in a low flow rate dehumidifying and air cleaning mode.

In the meantime, if the compressor 2 and the second fan 40 are stopped, and the first fan 30 is driven, the air may be drawn from the outside of the dehumidifier, not into the second passage P2, but into the first passage P1. As shown in FIG. 5, the air drawn into the first passage P1 from the outside of the dehumidifier may pass through the evaporator 8 without heat exchange therewith, then, may pass through the condenser 8 without heat exchange therewith, and may be drawn into the first fan 30. The air drawn into the first fan 30 thus may be blown to the second fan 40 by air blowing force of the first fan 30, may be blown to the air outlet 16 passed through the second fan 40, and may be discharged to the outside of the dehumidifier through the air outlet 16. The air discharged through the air outlet 16 passed through the second fan 40 after blown by the first fan 30 may have a flow rate lower than a case when both of the first fan 30 and the second fan 40 are driven. If it is a case when the dehumidifier does not include the cleaning unit 50, the dehumidifier may function as a fan, and, if it is a case when the dehumidifier includes the cleaning unit 50, the dehumidifier may function as an air cleaning unit. In this case, the dehumidifier may be in a low flow rate air blowing mode, or in a low flow rate air cleaning mode.

Figure 6:
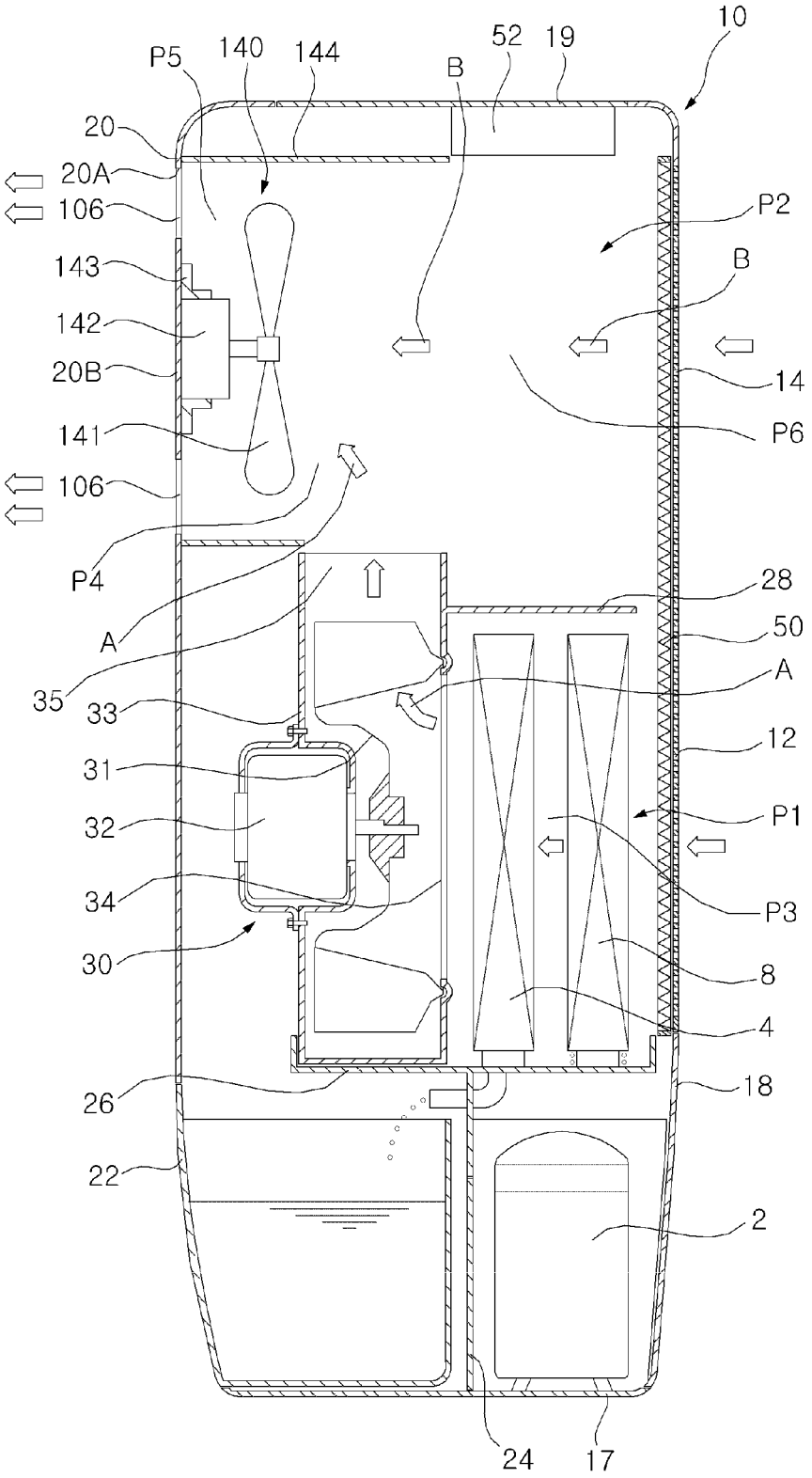
FIG. 6 is a schematic view illustrating a dehumidifier in accordance with a second preferred embodiment of the present invention, showing an air flow when all of a compressor, a first fan and a second fan are driven.
Figure 7:
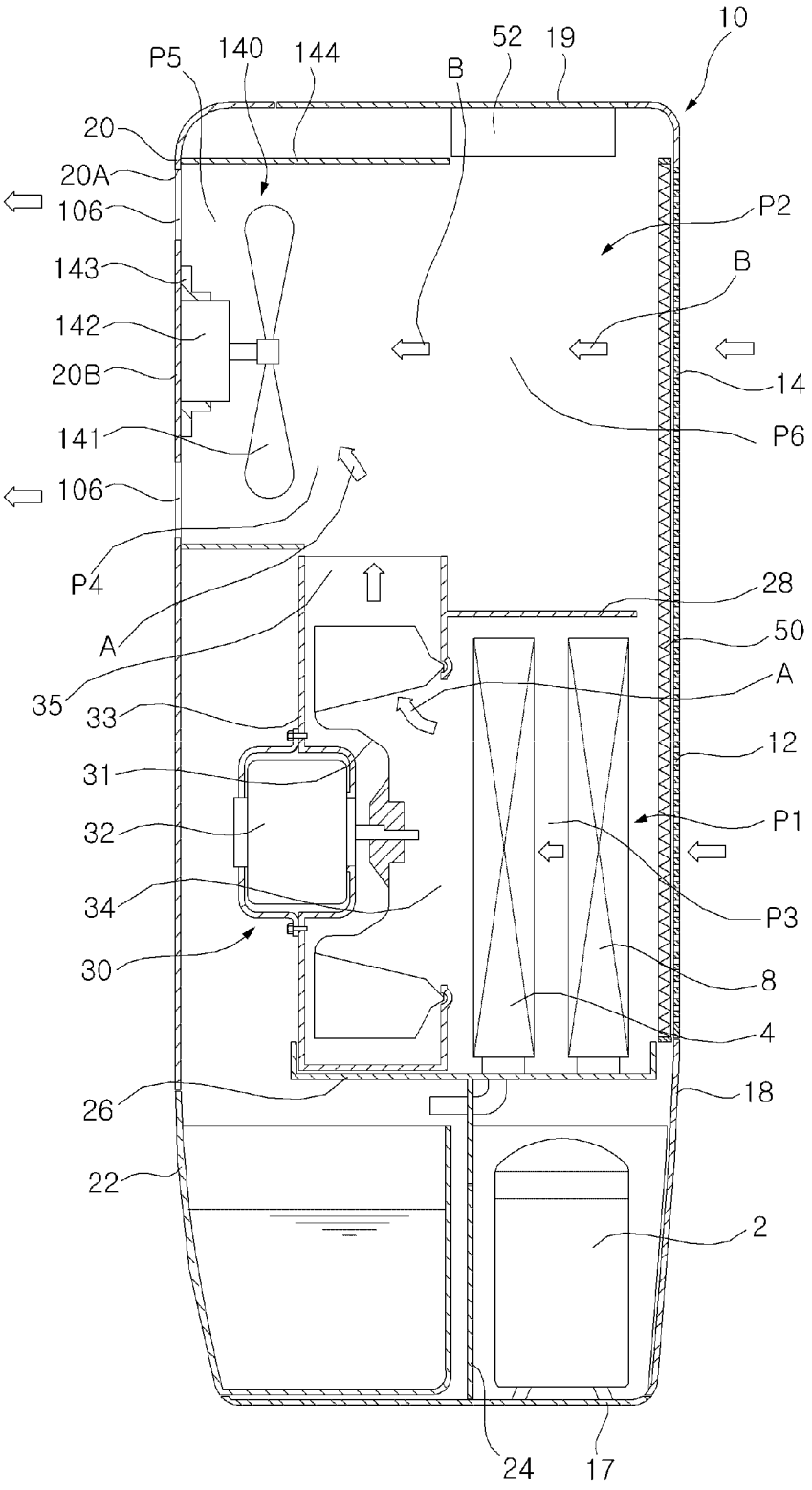
FIG. 7 is a schematic view illustrating a dehumidifier in accordance with a second preferred embodiment of the present invention, showing an air flow when a compressor and a first fan are stopped and a second fan is driven.
Figure 8:
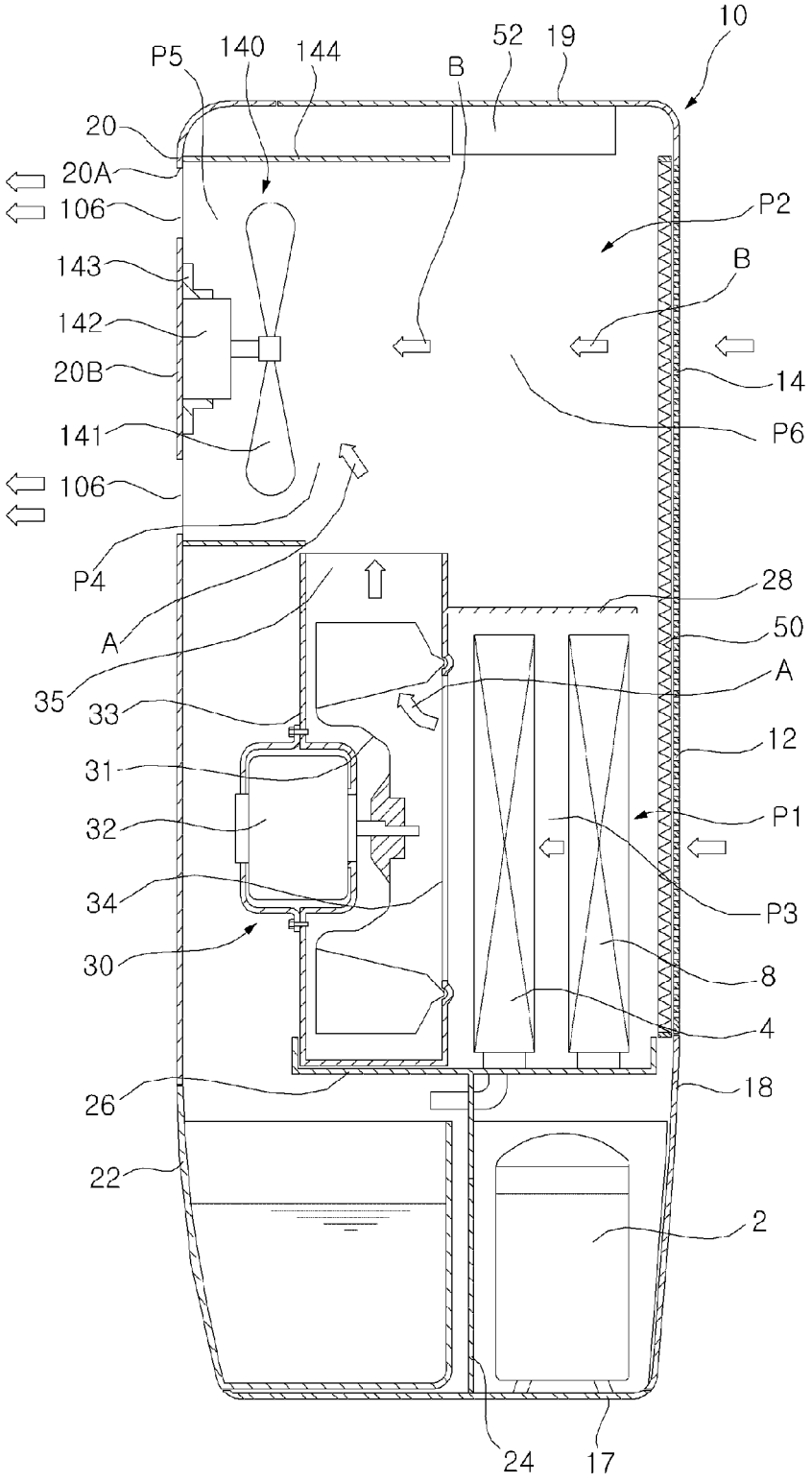
FIG. 8 is a schematic view illustrating a dehumidifier in accordance with a second preferred embodiment of the present invention, showing an air flow when a compressor is stopped and both a first fan and a second fan are driven.
Figure 9:
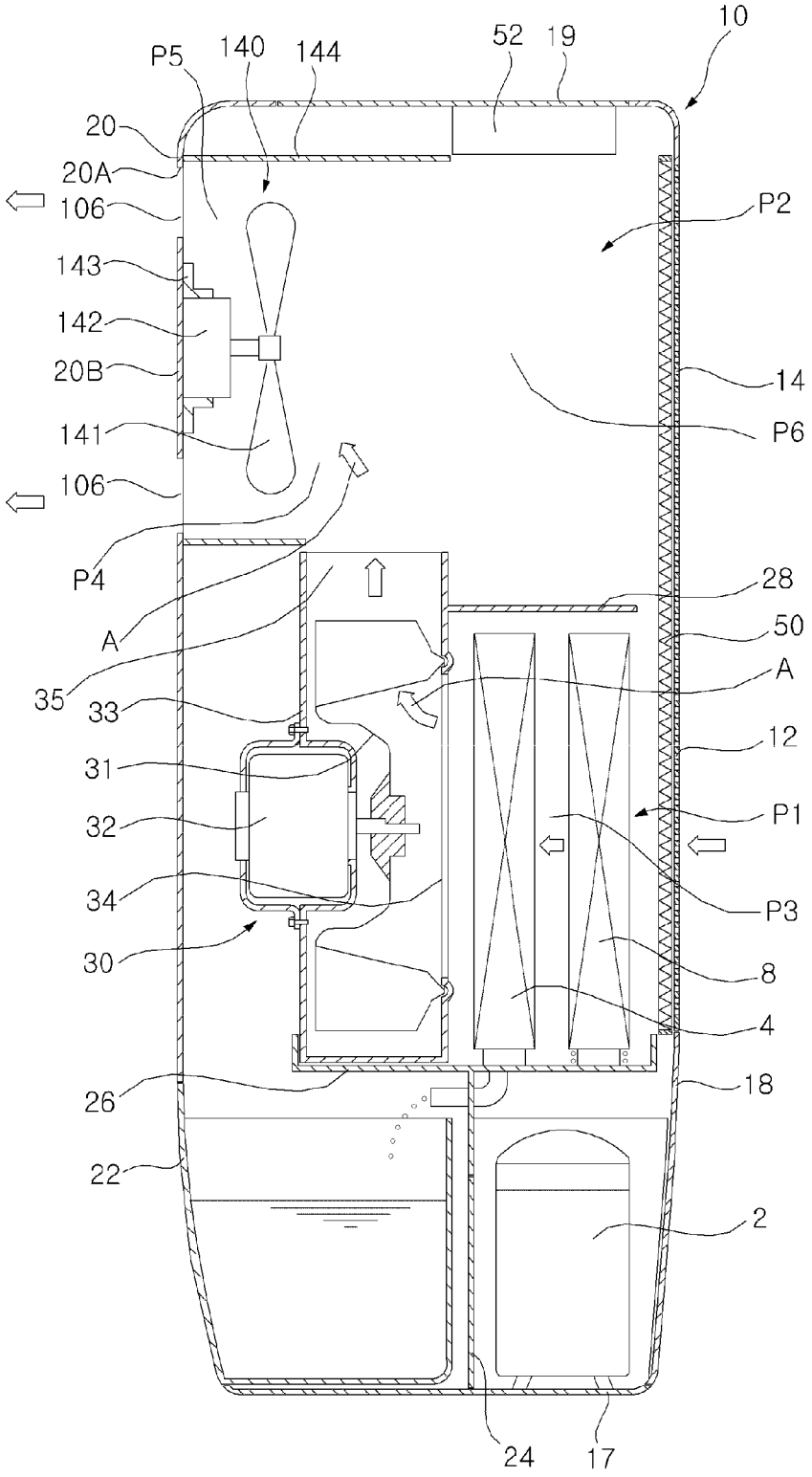
FIG. 9 is a schematic view illustrating a dehumidifier in accordance with a second preferred embodiment of the present invention, showing an air flow when a compressor and a first fan are driven and a second fan is stopped.
Figure 10:
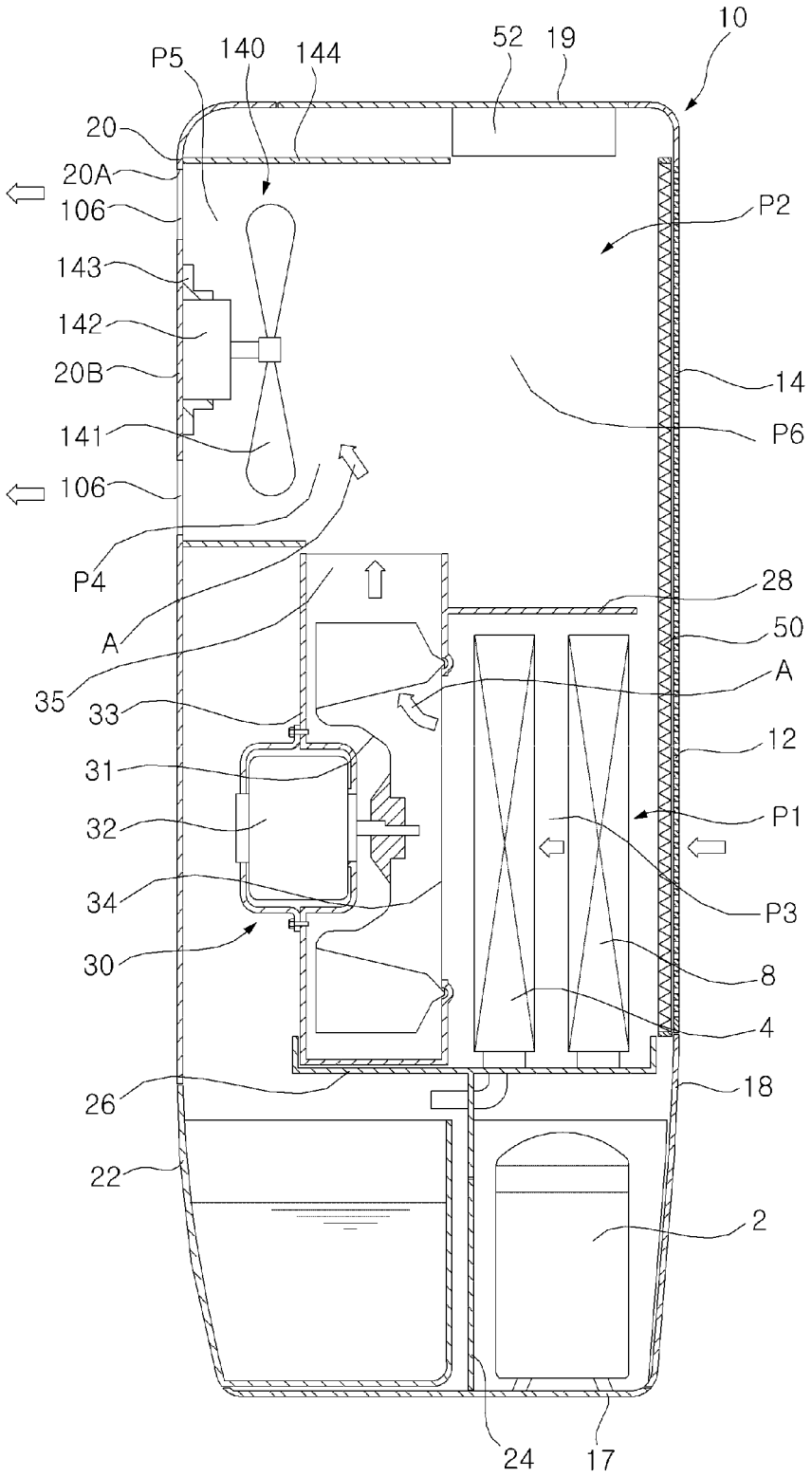
FIG. 10 is a schematic view illustrating a dehumidifier in accordance with a second preferred embodiment of the present invention, showing an air flow when a compressor and a second fan are stopped and a first fan is driven.

FIG. 6 is a schematic view illustrating a dehumidifier in accordance with a second preferred embodiment of the present invention, showing an air flow when all of a compressor, a first fan and a second fan are driven, FIG. 7 is a schematic view illustrating a dehumidifier in accordance with a second preferred embodiment of the present invention, showing an air flow when a compressor and a first fan are stopped and a second fan is driven, FIG. 8 is a schematic view illustrating a dehumidifier in accordance with a second preferred embodiment of the present invention, showing an air flow when a compressor is stopped and both a first fan and a second fan are driven, FIG. 9 is a schematic view illustrating a dehumidifier in accordance with a second preferred embodiment of the present invention, showing an air flow when a compressor and a first fan are driven and a second fan is stopped, and FIG. 10 is a schematic view illustrating a dehumidifier in accordance with a second preferred embodiment of the present invention, showing an air flow when a compressor and a second fan are stopped and a first fan is driven.

Since configurations and operations of the dehumidifier in accordance with the second preferred embodiment of the present invention are the same or similar to the first embodiment of the present invention except air discharge directions and the second fan 140, the same reference numerals will be used and detailed description of the same or similar configurations and operations will be omitted.

The dehumidifier may discharge the air in a front direction, and an air outlet 106 may be formed in a front of the casing 10 to be opened in a front/rear direction. The casing 10 may include a base 17, a suction panel 18, a top panel 19, a front panel 20, and the air outlet 106 is formed, not in the top panel 19, but in the front panel 20 opened in the front/rear direction. In this case, the front panel 20 may become a discharge panel. Since the air outlet 106 is formed in a front side of the casing 10, the air outlet 106 may be a front air outlet for discharging the air in the front direction. The air outlet 106 may be formed in the casing 10 in an annular shape. In order to form the annular air outlet 106, a circular opening 20A may be formed in the front panel 20, and an inner guide 20B may be mounted to an inner side of the circular opening 20A to form the annular air outlet 106. The inner guide 20B may be fixedly secured to the front panel 20 or the air guide 44 with at least one supporting leg. The inner guide 20B may have an outside circumference spaced from the circular opening 20A. The annular air outlet 106 may be formed between the outside circumference of the inner guide 20B and the circular opening 20A.

The second fan 140 may have an air blowing direction different from the air blowing direction of the second fan 40 of the first embodiment, but with the same functions. The second fan 140 may be mounted to draw the air from a rear side and discharge to a front side. The second fan 140 may be mounted to be positioned in rear of the front panel 20. The second fan 140 may have a horizontal rotating central axis. The first fan 30 may be arranged to have a horizontal rotating central axis to draw the air in the front/rear direction and blow the air upward, and the second fan 140 may draw the air from the rear side and blow the air to the front side in a state the second fan 140 has the rotating central axis parallel with the rotating central axis of the first fan 30. The second fan 140 may be mounted to be positioned in front of the first fan 30, or mounted to be positioned on an upper side of front side of the first fan 30. The second fan 140 may include an impeller 141, and a motor 142 for rotating the impeller 141. The second fan 140 may further include a motor mounter 143 for mounting the motor 142. The motor 142 may be arranged to have a rotation shaft projected backward. The dehumidifier may further include an air guide 144 for guiding the air blown by the second fan 140 to the air outlet 106. The air guide 144 may be formed to have a hollow shape. The air guide 144 may have an opened front side and an opened rear side for guiding the air in a front/rear direction. The air guide 144 may have a fore end arranged to face the air outlet 106. The air guide 144 may have a rear end arranged to face an air inlet 14 which draws the air which will bypass the evaporator 8 and the condenser 4. The air guide 144 may have an opening for introducing the air A flowing from the first fan 30 thereto, and an opening for introducing the air B bypassed the evaporator 8 and the condenser 4 thereto formed therein, respectively. It is also possible that the air guide 144 has one opening for introducing the air A flowing from the first fan 30 and the air B bypassed the evaporator 8 and the condenser thereto. If the dehumidifier includes the air guide 144, the air guide 144 may be mounted to be positioned between the first fan 30 and the air outlet 106. In the meantime, the second fan 140 may be mounted to an outside of the outlet portion 35 of the first fan 30, for generating suction force from an outer side of the first fan 30 to an inner side of the first fan 30. The second fan 140 may be mounted to the casing 10 or the air guide 144. If the second fan 140 is mounted to the casing 10, the second fan 140 may be mounted to the front panel 20. The second fan 140 may have the motor mounter 143 mounted to the front panel 20. If the second fan 140 is mounted to the inner guide 20B, the motor mounter 143 may be mounted to the air guide 144. The second fan 140 may be mounted to be positioned in the air guide 144.

Alike the first preferred embodiment of the present invention, the dehumidifier of the embodiment suggests including a first passage P1 for drawing the air and discharging the air to the outside of the dehumidifier after the air is passed through the evaporator 8, the condenser 4, the first fan 30 and the second fan 140 in succession, and a second passage P2 for drawing the air and discharging the air to the outside of the dehumidifier after the air is passed through the second fan 140. Alike the first preferred embodiment of the present invention, the first passage P1 may include a first fan suction flow passage P3, a first fan inside flow passage, a fan connection flow passage P4, and a common discharge flow passage P5. Alike the first preferred embodiment of the present invention, the second passage P2 may include a second fan suction flow passage P6 and the common discharge flow passage P5.

Alike the first preferred embodiment of the present invention, the embodiment suggests performing a plurality of operation modes, selectively.

In the first mode, the dehumidifier may have all of the compressor 2, the first fan 30 and the second fan 140 driven, and, as shown in FIG. 6, the air may be drawn into the dehumidifier from the outside of the dehumidifier distributed to the first passage P1 and the second passage P2. Alike the first mode in the first preferred embodiment of the present invention, the air drawn into the first passage P1 from the outside of the dehumidifier may be heated at the condenser 4 after dehumidified at the evaporator 8 and may be drawn into the first fan 30 from the condenser 4. The air drawn into the first fan 30 may be blown to the second fan 140 from the first fan 30. Alike the first mode in the first preferred embodiment of the present invention, the air drawn into the second passage P2 from the outside of the dehumidifier may be drawn into the second fan 140 bypassed the evaporator 8, the condenser 4, and the first fan 30. The air A blown to the second fan 140 from the first fan 30 may join with the air B bypassed the evaporator 8, the condenser 4, and the first fan 30, and may be blown to a front direction of the second fan 140. The air blown to a front side of the second fan 140 thus is discharged to a front side of the air outlet 106 passed through the air outlet 106. The dehumidifier may discharge the air to the front side at a higher flow rate and a lower temperature than a case in which one of the first fan 30 and the second fan 140 is driven and the other one is not driven. The dehumidifier may function as a high flow rate dehumidifier which discharges a high flow rate of dehumidified air blown by the two fans 30 and 140 to the front side of the air outlet 106.

In the second mode, the dehumidifier may have the compressor 2 and the first fan 30 stopped, and the second fan 140 driven, and, as shown in FIG. 7, the air may be drawn from the outside of the dehumidifier distributed to the first passage P1 and the second passage P2. Alike the second mode in the first preferred embodiment of the present invention, the air drawn into the first passage P1 from the outside of the dehumidifier may be blown to the second fan 140 from the first fan 30 after passed through the evaporator 8 and the condenser 4 in succession without heat exchange therewith. Alike the second mode in the first preferred embodiment of the present invention, the air drawn into the second passage P2 from the outside of the dehumidifier may be drawn into the second fan 140 bypassed the evaporator 8, the condenser 4, and the first fan 30. The air A blown to the second fan 140 from the first fan 30 may join with the air B bypassed the evaporator 8, the condenser 4, and the first fan 30, and may be blown to the front side of the second fan 140. The air blown to the front direction of the second fan 140 thus is discharged to the front side of the air outlet 106 passed through the air outlet 106, and the dehumidifier may function as a fan which blows the air to the front side of the air outlet 106.

In the third mode, the dehumidifier may have the compressor 2 stopped, the first fan 30 and the second fan 140 driven together, and, as shown in FIG. 8, the air may be drawn from the outside of the dehumidifier distributed to the first passage P1 and the second passage P2. Alike the third mode in the first preferred embodiment of the present invention, the air drawn into the first passage P1 from the outside of the dehumidifier may be blown to the second fan 140 from the first fan 30 after passed through the evaporator 8 and the condenser 4 in succession without heat exchange therewith. Alike the third mode in the first preferred embodiment of the present invention, the air drawn into the second passage P2 from the outside of the dehumidifier may be drawn into the second fan 140 bypassed the evaporator 8, the condenser 4, and the first fan 30. The air A blown to the second fan 140 from the first fan 30 thus may join with the air B bypassed the evaporator 8, the condenser 4, and the first fan 30, and may be blown to the front side of the second fan 140. The air blown to the front side of the second fan 140 thus is discharged to the front side of the air outlet 106 passed through the air outlet 106, and the dehumidifier may function as a fan which blows the air to the front side. In the third mode, the dehumidifier may discharge the air at a high flow rate than the case in which one of the first fan 30 and the second fan 140 is driven and the other one is stopped, and may function as a high flow rate fan which blows a high flow rate of the air blown by the two fans 30 and 140 to the front side of the air outlet 106.

In the fourth mode, the dehumidifier may have the compressor 2 and the first fan 30 driven, and the second fan 140 stopped, and, as shown in FIG. 9, the air may be drawn from the outside of the dehumidifier, not into the second passage P2, but into the first passage P1. Alike the fourth mode in the first preferred embodiment of the present invention, the air drawn into the first passage P1 from the outside of the dehumidifier thus may have the temperature of the air elevated at the condenser 4 after dehumidified at the evaporator 8, and may be drawn into the first fan 30 from the condenser 4. The air drawn into the first fan 30 thus may be blown to the second fan 140 from the first fan 30 by the air blowing force of the first fan 30, may be blown to the air outlet 106 passed through the second fan 140, and may be discharged to the front side of the air outlet 106. The dehumidifier may function as a dehumidifier which discharges dehumidified air to the front side of the air outlet 106.

In the fifth mode, the dehumidifier may have the compressor 2 and the second fan 140 stopped, and the first fan 30 driven, and, as shown in FIG. 10, the air may be drawn from the outside of the dehumidifier, not into the second passage P2, but into the first passage P1. Alike the fifth mode in the first preferred embodiment of the present invention, the air drawn into the first passage P1 from the outside of the dehumidifier may be drawn into the first fan 30 after passed through the evaporator 8 and the condenser 4 in succession without heat exchange therewith. The air drawn into the first fan 30 thus may be blown to the second fan 140 from the first fan 30 by the air blowing force of the first fan 30, may be blown to the air outlet 106 passed through the second fan 140, and may be discharged to the front side of the air outlet 106. The dehumidifier may function as a fan which discharges the air to the front side of the air outlet 106.

Figure 11:
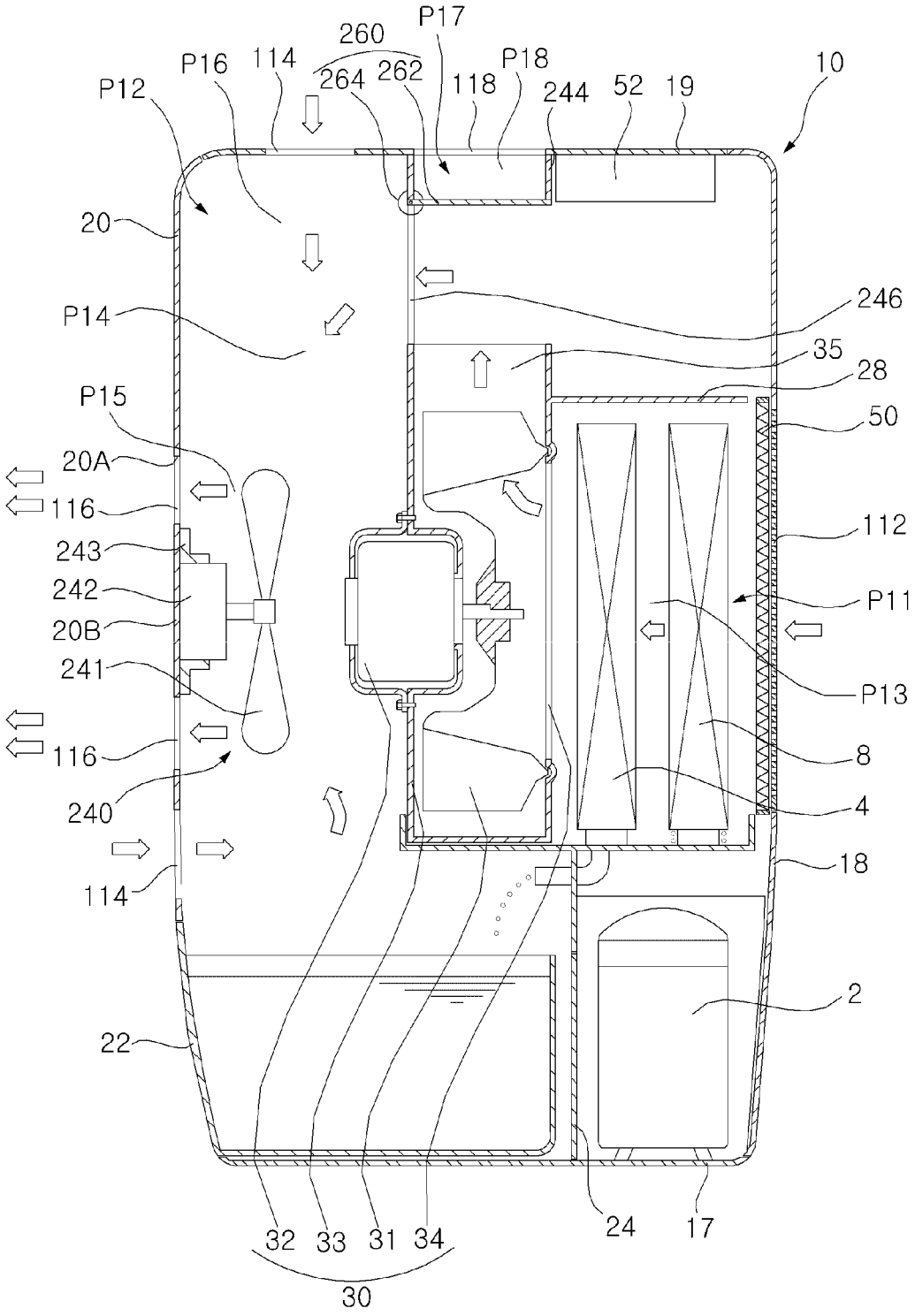
FIG. 11 is a schematic view illustrating a dehumidifier in accordance with a third preferred embodiment of the present invention, showing an air flow when all of a compressor, a first fan and a second fan are driven and a flow passage control device is in a first air outlet discharge mode.
Figure 12:
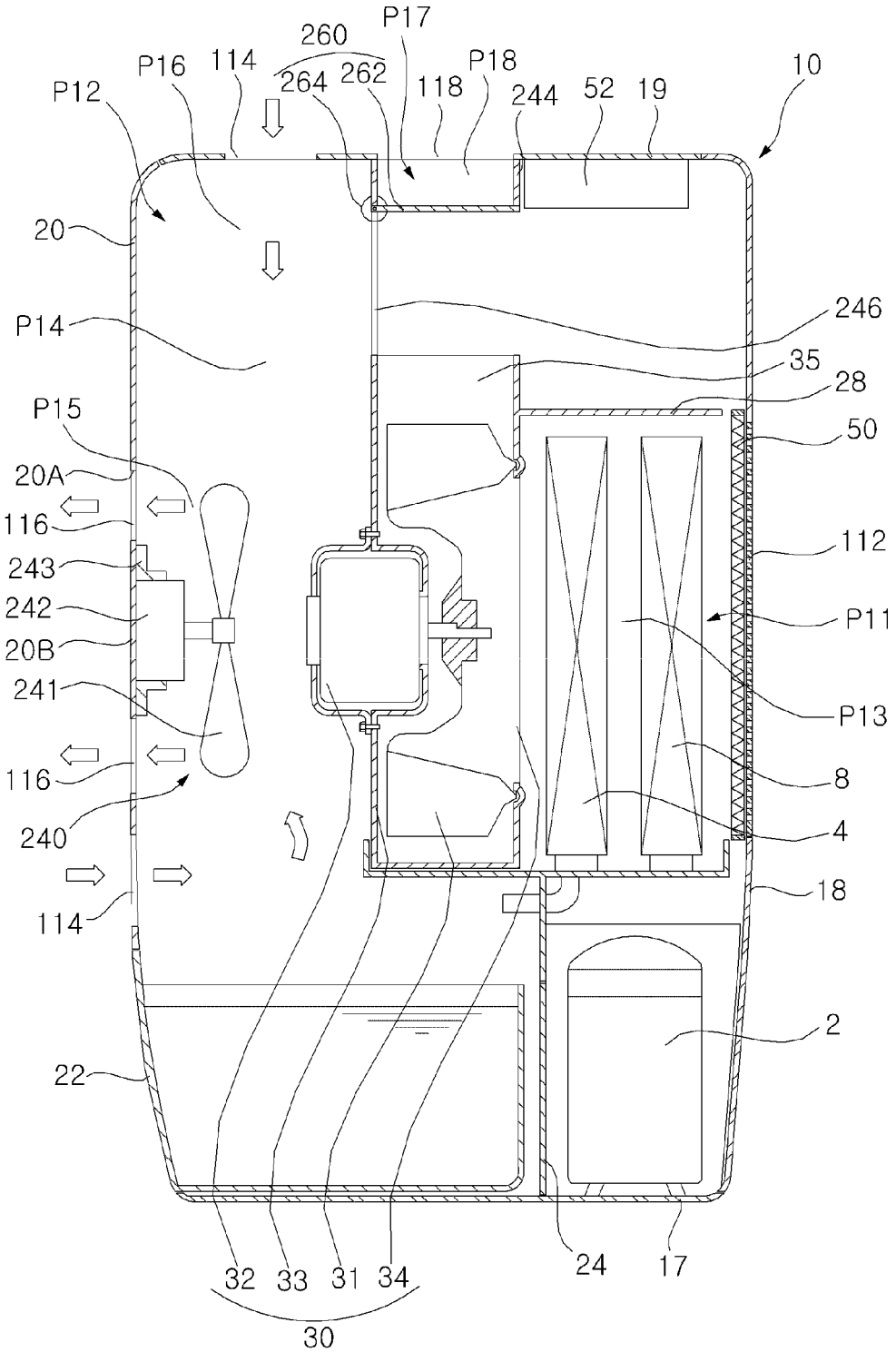
FIG. 12 is a schematic view illustrating a dehumidifier in accordance with a third preferred embodiment of the present invention, showing an air flow when a compressor and a first fan are driven, a second fan is stopped, and a flow passage control device is in a first air outlet discharge mode.
Figure 13:
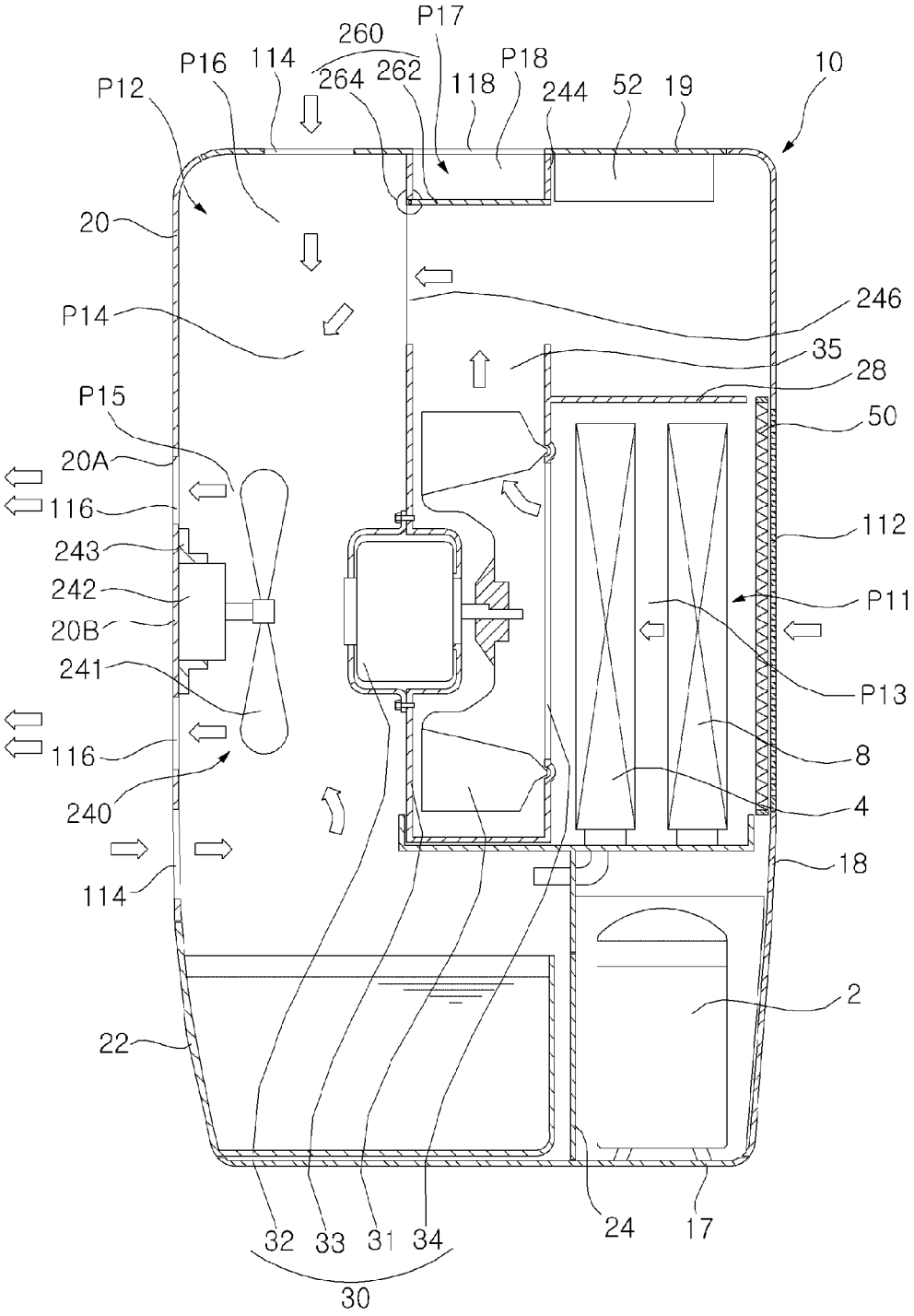
FIG. 13 is a schematic view illustrating a dehumidifier in accordance with a third preferred embodiment of the present invention, showing an air flow when a compressor is stopped, both a first fan and a second fan are driven, and a flow passage control device is in a first air outlet discharge mode.
Figure 14:
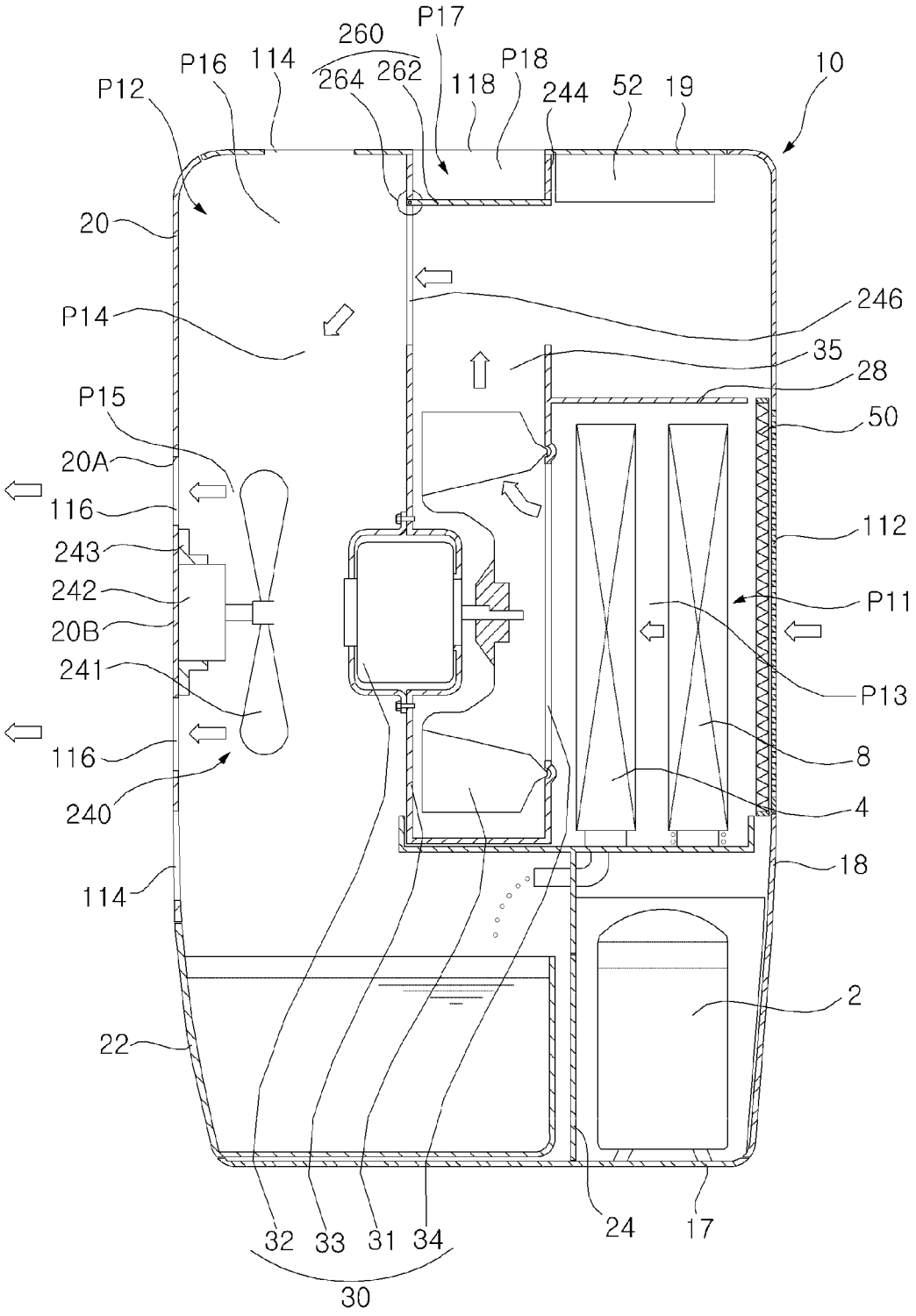
FIG. 14 is a schematic view illustrating a dehumidifier in accordance with a third preferred embodiment of the present invention, showing an air flow when a compressor and a first fan are driven, a second fan is stopped, and a flow passage control device is in a first air outlet discharge mode.
Figure 15:
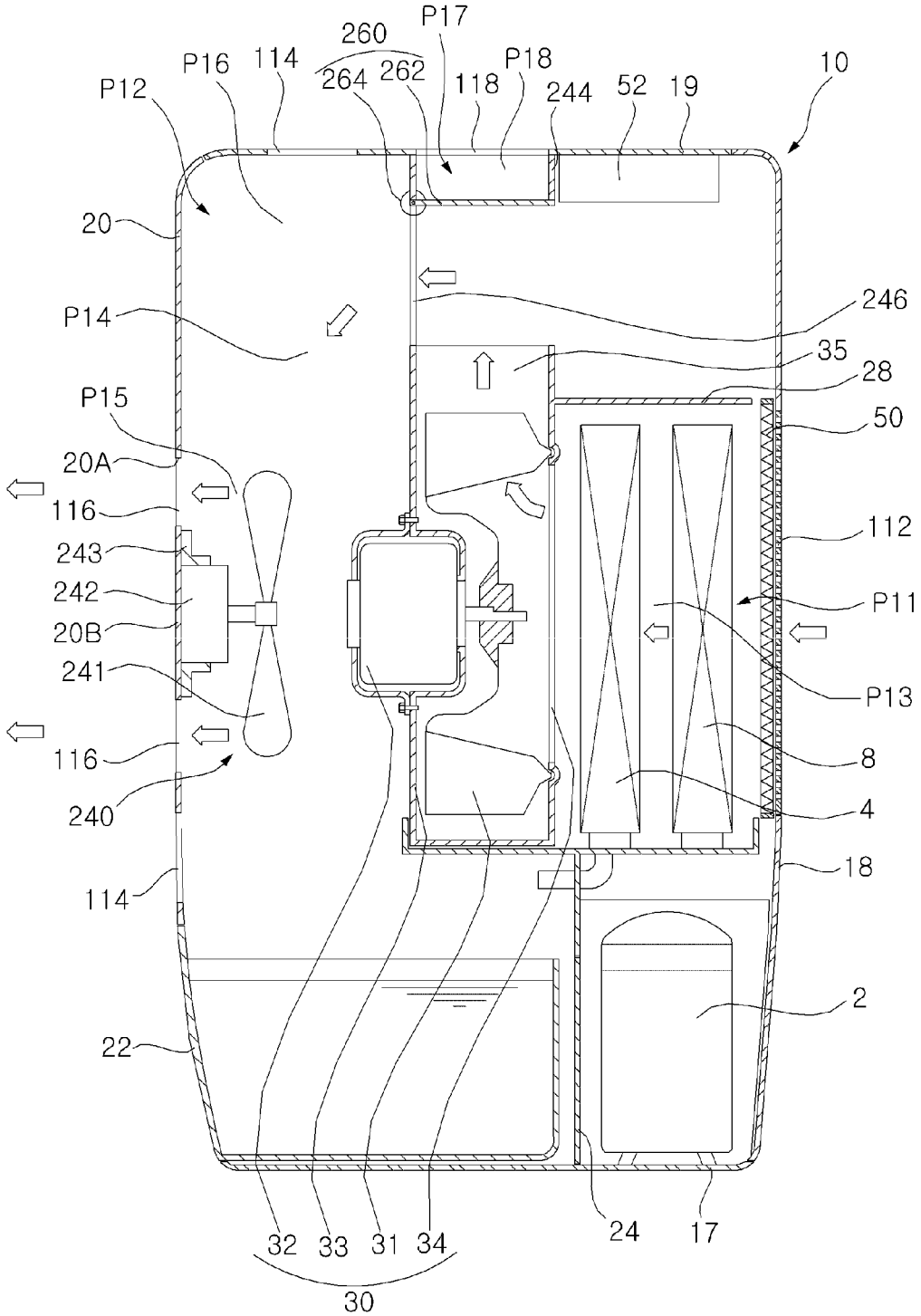
FIG. 15 is a schematic view illustrating a dehumidifier in accordance with a third preferred embodiment of the present invention, showing an air flow when a compressor and a second fan are stopped, a first fan is driven, and a flow passage control device is in a first air outlet discharge mode.
Figure 16:
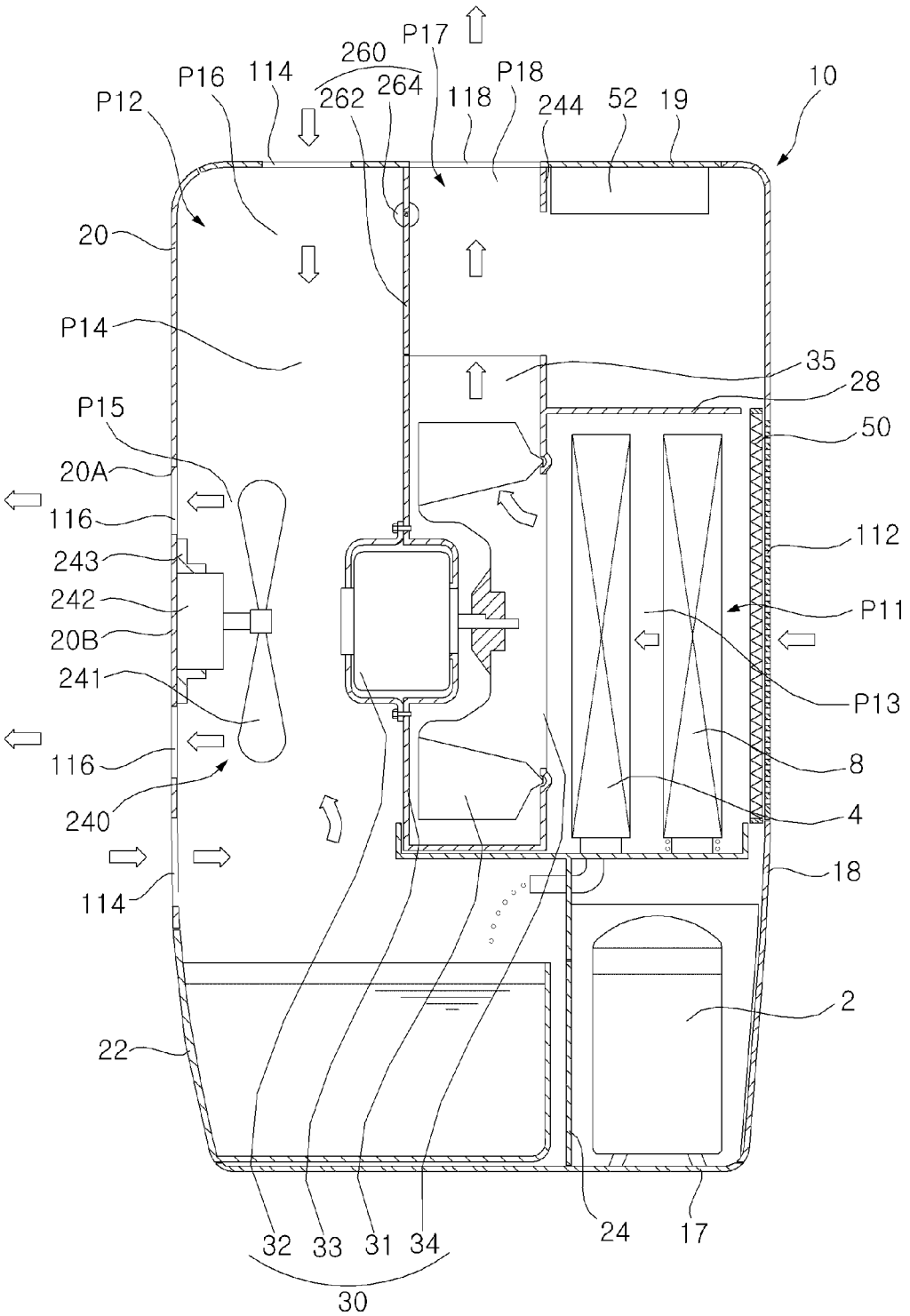
FIG. 16 is a schematic view illustrating a dehumidifier in accordance with a third preferred embodiment of the present invention, showing an air flow when all of a compressor, a first fan and a second fan are driven and a flow passage control device is in a second air outlet discharge mode.
Figure 17:
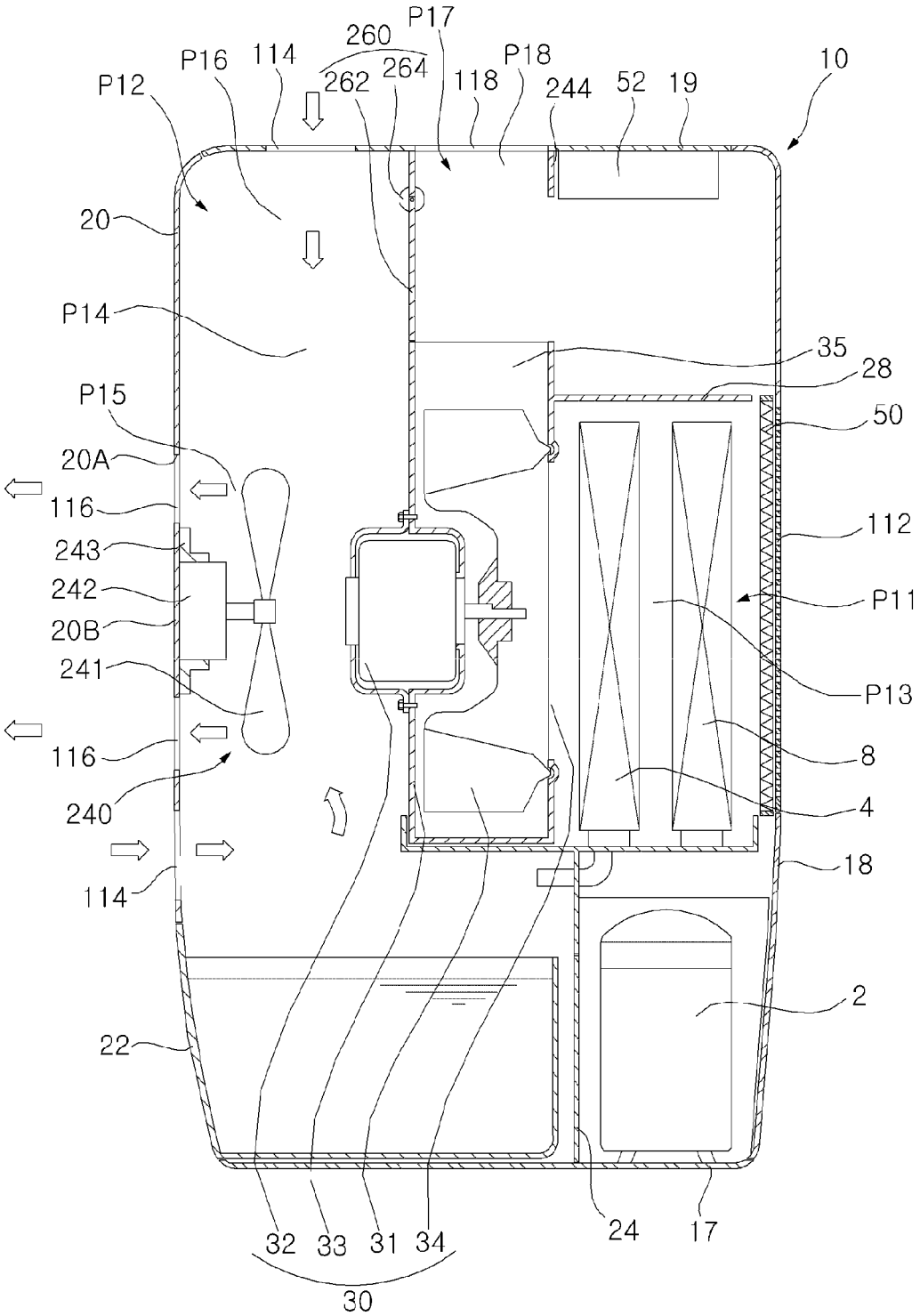
FIG. 17 is a schematic view illustrating a dehumidifier in accordance with a third preferred embodiment of the present invention, showing an air flow when a compressor and a first fan are stopped, a second fan is driven, and a flow passage control device is in a second air outlet discharge mode.
Figure 18:
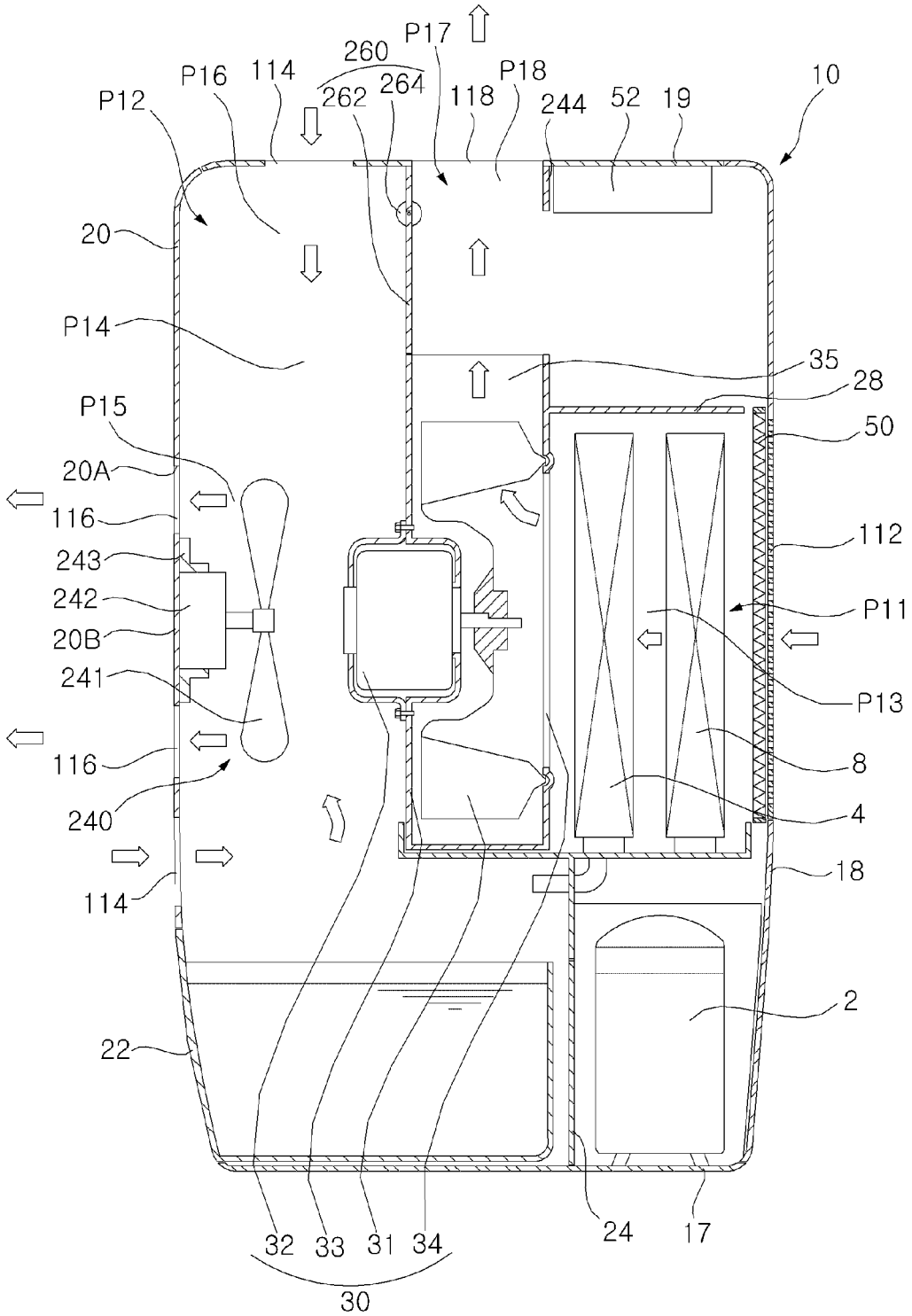
FIG. 18 is a schematic view illustrating a dehumidifier in accordance with a third preferred embodiment of the present invention, showing an air flow when a compressor is stopped, both a first fan and a second fan are driven, and a flow passage control device is in a second air outlet discharge mode.
Figure 19:
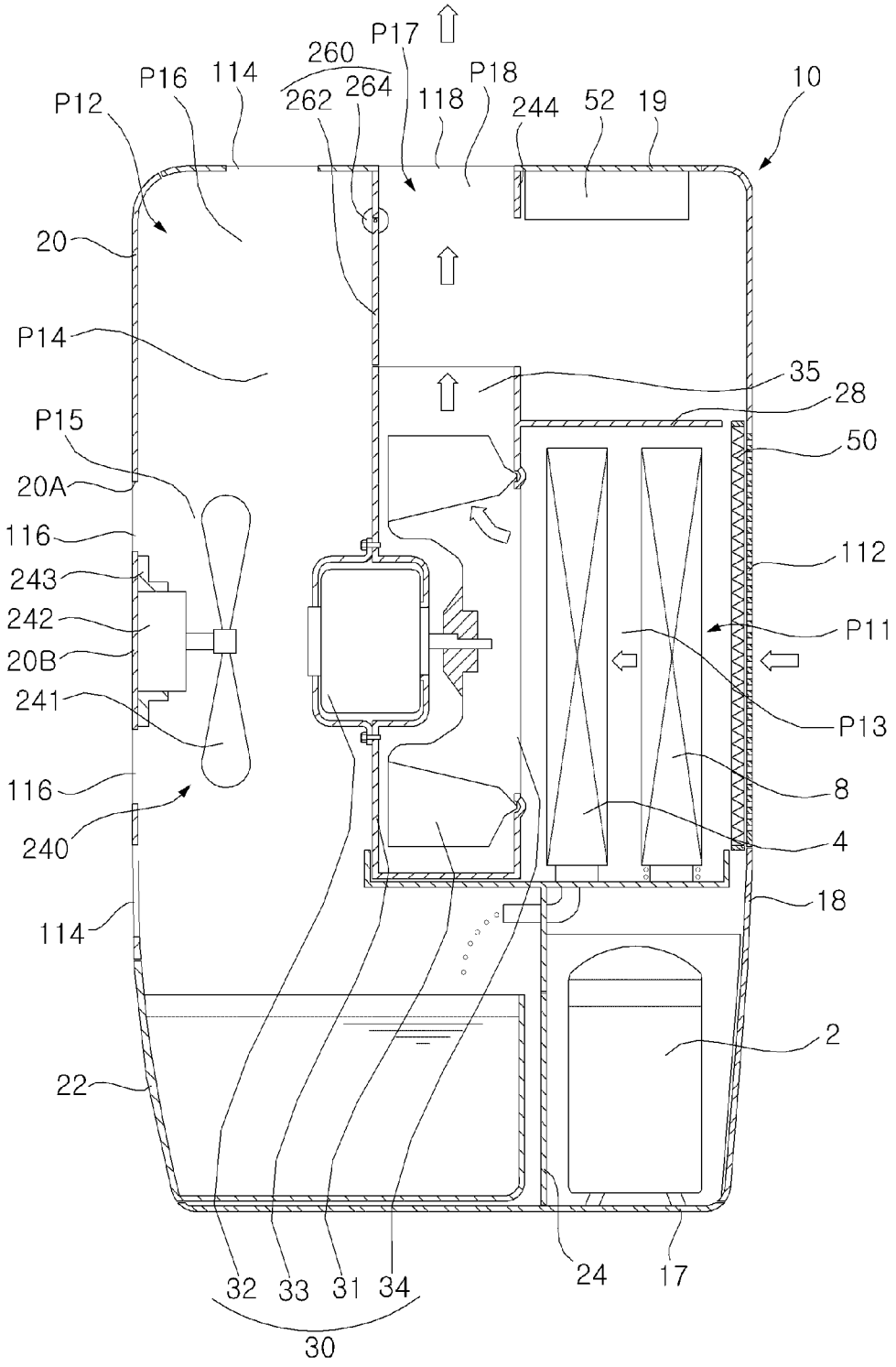
FIG. 19 is a schematic view illustrating a dehumidifier in accordance with a third preferred embodiment of the present invention, showing an air flow when a compressor and a first fan are driven, a second fan is stopped, and a flow passage control device is in a second air outlet discharge mode.
Figure 20:
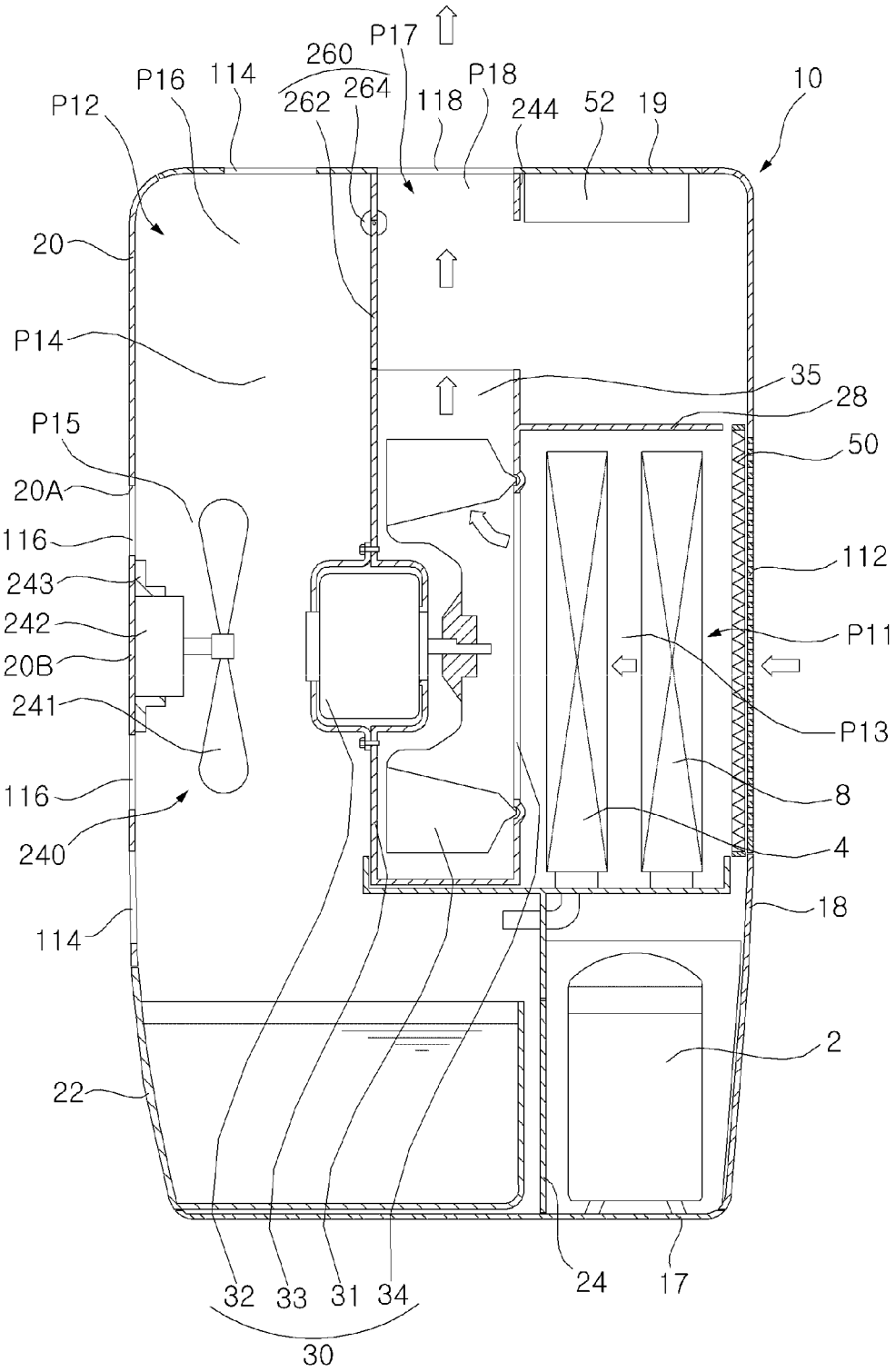
FIG. 20 is a schematic view illustrating a dehumidifier in accordance with a third preferred embodiment of the present invention, showing an air flow when a compressor and a second fan are stopped, a first fan is driven, and a flow passage control device is in a second air outlet discharge mode.

FIG. 11 is a schematic view illustrating a dehumidifier in accordance with a third preferred embodiment of the present invention, showing an air flow when all of a compressor, a first fan and a second fan are driven and a flow passage control device is in a first air outlet discharge mode, FIG. 12 is a schematic view illustrating a dehumidifier in accordance with a third preferred embodiment of the present invention, showing an air flow when a compressor and a first fan are driven, a second fan is stopped, and a flow passage control device is in a first air outlet discharge mode, FIG. 13 is a schematic view illustrating a dehumidifier in accordance with a third preferred embodiment of the present invention, showing an air flow when a compressor is stopped, both a first fan and a second fan are driven, and a flow passage control device is in a first air outlet discharge mode, FIG. 14 is a schematic view illustrating a dehumidifier in accordance with a third preferred embodiment of the present invention, showing an air flow when a compressor and a first fan are driven, a second fan is stopped, and a flow passage control device is in a first air outlet discharge mode, FIG. 15 is a schematic view illustrating a dehumidifier in accordance with a third preferred embodiment of the present invention, showing an air flow when a compressor and a second fan are stopped, a first fan is driven, and a flow passage control device is in a first air outlet discharge mode, FIG. 16 is a schematic view illustrating a dehumidifier in accordance with a third preferred embodiment of the present invention, showing an air flow when all of a compressor, a first fan and a second fan are driven and a flow passage control device is in a second air outlet discharge mode, FIG. 17 is a schematic view illustrating a dehumidifier in accordance with a third preferred embodiment of the present invention, showing an air flow when a compressor and a first fan are stopped, a second fan is driven, and a flow passage control device is in a second air outlet discharge mode, FIG. 18 is a schematic view illustrating a dehumidifier in accordance with a third preferred embodiment of the present invention, showing an air flow when a compressor is stopped, both a first fan and a second fan are driven, and a flow passage control device is in a second air outlet discharge mode, FIG. 19 is a schematic view illustrating a dehumidifier in accordance with a third preferred embodiment of the present invention, showing an air flow when a compressor and a first fan are driven, a second fan is stopped, and a flow passage control device is in a second air outlet discharge mode, and FIG. 20 is a schematic view illustrating a dehumidifier in accordance with a third preferred embodiment of the present invention, showing an air flow when a compressor and a second fan are stopped, a first fan is driven, and a flow passage control device is in a second air outlet discharge mode.

The dehumidifier of the embodiment may have a first air inlet 112 and a second air inlet 114 formed therein for drawing the air therein, and a first air outlet 116 and a second air outlet 118 formed therein for discharging the air therefrom.

The first air inlet 112 and the second air inlet 114 may be formed in different sides of the dehumidifier. The first air inlet 112 may be formed in a rear side of the dehumidifier, and the second air inlet 114 may be formed in at least one of an upper side, a lower side, a right side, and a left side. The first air inlet 112 may be formed at a relatively rear portion than the second air inlet 114. If the first air inlet 112 is a rear inlet, the second air inlet 114 may be a front inlet. The second inlet 114 may be plural formed in different sides of the dehumidifier. The second air inlet 114 may be formed at least one in the upper side of the dehumidifier, as well as at least one in the front side of the dehumidifier.

The first air outlet 116 and the second air outlet 118 may be formed in different sides of the dehumidifier. The first air outlet 116 and the second air outlet 118 may be formed to discharge the air in directions of the dehumidifier different from one another. The first air outlet 116 may be formed to be opened in the front/rear direction of the casing 10, and the second air outlet 118 may be formed in the casing 10 to discharge the air in a direction different from the first air outlet 116. The first air outlet 116 may be formed in the front side of the dehumidifier, and the second air outlet 118 may be formed at least one side of the upper side, the lower side, the right side, and the left side of the dehumidifier. If formed in the upper side of the dehumidifier, the second air outlet 118 may discharge the air blown from the first fan 30 to the upper side of the dehumidifier, if formed in the rear side of the dehumidifier, the second air outlet 118 may discharge the air blown from the first fan 30 to the rear side of the dehumidifier, if formed in at least one the left side and right side of the dehumidifier, the second air outlet 118 may discharge the air blown from the first fan 30 to a lateral direction of the dehumidifier. The first air outlet 116 may be formed in front of the second air outlet 118 relatively, and the first air outlet 116 is a front air outlet, the second air outlet 118 may be a rear air outlet. The dehumidifier may further include a second air outlet air guide 244 for guiding discharge of the air blown from the first fan 30 to the second air outlet 118. The second air outlet air guide 244 may be mounted to be positioned between the first fan 30 and the second air outlet 118. The second air outlet air guide 244 may be formed to have a hollow shape. If the second air outlet 118 is formed to discharge the air to the upper side of the dehumidifier, the second air outlet air guide 244 may be formed to guide the air blown from the first fan 30 in a vertical direction. If the second air outlet 118 is formed to discharge the air to the rear side of the dehumidifier, the second air outlet air guide 244 may be formed to guide the air blown from the first fan 30 in the front/rear direction. If the second air outlet 118 is formed to discharge the air in the lateral direction of the dehumidifier, the second air outlet air guide 244 may be formed to guide the air blown from the first fan 30 to the lateral direction.

The dehumidifier of the embodiment may have a second fan 240 positioned in front of the first fan 30. Alike the second preferred embodiment of the present invention, the second fan 240 may blow the air in the front direction. The second fan 240 may have an air blow direction parallel to the air blow direction of the second fan 140 in accordance with the second preferred embodiment of the present invention. The second fan 240 may be mounted to draw the air from the rear side and to discharge the air to the front side. A front panel 20 may have a circular opening 20A formed at a position facing the first fan 30. The front panel 20 may have an inner guide 20B arranged thereon for forming an annular first air outlet 116 on an inner side of the circular opening 20A. The first air outlet 116 may face a front plate of the first fan 30. The first air outlet 116 may face the fan housing 33 of the first fan 30.

The second fan 240 may be mounted to be positioned between the front panel 20 and the first fan 30. The second fan 240 may have a horizontal rotating central axis. The second fan 240 may include an impeller 241, and a motor 242 for rotating the impeller 241. The second fan 240 may further include a motor mounter 243 for mounting the motor 242. It is possible that the motor mounter 243 is mounted to the front panel 20. It is possible that the motor mounter 243 is mounted to the fan housing 33 of the first fan 30.

The impeller 241 of the second fan 240 may be arranged to face the fan housing 33 of the first fan 30. The impeller 241 of the second fan 240 may blow the air from between the first air outlet 116 and the first fan 30 to the front side of the first air outlet 116.

If the motor 243 is mounted to the front panel 20, the motor 242 of the second fan 240 may have a rotating shaft projected toward the first fan 30, and the impeller 241 of the second fan 240 may rotate between the front panel 20 and the first fan 30.

The dehumidifier of the embodiment may include a first passage P11 for drawing the air into the first air inlet 112 and discharging the air to the first air outlet 116 after passed through the evaporator 8, the condenser 4, the first fan 30 and the second fan 240 in succession.

The dehumidifier of the embodiment may include a second passage P12 for drawing the air into the second air inlet 114 and discharging the air through the first air outlet 116 after passed through the second fan 240.

The dehumidifier of the embodiment may include a third passage P17 for drawing the air into the first air inlet 112 and discharging the air to the second air outlet 118 after passed through the evaporator 8, the condenser 4, and the first fan 30.

The first fan 30 may be positioned between the condenser 4 and the second fan 240 in an air flow direction of the first passage P11. The first fan 30 may be positioned between the condenser 4 and the second air outlet 118 in an air flow direction of the third passage P17.

The second fan 240 may be positioned between the first fan 30 and the first air outlet 116 in an air flow direction of the first passage P11. The second fan 240 may be positioned between the second air inlet 114 and the first air outlet 116 in an air flow direction of the second passage P12.

The first passage P11 may include a first fan suction flow passage P13 between the first air inlet 112 and the first fan 30, a fan connection flow passage P14 between the first fan 30 and the second fan 240, and a common discharge flow passage P15 between the second fan 240 and the first air outlet 116 in an air flow direction passing through the first passage P11. The first passage P11 may further include a first fan inside passage formed in the first fan 30.

The second passage P12 may have the air drawn into the second air inlet 114 to be discharged to the first air outlet 116 without passed through the evaporator 8, the condenser 4, and the first fan 30. The second passage P12 may include a second fan suction flow passage P16 between the second air inlet 114 and the second fan 240, and the common discharge passage P15 between the second fan 240 and the first air outlet 116 in an air flow direction passing through the second passage P12.

The third passage P17 may have the air drawn into the first air inlet 112 and discharged through the second air outlet 118 without passed through the second fan 240. The third passage P17 may include a first fan suction flow passage P13 between the first air inlet 112 and the first fan 30, and an independent discharge flow passage P18 between the first fan 30 and the second air outlet 118 in an air flow direction passing through the third passage P17. The third passage P17 may further include a first fan inside flow passage formed in the first fan 30.

The first fan suction flow passage P13 may be formed between the first air inlet 112 and the orifice 34 in the air flow direction. The first fan suction flow passage P13 may be formed between the drain pan 26 and the flow passage guide 28.

The first fan inside flow passage may be formed between the orifice 34 and the fan housing 33.

The fan connection flow passage P14 may be positioned between the outlet portion 35 of the first fan 30 and the second fan 240 in the air flow direction. The fan connection flow passage P14 may include a communication portion 246. The fan connection flow passage P14 may be constructed of the front panel 20 and the first fan 30. The fan connection flow passage P14 may be constructed of the rear side of the front panel 20 and the front side of the fan housing 33 of the first fan 30.

The second fan suction flow passage P16 may be formed between the second air inlet 114 and the second fan 240 in the air flow direction. The second fan suction flow passage P16 may be constructed of the front panel 20, and the second air outlet air guide 244. The second fan suction flow passage P16 may be formed between a rear side of the front panel 20 and a front side of the second air outlet air guide 244. The second fan suction flow passage P16 may be constructed of the first fan 30. The second fan suction flow passage P16 may be constructed of a front side of the fan housing 33 of the first fan 30.

The independent discharge flow passage P18 may be constructed of the second air outlet air guide 244.

The first passage P11 and the third passage P17 may be branched in the air flow direction and the first passage P11 and the second passage P12 may join in the air flow direction. The third passage P17 may be branched from the first passage P11 between the first fan 30 and the second fan 240 in the air flow direction. The second passage P12 may join with the first passage P11 between the first fan 30 and the second fan 240 in the air flow direction.

The air drawn into the first air inlet 112 may be discharged to the first air outlet 116 after passed through the first fan suction flow passage P13, the first fan inside flow passage, the fan connection flow passage P14, and the common discharge flow passage P15 in succession. The air drawn into the first air inlet 112 may be discharged to the second air outlet 118 passed through the first fan suction flow passage P13, the first fan inside flow passage, and the independent discharge flow passage P18 in succession.

The air drawn into the second air inlet 114 may be discharged to the first air outlet 116 after passed through the second suction flow passage P16, and the common discharge flow passage P15 in succession.

The dehumidifier may have a communication opening 246 formed therein for flowing of the air passed through the second fan 240 to the first fan 30. The communication opening 246 may be positioned between the first fan 30 and the second fan 240 in the air flow direction drawn into the first air inlet 112. The communication opening 246 may be a portion of the fan connection flow passage P14. It is possible that the communication opening 246 may be formed between the fan housing 33 of the first fan 30 and the casing 10. The communication opening 246 may be formed between the fan housing 33 of the first fan 30 and a second air outlet air guide 244 to be described later.

The dehumidifier may further include a flow passage control device 260 for controlling a flow passage in the dehumidifier.

The flow passage control device 260 may include a flow passage control member 262, and an operating device 264 for operating the flow passage control member 262. The flow passage control device 260 may be mounted to open/ close the communication opening 246. The flow passage control device 260 may control a flow passage in the dehumidifier by opening/closing the communication opening 246. The flow passage control device 260 may be mounted to open/close the second air outlet 118. The flow passage control device 260 may control a flow passage in the humidifier by opening/closing the second air outlet 118.

The flow passage control device 260 may include a communication opening flow passage control device for opening/closing the communication opening 246 and a second air outlet flow passage control device for opening/closing the second air outlet 118. Each of the communication opening flow passage control device and the second air outlet flow passage control device may include a flow passage control member and an operation device. When the communication opening flow passage control device opens the communication opening 246, the second air outlet flow passage control device may close the second air outlet. When the communication opening flow passage control device closes the communication opening 246, the second air outlet flow passage control device may open the second air outlet 118.

The flow passage control device 260 may not be provided to each of the communication opening 246 and the second air outlet 118, but one flow passage control device may close the second air outlet 118 while opening the communication opening 246, and opposite to this, one flow passage control device may open the second air outlet 118 while closing the communication opening 246. In this case, the one flow passage control member 262 may close the second air outlet 118 when the one flow passage control member 262 is at a position of opening the communication opening 246, and vice versa.

The flow passage control device 260 may have a first mode in which the flow passage control device 260 opens the communication opening 246 between the first fan 30 and the second fan 240, and a second mode in which the flow passage control device 260 closes the communication opening 246 between the first fan 30 and the second fan 240. The first mode may be a communication opening opening mode and the second mode may be a communication opening closing mode. The flow passage control device 260 may be in a second air outlet closing mode for closing the second air outlet 118 in the first mode and a second air outlet opening mode for opening the second air outlet 118 in the second mode.

In the first mode of the flow passage control device 260, the air drawn into the first air inlet 112 may not be discharged to the second air outlet 118 from the first fan 30, but may be blown to the second fan 240. In the second mode of the flow passage control device 260, the air drawn into the first air inlet 112 may not flow from the first fan 30 to the second fan 240, but may be blown toward the second air outlet 118. The first mode of the flow passage control device 260 may be a first air outlet discharge mode in which the air drawn into the first air inlet 112 is discharged to the first air outlet 116. The second mode of the flow passage control device 260 may be a second air outlet discharge mode in which the air drawn into the first air inlet 112 is discharged to the second air outlet 118.

When opening the communication opening 246, the flow passage control member 262 may function as a first air guide which guides the air blown from the first fan 30 to the communication opening 246. When closing the communication opening 246, the flow passage control member 262 may function as a second air guide which guides the air blown from the first fan 30 to the second air outlet 118. The flow passage control member 262 may have one side functioning as the first air guide and the other side functioning as the second air guide.

When closing the communication opening 246, the flow passage control member 262 may be positioned not to block between the first fan 30 and the second air outlet 118 for enabling the air passed through the first fan 30 to be discharged to the second air outlet 118.

When the communication opening 246 is opened, the flow passage control member 262 may be positioned to block between the first fan 30 and the second air outlet 118 for preventing the air passed through the first fan 30 from being discharged to the second air outlet 118. That is, the flow passage control member 262 may function as a second air outlet closing device which closes the second air outlet 118.

The flow passage control member 262 may be rotatably mounted or movably arranged in the dehumidifier. The flow passage control member 262 may be positioned at a first position at which the flow passage control member 262 closes the communication opening 246 and opens the second air outlet 118, or a second position at which the flow passage control member 262 opens the communication opening 246 and closes the second air outlet 118.

The communication opening 246 may be horizontally opened in the front/rear direction of the humidifier, and the second air outlet 118 may be vertically opened in an up/down direction in an upper side of the dehumidifier.

When arranged vertically, the flow passage control member 262 may be positioned at the first position at which the flow passage control member 262 opens the communication opening 246 while closing the second air outlet 118. When positioned at the first position, the flow passage control member 262 may guide the air flowing from the first fan 30 to be discharged upward.

When arranged vertically, the flow passage control member 262 may be positioned at the second position at which the flow passage control member 262 opens the communication opening 246 while closing the second air outlet 118. When positioned at the second position, the flow passage control member 262 may guide the air flowing from the first fan 30 to flow toward a front direction.

Since configurations and operations of the dehumidifier of the embodiment are the same or similar to the first or second embodiment of the present invention except the first air inlet 112, the second air inlet 114, the first air outlet 116, the second air outlet 118, the first passage P11, the second passage P12, the third passage P17, the second fan 240, and the flow passage control device 260, the same reference numerals will be used and detailed description of the configurations and the operations of the dehumidifier of the embodiment will be omitted.

Hereafter, for convenience of description, the first mode of the flow passage control device 260 will be described calling as a first air outlet discharge mode and the second mode will be described calling as a second air outlet discharge mode.

The dehumidifier may include at least two operation modes. The dehumidifier may have a plurality of operation modes, and may be operated in one operation mode selected from the plurality of operation modes.

The plurality of operation modes may include a first mode in which the flow passage control device 260 is in the first air outlet discharge mode, and the compressor 2, the first fan 30, and the second fan 40 are operated together. The plurality of operation modes may include a second mode in which the flow passage control device 260 is in the first air outlet discharge mode, the compressor 2 and the first fan 30 are stopped, and the second fan is driven. The plurality of operation modes may further include a third mode in which the flow passage control device 260 is in the first air outlet discharge mode, the compressor 2 is stopped and the first fan 30 and the second fan 240 are driven, together. The plurality of operation modes may include a fourth mode in which the flow passage control device 260 is in the first air outlet discharge mode, the compressor 2 and the first fan 30 are driven and the second fan 240 is stopped. The plurality of operation modes may include a fifth mode in which the flow passage control device 260 is in the first air outlet discharge mode, the compressor 2 and the second fan 40 are stopped, and the first fan 30 is driven.

The plurality of operation modes may include a sixth mode in which the flow passage control device 260 is in the second air outlet discharge mode, and all of the compressor 2, the first fan 30 and the second fan 240 are driven. The plurality of operation modes may include a seventh mode in which the flow passage control device 260 is in the second air outlet discharge mode, the compressor 2 and the first fan 30 are stopped and the second fan 240 is driven. The plurality of operation modes may include an eighth mode in which the flow passage control device 260 is in the second air outlet discharge mode, the compressor 2 is stopped and the first fan 30 and the second fan 240 are driven together. The plurality of operation modes may include a ninth mode in which the flow passage control device 260 is in the second air outlet discharge mode, the compressor 2 and the first fan 30 are driven and the second fan 240 is stopped. The plurality of operation modes may include a tenth mode in which the flow passage control device 260 is in the second air outlet discharge mode, the compressor 2 and the second fan 240 are stopped and the first fan 30 is driven.

The operation of each mode of the dehumidifier in accordance with the embodiment will be described.

If the compressor 2, the first fan 30, and the second fan 40 are driven together and the flow passage control device 260 is in the first air outlet discharge mode, as shown in FIG. 11, the air may be drawn into the dehumidifier from an outside of the dehumidifier distributed to the first air inlet 112 and the second air inlet 114. Alike the first mode in the second preferred embodiment of the present invention, the air drawn into the first air inlet 112 from the outside of the dehumidifier may be dehumidified as the air passes through the evaporator 8, and may have a temperature thereof elevated as the air passes through the condenser 4 by the refrigerant passing through the condenser 4. The air passed through the condenser 4 may be drawn into the first fan 30. The air drawn into the first fan 30 after passed through the condenser 4 thus may flow to the second fan 240 by the air blowing force of the first fan 30 and the suction force of the second fan 240, and the air flowing to the second fan 240 from the first fan 30 may be drawn into the second fan 240 passed through the communication opening 246. Alike the first mode in the second preferred embodiment of the present invention, the air drawn into the second air inlet 114 may be drawn into the second fan 240 bypassed the evaporator 8, the condenser 4 and the first fan 30, and may join with the air blown to the second fan 240 from the first fan 30. If the first air outlet 116 is a front air outlet, the dehumidifier may function as a high flow rate dehumidifier which discharges a high flow rate of dehumidified air blown by the two fans 30 and 240 to the front side of the first air outlet 116. In a case the first air outlet 116 is the front air outlet, if the flow passage control device 260 is in the first air outlet discharge mode, and the compressor 2, the first fan 30 and the second fan 40 are driven together, the dehumidifier may be in a front high flow rate dehumidifying mode.

In the meantime, if the compressor 2 and the first fan 30 are stopped, the second fan 240 is driven, and the flow passage control device 260 is in the first air outlet discharge mode, as shown in FIG. 12, the air may be drawn into the dehumidifier from the outside of the dehumidifier distributed to the first air inlet 112 and the second air inlet 114. Alike the second mode in the second preferred embodiment of the present invention, the air drawn into the first air inlet 112 from the outside of the dehumidifier may pass through the first fan 30 after passed through the evaporator 8 and the condenser 4 without heat exchange therewith, and may be drawn into the second fan 240 passed through communication opening 246. Alike the second mode in the second preferred embodiment of the present invention, the air drawn into the second air inlet 114 from the outside of the dehumidifier may be drawn into the second fan 240 bypassed the evaporator 8, the condenser 4 and the first fan 30, and may join with the air drawn into the second fan 240 from the first fan 30. If the first air outlet 116 is the front air outlet, the dehumidifier may function as a fan which discharges non-dehumidified air blown by one fan 240 to the front side of the first air outlet 116. If the first air outlet 116 is the front air outlet, the flow passage control device 260 is in the first air outlet discharge mode, the compressor 2 and the first fan 30 are stopped, and the second fan 240 is driven, the dehumidifier may be in a front fan mode. If a flow rate of the dehumidifier is classified into two stages, the dehumidifier may be in a front low flow rate fan mode. If the flow rate of the dehumidifier is classified into three stages, and the second fan 240 has a flow rate higher than a flow rate of the first fan 30, the dehumidifier may be in a front medium flow rate fan mode. If the flow rate of the dehumidifier is classified into three stages, and the second fan 240 has a flow rate lower than a flow rate of the first fan 30, the dehumidifier may be in a front low flow rate fan mode.

In the meantime, if the compressor 2 is stopped, the first fan 30 and the second fan 240 are driven together, and the flow passage control device 260 is in the first air outlet discharge mode, as shown in FIG. 13, the air may be drawn into the dehumidifier from the outside of the dehumidifier distributed to the first air inlet 112 and the second air inlet 114. Alike the third mode in the second preferred embodiment of the present invention, the air drawn into the first air inlet 112 from the outside of the dehumidifier may be drawn into the first fan 30 after passed through the evaporator 8 and the condenser 4 in succession without heat exchange therewith. The air drawn into the first fan 30 after passed through the condenser 4 thus may flow to the second fan 240 by the air blowing force of the first fan 30 and the suction force of the second fan 240, and the air flowing to the second fan 240 from the first fan 30 may be drawn into the second fan 240 passed through the communication opening 246. Alike the third mode in the second preferred embodiment of the present invention, the air drawn into the second air inlet 114 from the outside of the dehumidifier may be drawn into the second fan 240 bypassed the evaporator 8, the condenser 4 and the first fan 30, and may join with the air drawn into the second fan 240 from the first fan 30. If the first air outlet 116 is the front air outlet, the dehumidifier may function as a high flow rate fan which discharges a high flow rate of non-dehumidified air blown by the two fans 30 and 240 to the front side of the first air outlet 116. If the first air outlet 116 is the front air outlet, the flow passage control device 260 is in the first air outlet discharge mode, the compressor 2 is stopped and the first fan 30 and the second fan 240 are driven together, the dehumidifier may be in a front high flow rate fan mode.

In the meantime, if the compressor 2 and the first fan 30 are driven, the second fan 240 is stopped, and the flow passage control device 260 is in the first air outlet discharge mode, as shown in FIG. 14, the air may be drawn into the dehumidifier from the outside of the dehumidifier, not through the second air inlet 114, but through the first air inlet 112. Alike the fourth mode in the second preferred embodiment of the present invention, the air drawn into the first air inlet 112 from the outside of the dehumidifier may be dehumidified at the evaporator 8, heated at the condenser 4, and drawn into the first fan 30 from the condenser 4. The air drawn into the first fan 30 may be blown to the second fan 240 from the first fan 30 by the air blowing force of the first fan 30, and may be blown to the second fan 240 passed through the communication opening 246. The air blown to the second fan 240 may be discharged through the first air outlet 116 by the air blowing force of the first fan 30. If the first air outlet 116 is the front air outlet, the dehumidifier may function as a dehumidifier which discharges dehumidified air blown by one fan 30 to the front side of the first air outlet 116. If the first air outlet 116 is the front air outlet, the flow passage control device 260 is in the first air outlet discharge mode, the compressor 2 and the first fan 30 are driven, and the second fan 240 is stopped, the dehumidifier may be in a front low flow rate dehumidifying mode.

In the meantime, if the compressor 2 and the second fan 240 are stopped, the first fan 30 is driven, and the flow passage control device 260 is in the first air outlet discharge mode, as shown in FIG. 15, the air may be drawn into the dehumidifier from the outside of the dehumidifier, not through the second inlet 114, but through the first air inlet 112. Alike the fifth mode in the second preferred embodiment of the present invention, the air drawn into the first air inlet 112 from the outside of the dehumidifier may be drawn into the first fan 30 after passed through the evaporator 8 and the condenser 4 without heat exchange therewith. The air drawn into the first fan 30 may be blown to the second fan 240 from the first fan 30 by the air blowing force of the first fan 30, and may be blown to the second fan 240 passed through the communication opening 246. The air blown to the second fan 240 may be discharged to the first air outlet 116 by the air blowing force of the first fan 30. If the first air outlet 116 is the front air outlet, the dehumidifier may function as a fan which discharges non-dehumidified air blown by one fan 30 to the front side of the first air outlet 116. If the first air outlet 116 is the front air outlet, the flow passage control device 260 is in the first air outlet discharge mode, the compressor 2 and the second fan 240 are stopped, and the first fan 30 is driven, the dehumidifier may be in a front low flow rate fan mode.

In the meantime, if all of the compressor 2, the first fan 30, and the second fan 240 are driven, and the flow passage control device 260 is in the second air outlet discharge mode, as shown in FIG. 16, the air may be drawn into the dehumidifier from the outside of the dehumidifier distributed to the first air inlet 112 and the second air inlet 114. The air drawn into the first air inlet 112 from the outside of the dehumidifier may be dehumidified as the air passes through the evaporator 8, and may have a temperature thereof elevated by the refrigerant passing through the condenser 4 as the air passes through the condenser 4. The air passed through the condenser 4 may be drawn into the first fan 30. The air drawn into the first fan 30 after passed through the condenser 4 may be blown to the second air outlet 118 by the air blowing force of the first fan 30, and may be discharged through the second air outlet 118. The air drawn into the second air inlet 114 from the outside of the dehumidifier may be drawn into the second fan 240 bypassed the evaporator 8, the condenser 4 and the first fan 30, and may be discharged to the first air outlet 116 by the second fan 240. If the first air outlet 116 is the front air outlet, and the second air outlet is a rear air outlet, the dehumidifier may discharge the dehumidified air blown by the first fan 30 to the second air outlet 118, and may discharge the non-dehumidified air blown by the second fan 240 to the front side of the first air outlet 116. If the first air outlet 116 is the front air outlet, the second air outlet is a rear air outlet, the flow passage control device 260 is in the second air outlet discharge mode, and all of the compressor 2, the first fan 30 and the second fan 240 are driven, the dehumidifier may be in a rear dehumidifying and front fan mode. If the flow rate of the dehumidifier is classified into two stages, the dehumidifier may be in a rear low flow rate dehumidifying and front low flow rate fan mode, and if the flow rate of the dehumidifier is classified into three stages, and the second fan 240 has a flow rate higher than a flow rate of the first fan 30, the dehumidifier may be in a rear low flow rate dehumidifying and front medium flow rate fan mode. If the flow rate of the dehumidifier is classified into three stages, and the second fan 240 has a flow rate lower than a flow rate of the first fan 30, the dehumidifier may be in a rear medium flow rate dehumidifying and front low flow rate fan mode.

In the meantime, if the compressor 2 and the first fan 30 are stopped, the second fan 240 is driven, and the flow passage control device 260 is in the second air outlet discharge mode, as shown in FIG. 17, the air may be drawn into the dehumidifier from the outside of the dehumidifier, not through the first air inlet 112, but through the second air inlet 114. The air drawn into the second air inlet 114 from the outside of the dehumidifier may be drawn into the second fan 240 after bypassed the evaporator 8, the condenser 4 and the first fan 30, and may be discharged to the first air outlet 116 by the second fan 240. If the first air outlet 116 is the front air outlet, and the second air outlet 118 is the rear air outlet, the dehumidifier may discharge non-dehumidified air blown by the second fan 240 to the front side of the first air outlet 116. If the first air outlet 116 is the front air outlet, the second air outlet 118 is the rear air outlet, the flow passage control device 260 is in the second air outlet discharge mode, the compressor 2 and the first fan 30 are stopped, and the second fan 240 is driven, the dehumidifier may be in a front fan mode. If the flow rate of the dehumidifier is classified into two stages, the dehumidifier may be in a front low flow rate fan mode, and if the flow rate of the dehumidifier is classified into three stages, and the second fan 240 has a flow rate higher than a flow rate of the first fan 30, the dehumidifier may be in a front medium flow rate fan mode. If the flow rate of the dehumidifier is classified into three stages, and the second fan 240 has a flow rate lower than a flow rate of the first fan 30, the dehumidifier may be in a front low flow rate fan mode.

In the meantime, if the compressor 2 is stopped, the first fan 30 and the second fan 240 are driven, and the flow passage control device 260 is in the second air outlet discharge mode, as shown in FIG. 18, the air may be drawn into the dehumidifier from the outside of the dehumidifier distributed to the first air inlet 112 and the second air inlet 114. The air drawn into the first air inlet 112 from the outside of the dehumidifier may be drawn into the first fan 30 after passed through the evaporator 8 and the condenser 4 in succession without heat exchange therewith. The air drawn into the first fan 30 after passed through the condenser 4 may be blown to the second air outlet 118 by the air blowing force of the first fan 30, and may be discharged through the second air outlet 118. The air drawn into the second air inlet 114 from the outside of the dehumidifier may be drawn into the second fan 240 bypassed the evaporator 8, the condenser 4 and the first fan 30, and may be discharged to the first air outlet 116 by the second fan 240. If the first air outlet 116 is the front air outlet, and the second air outlet 118 is the rear air outlet, the dehumidifier may discharge the non-dehumidified air blown by the first fan 30 to the second air outlet 118, and the non-dehumidified air blown by the second fan 240 to the front side of the first air outlet 116. If the first air outlet 116 is the front air outlet, and the second air outlet 118 is the rear air outlet, the flow passage control device 260 is in the second air outlet discharge mode, the compressor 2 is stopped, and the first fan 30 and the second fan 240 are driven together, the dehumidifier may be in a rear fan and front fan mode. In this case, the dehumidifier may function as a multi-fan in which one device blows the non-dehumidified air in many directions. If the flow rate of the dehumidifier is classified into two stages, the dehumidifier may be in a rear low flow rate fan and front low flow rate fan mode. If the flow rate of the dehumidifier is classified into three stages, and the second fan 240 has a flow rate higher than a flow rate of the first fan 30, the dehumidifier may be in a rear low flow rate fan and front medium flow rate fan mode. If the flow rate of the dehumidifier is classified into three stages, and the second fan 240 has a flow rate lower than a flow rate of the first fan 30, the dehumidifier may be in a rear medium flow rate fan and front low flow rate fan mode.

In the meantime, if the compressor 2 and the first fan 30 are driven, the second fan 240 is stopped, and the flow passage control device 260 is in the second air outlet discharge mode, as shown in FIG. 19, the air may be drawn into the dehumidifier from the outside of the dehumidifier, not through the second air inlet 114, but through the first air inlet 112. The air drawn into the first air inlet 112 from the outside of the dehumidifier may be drawn into the first fan 30 after dehumidified at the evaporator 8 and heated at the condenser 4. The air drawn into the first fan 30 thus may be blown to the second air outlet 118 by the air blowing force of the first fan 30, and may be discharged through the second air outlet 118. If the first air outlet 116 is the front air outlet, and the second air outlet 118 is the rear air outlet, the dehumidifier may discharge dehumidified air blown by the first fan 30 to the second air outlet 118. If the first air outlet 116 is the front air outlet, and the second air outlet 118 is the rear air outlet, the flow passage control device 260 is in the second air outlet discharge mode, the compressor 2 and the first fan 30 are driven, and the second fan 240 is stopped, the dehumidifier may be in a rear low flow rate dehumidifying mode.

In the meantime, if the compressor 2 and the second fan 240 are stopped, the first fan 30 is driven, and the flow passage control device 260 is in the second air outlet discharge mode, as shown in FIG. 20, the air may be drawn into the dehumidifier from the outside of the dehumidifier, not through the second air inlet 114, but through the first air inlet 112. The air drawn into the first air inlet 112 from the outside of the dehumidifier may be drawn into the first fan 30 after passed the evaporator 8, the condenser 4 in succession without heat exchange therewith. The air drawn into the first fan 30 after passed through the condenser 4 may be blown to the second air outlet 118 by the air blowing force of the first fan 30, and may be discharged through the second air outlet 118. If the first air outlet 116 is the front air outlet, and the second air outlet 118 is the rear air outlet, the dehumidifier may discharge non-dehumidified air blown by the first fan 30 to the second air outlet 118. If the first air outlet 116 is the front air outlet, and the second air outlet 118 is the rear air outlet, the flow passage control device 260 is in the second air outlet discharge mode, the compressor 2 and the second fan 240 are stopped, and the first fan 30 is driven, the dehumidifier may be in a rear low flow rate fan mode.

Figure 21:
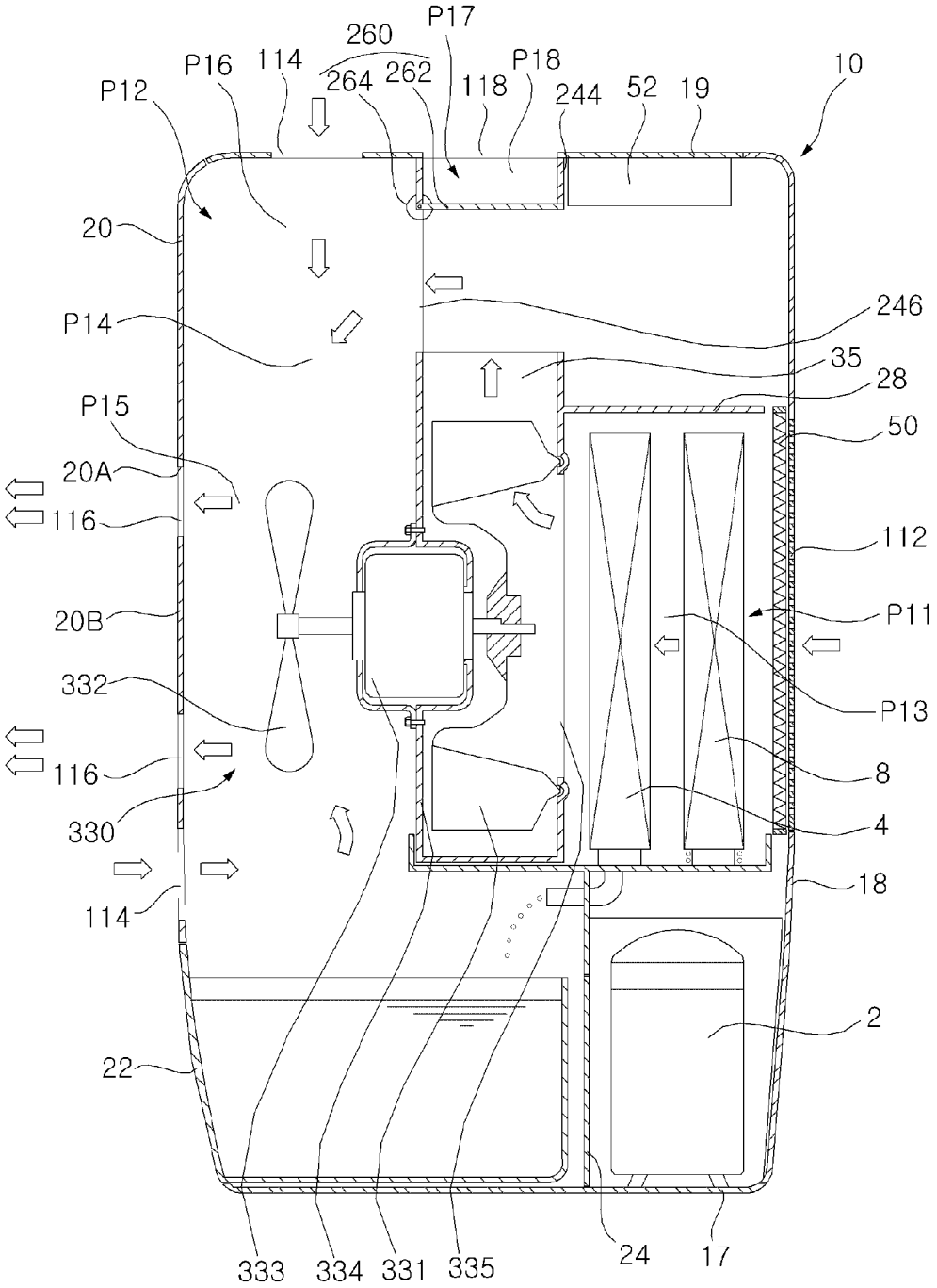
FIG. 21 is a schematic view illustrating a dehumidifier in accordance with a fourth preferred embodiment of the present invention, showing an air flow when a compressor and a fan are driven, and a flow passage control device is in a first air outlet discharge mode.
Figure 22:
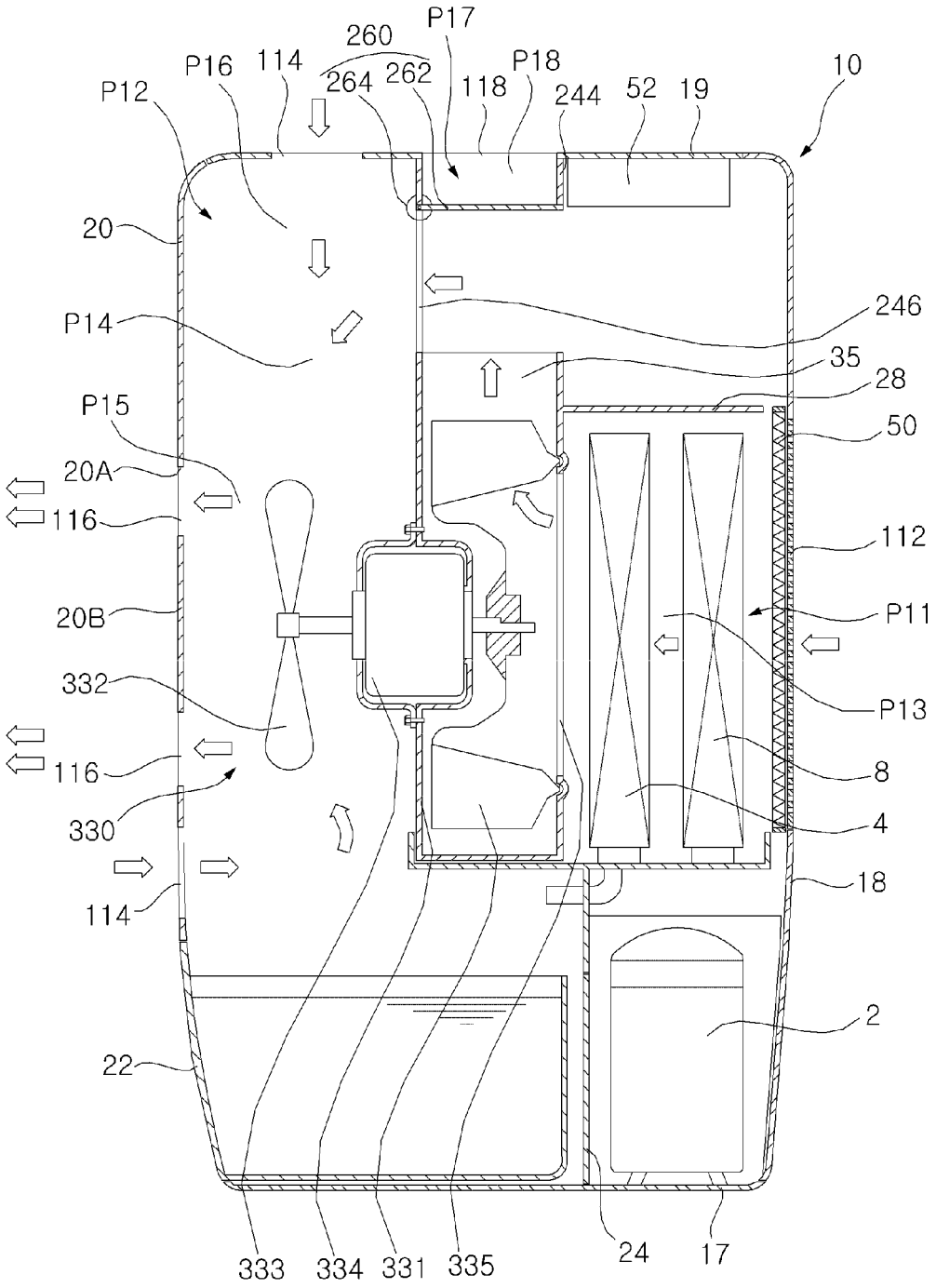
FIG. 22 is a schematic view illustrating a dehumidifier in accordance with a fourth preferred embodiment of the present invention, showing an air flow when a compressor is stopped, a fan is driven, and a flow passage control device is in a first air outlet discharge mode.
Figure 23:
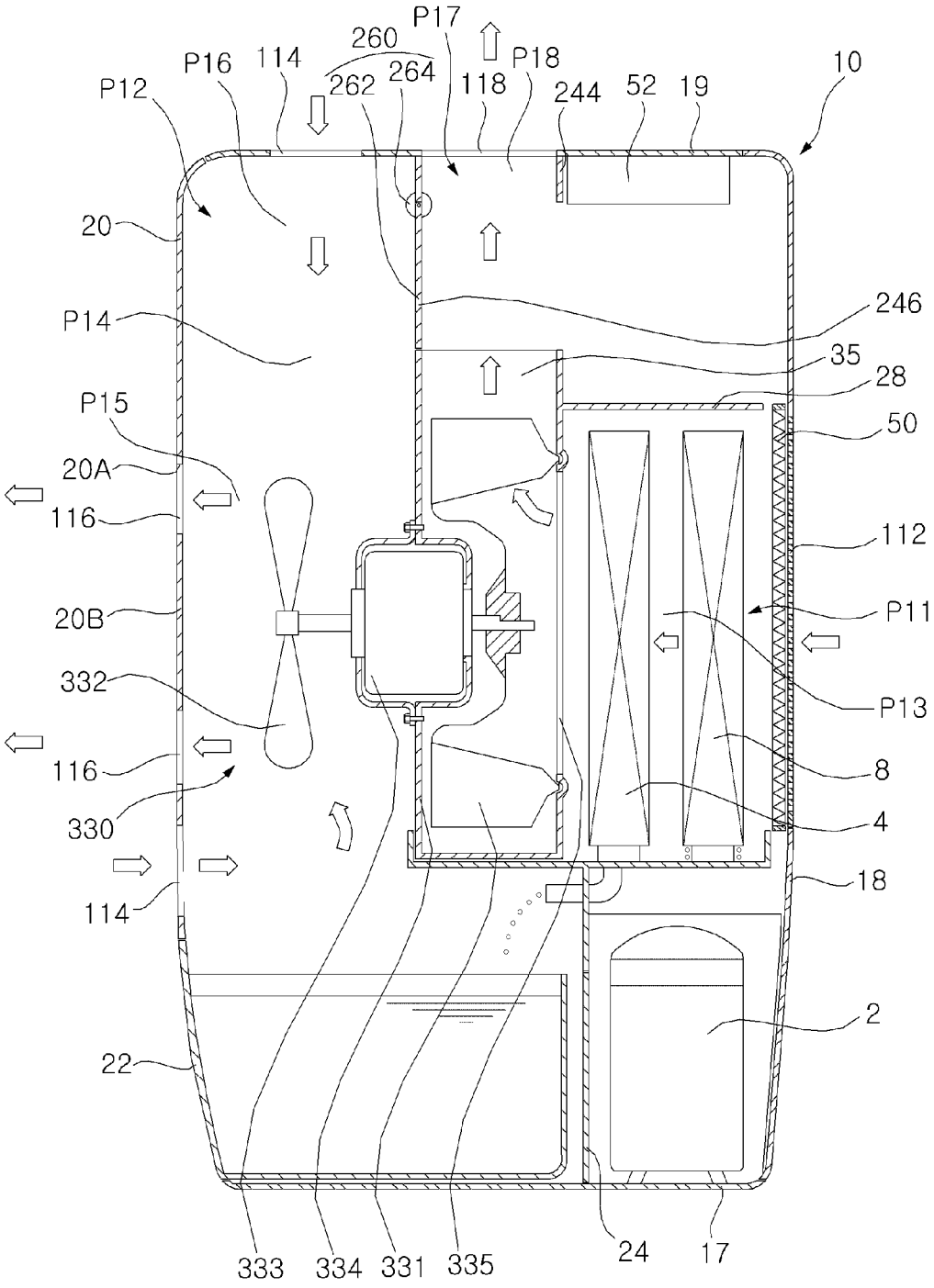
FIG. 23 is a schematic view illustrating a dehumidifier in accordance with a fourth preferred embodiment of the present invention, showing an air flow when a compressor and a fan are driven, and a flow passage control device is in a second air outlet discharge mode.
Figure 24:
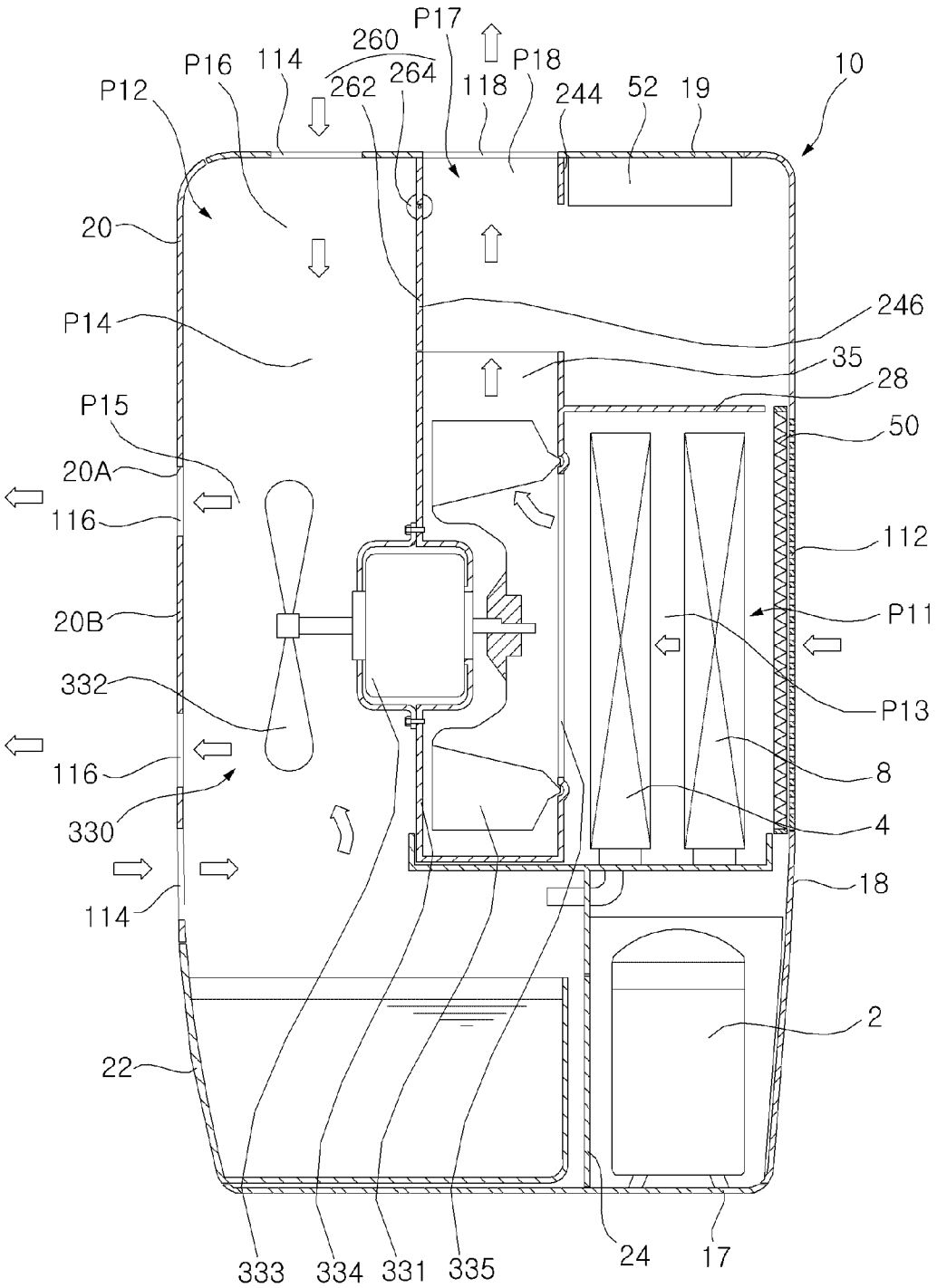
FIG. 24 is a schematic view illustrating a dehumidifier in accordance with a fourth preferred embodiment of the present invention, showing an air flow when a compressor is stopped, a fan is driven, and a flow passage control device is in a second air outlet discharge mode.

FIG. 21 is a schematic view illustrating a dehumidifier in accordance with a fourth preferred embodiment of the present invention, showing an air flow when a compressor and a fan is driven, and a flow passage control device is in a first air outlet discharge mode, FIG. 22 is a schematic view illustrating a dehumidifier in accordance with a fourth preferred embodiment of the present invention, showing an air flow when a compressor is stopped, a fan is driven, and a flow passage control device is in a first air outlet discharge mode, FIG. 23 is a schematic view illustrating a dehumidifier in accordance with a fourth preferred embodiment of the present invention, showing an air flow when a compressor and a fan are driven, and a flow passage control device is in a second air outlet discharge mode, and FIG. 24 is a schematic view illustrating a dehumidifier in accordance with a fourth preferred embodiment of the present invention, showing an air flow when a compressor is stopped, a fan is driven, and a flow passage control device is in a second air outlet discharge mode.

The embodiment suggests the fan 330 to include a first impeller 331, a second impeller 332, and a common motor 333. The common motor 333 may rotate the first impeller 331 and the second impeller 332, together.

It is possible that the common motor 333 has one shaft projected therefrom, and the first impeller 331 and the second impeller 332 are mounted to the one shaft spaced from each other.

It is possible that the common motor 333 may be a double shaft motor having a first rotation shaft and a second rotation shaft projected in directions opposite to each other, wherein the first impeller 331 is mounted to the first rotation shaft, and the second impeller 332 is mounted to the second rotation shaft, and the first impeller 331 and the second impeller 332 are rotated by the common motor 333, together.

It is possible that the fan 330 has the first impeller 331 and the second impeller 332 of the same kind.

It is possible that the fan 330 has the first impeller 331 and the second impeller 332 of different kinds. The first impeller 331 may be an impeller of a centrifugal fan, such as a turbo fan and a sirocco fan or a mixed flow fan, and the second impeller 332 may be an impeller of an axial fan, such as a propeller fan, a tube axial fan, and a vane axial fan.

The fan 330 may include a partition wall W positioned between the first impeller 331 and the second impeller 332. The partition wall W may block the air being flowed by the first impeller 331 and the air being flowed by the second impeller 332 from each other. The fan 330 may further include a fan housing 334 enclosing one of the first impeller 331 and the second impeller 332. The fan 330 may further include an orifice 335 for guiding the air being drawn into the fan housing 334. It is possible that the dehumidifier has the partition wall W constructed separate from the fan housing 334. The dehumidifier may have a portion of the fan housing 334 functioning as a partition wall W for blocking the air being flowed by the first impeller 331 from the air being flowed by the second impeller 332.

If the first impeller 331 is an impeller of the centrifugal fan or the mixed flow fan, and the second impeller 332 is an impeller of the axial fan, the fan housing 334 may enclose the first impeller 331 and the orifice 335 may guide the air being flowed when the first impeller 331 rotates to an inside of the fan housing 334.

If the first impeller 331 is an impeller of the axial fan, and the second impeller 332 is an impeller of the centrifugal fan or the mixed flow fan, the fan housing 334 may enclose the second impeller 332, and the orifice 335 may guide the air being flowed when the second impeller 332 rotates to the inside of the fan housing 334.

Since configurations and operations of the dehumidifier of the embodiment are the same, or similar to one of the first embodiment, the second embodiment, and the third embodiment of the present invention except the fan 330, the same reference numerals will be used and description of the same or similar configurations and operations will be omitted.

Alike the first embodiment or the second embodiment of the present invention, the embodiment suggests forming one air outlet 16 or 106, and including a first passage P1 and a second passage P2.

Alike the third embodiment of the present invention, the embodiment suggests forming a first air inlet 112, a second air inlet 114, a first air outlet 116, a second air outlet 118, and a communication opening 246, and including a first passage P11, a second passage P12, a third passage P17, and a flow passage control device 260.

Hereafter, an example will be described, in which the dehumidifier has the first air inlet 112, the second air inlet 114, the second air outlet 116, the second air outlet 118, and the communication opening 246 formed therein, includes the first passage P11, the second passage P12, the third passage P17, and the flow passage control device 260, and the first impeller 331 and the second impeller 332 rotated by the common motor 333.

In this case, the first impeller 331 may be an element corresponding to the impeller 31 of the first fan 30 in accordance with the third preferred embodiment of the present invention. The second impeller 332 may be an element corresponding to the impeller 241 of the second fan 240 in accordance with the third preferred embodiment of the present invention. A configuration of the common motor 333 may be a configuration corresponding to the motor 32 of the first fan 30 in accordance with the third preferred embodiment of the present invention except the common motor 333 rotates the first impeller 331 and the second impeller 332, together. The fan housing 334 may be an element corresponding to the fan housing 33 of the first fan 30 in accordance with the third preferred embodiment of the present invention. The orifice 335 may be an element corresponding to the orifice 34 of the first fan 30 in accordance with the third preferred embodiment of the present invention.

The first passage P11 may be formed such that the air is drawn into the first air inlet 112, and discharged to the first air outlet 116 after passed through the evaporator 8, the condenser 4, the first impeller 331 and the second impeller 332 in succession.

The second passage P12 may be formed such that the air is drawn into the second air outlet 114 and discharged to the first air outlet 116 after passed through the second impeller 332. The second passage P12 may join with the first passage P11 between the first impeller 331 and the second impeller 332 in an air flow direction.

The third passage P17 may be formed such that the air is drawn into the first air inlet 112 and discharged to the second air outlet 118 after passed through the evaporator 8, the condenser 4, and the first impeller 331. The third passage P17 may be separated from the first passage P11 between the first impeller 331 and the second impeller 332 in an air flow direction.

The impeller 331 may be positioned between the condenser 4 and the impeller 332 in an air flow direction of the first passage P11. The first impeller 331 may be positioned between the condenser 4 and the second air outlet 118 in an air flow direction of the third passage P17.

The second impeller 332 may be positioned between the first impeller 331 and the first air outlet 116 in an air flow direction of the first passage P11. The second impeller 332 may be positioned between the second air inlet 114 and the first air outlet 116 in an air flow direction of the second passage P12.

The communication opening 246 may be positioned between the first impeller 331 and the second impeller 332 in an air flow direction of the air drawn into the first air inlet 112.

The operation of the embodiment will be described.

If the compressor 2 and the fan 330 are driven, and the flow passage control device 260 is in the first air outlet discharge mode, as shown in FIG. 21, the air may be drawn into the dehumidifier from the outside of the dehumidifier distributed to the first air inlet 112 and the second air inlet 114. The air drawn into the first air inlet 112 from the outside of the dehumidifier may be dehumidified as the air passes through the evaporator 8, and, thereafter, may have a temperature thereof elevated by the refrigerant passing through the condenser 4 as the air passes through the condenser 4. The air passed through the condenser 4 may be drawn into the first impeller 331. The air drawn into the first impeller 331 after passed through the condenser 4 thus may pass through the communication opening 246 and may flow to the second impeller 332. The air drawn into the second air inlet 114 from an outside of the dehumidifier may be drawn into the second impeller 332 bypassed the evaporator 8, the condenser 4, and the first impeller 331, and may join with the air flowed to the second impeller 332 from the first impeller 331. If the first air outlet 116 is a front air outlet, the dehumidifier may function as a high flow rate dehumidifier which discharges a high flow rate of dehumidified air blown by the two impellers 331 and 333 to the front side of the first air outlet 116. If the first air outlet 116 is the front air outlet, the flow passage control device 260 is in the first air outlet discharge mode, and the compressor 2 and the fan 330 are driven, the dehumidifier may be in a front high flow rate dehumidifying mode.

In the meantime, if the compressor 2 is stopped and the fan 330 is driven, and the flow passage control device 260 is in the first air outlet discharge mode, as shown in FIG. 22, the air may be drawn into the dehumidifier from the outside of the dehumidifier distributed to the first air inlet 112 and the second air inlet 114. The air drawn into the first air inlet 112 from the outside of the dehumidifier may be drawn into the first impeller 331 passed through the evaporator 8 and the condenser 4 without heat exchange therewith. The air drawn into the first impeller 331 after passed through the condenser 4 thus may pass through the communication opening 246 and may flow to the second impeller 332. The air drawn into the second air inlet 114 from the outside of the dehumidifier may be drawn into the second impeller 332 bypassed the evaporator 8, the condenser 4, and the first impeller 331, and may join with the air flowed to the second impeller 332 from the first impeller 331. If the first air outlet 116 is the front air outlet, the dehumidifier may function as a high flow rate fan which discharges a high flow rate of non-dehumidified air blown by the two impellers 331 and 332 to the front side of the first air outlet 116. If the first air outlet 116 is the front air outlet, the flow passage control device 260 is in the first air outlet discharge mode, and the compressor 2 and the fan 330 are driven, the dehumidifier may be in a front high flow rate fan mode.

In the meantime, if the compressor 2 and the fan 330 are driven, and the flow passage control device 260 is in the second air outlet discharge mode, as shown in FIG. 23, the air may be drawn into the dehumidifier from the outside of the dehumidifier distributed to the first air inlet 112 and the second air inlet 114. The air drawn into the first air inlet 112 from the outside of the may be dehumidified as the air passes through the evaporator 8, and, thereafter, may have a temperature thereof elevated by the refrigerant passing through the condenser 4 as the air passes through the condenser 4. The air passed through the condenser 4 may be drawn into the first impeller 331. The air drawn into the first impeller 331 after passed through the condenser 4 thus may be blown to the second air outlet 118, and may be discharged to the outside of the dehumidifier through the second air outlet 118. The air drawn into the second air inlet 114 from the outside of the dehumidifier may be drawn into the second impeller 332 bypassed the evaporator 8, the condenser 4, and the first impeller 331, and may be blown to the first air outlet 116 by the second impeller 332, and may be discharged to the outside of the dehumidifier through the first air outlet 116. If the first air outlet 116 is the front air outlet, and the second air outlet 118 is the rear air outlet, the dehumidifier may discharge dehumidified air to the second air outlet 118, and non-dehumidified air to the front side of the first air outlet 116. If the first air outlet 116 is the front air outlet, the second air outlet 118 is the rear air outlet, the flow passage control device 260 is in the second air outlet discharge mode, and the compressor 2 and the fan 330 are driven, the dehumidifier may be in a rear dehumidifying and front fan mode. If the flow rate of the dehumidifier is classified into two stages, the dehumidifier may be in a rear low flow rate dehumidifying and front low flow rate fan mode. If the flow rate of the dehumidifier is classified into three stages, and the first fan 30 has a flow rate higher than a flow rate of the second fan 240, the dehumidifier may be in a rear low rate dehumidifying and front medium flow rate fan mode.

In the meantime, if the compressor 2 is stopped, the fan 330 is driven, and the flow passage control device 260 is in the second air outlet discharge mode, as shown in FIG. 24, the air may be drawn into the dehumidifier from the outside of the dehumidifier distributed to the first air inlet 112 and the second air inlet 114. The air drawn into the first air inlet 112 from the outside of the dehumidifier may be drawn into the first impeller 331 passed through the evaporator 8 and the condenser 4 without heat exchange therewith. The air drawn into the first impeller 331 after passed through the condenser 4 thus may be blown to the second air outlet 118, and may be discharged to the outside of the dehumidifier through the second air outlet 118. The air drawn into the second air inlet 114 from the outside of the dehumidifier may be drawn into the second impeller 332 bypassed the evaporator 8, the condenser 4, and the first impeller 331, and may be blown to the first air outlet 116 by the second impeller 332, and may be discharged to the outside of the dehumidifier through the first air outlet 116. If the first air outlet 116 is the front air outlet, and the second air outlet 118 is the rear air outlet, the dehumidifier may discharge non-dehumidified air to the second air outlet 118, and non-dehumidified air to the front side of the first air outlet 116. If the first air outlet 116 is the front air outlet, the second air outlet 118 is the rear air outlet, the flow passage control device 260 is in the second air outlet discharge mode, and the compressor 2 and the fan 330 are driven, the dehumidifier may be in a rear fan and front fan mode. If the flow rate of the dehumidifier is classified into two stages, the dehumidifier may be in a rear low flow rate fan and front low flow rate fan mode. If the flow rate of the dehumidifier is classified into three stages, and a flow rate of the air being discharged to the first air outlet 116 is higher than a flow rate of the air being discharged to the second air outlet 118, the dehumidifier may be in a rear low flow rate fan and front medium flow rate fan mode.

Figure 25:
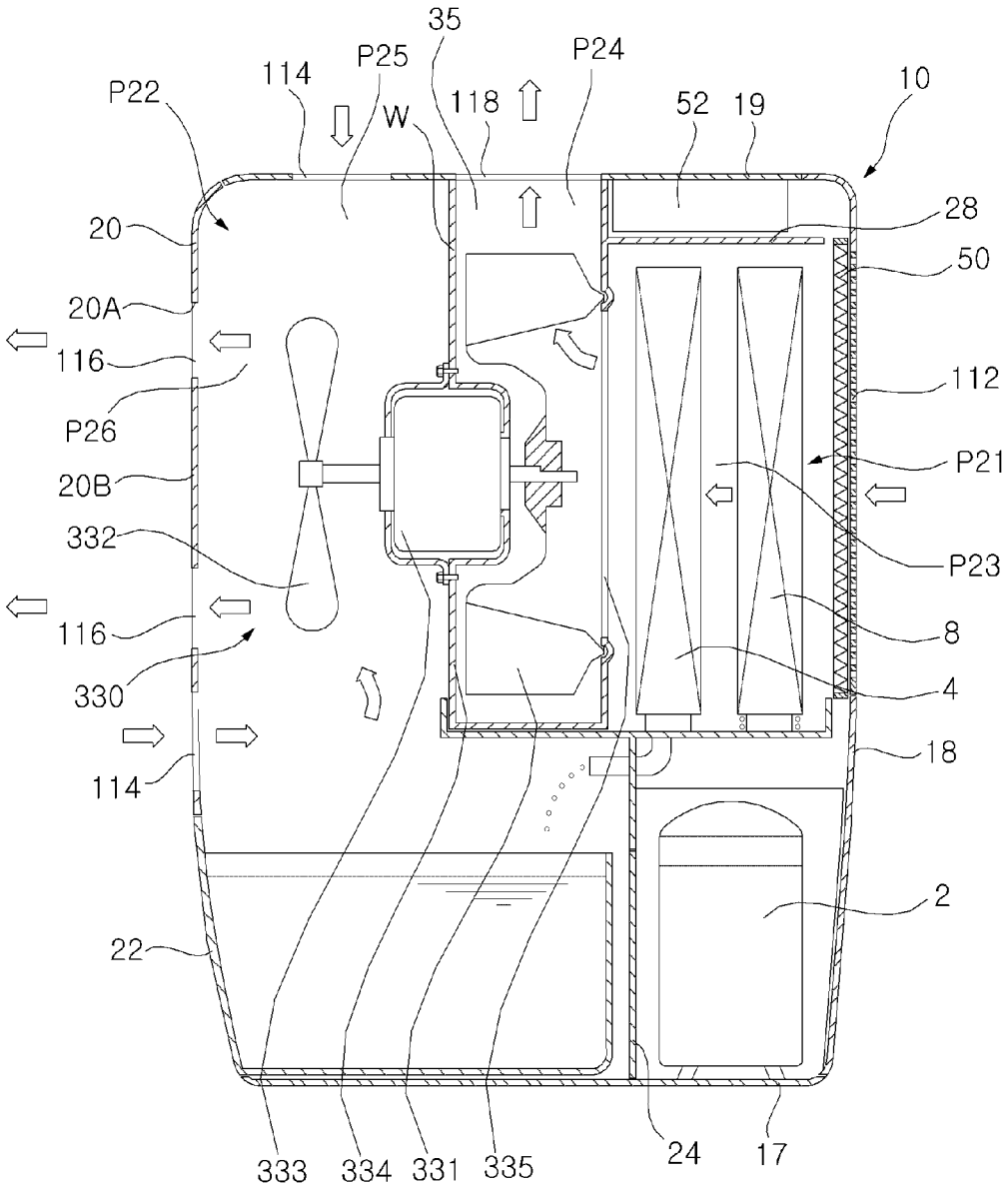
FIG. 25 is a schematic view illustrating a dehumidifier in accordance with a fifth preferred embodiment of the present invention, showing an air flow when a compressor and a fan are driven.
Figure 26:
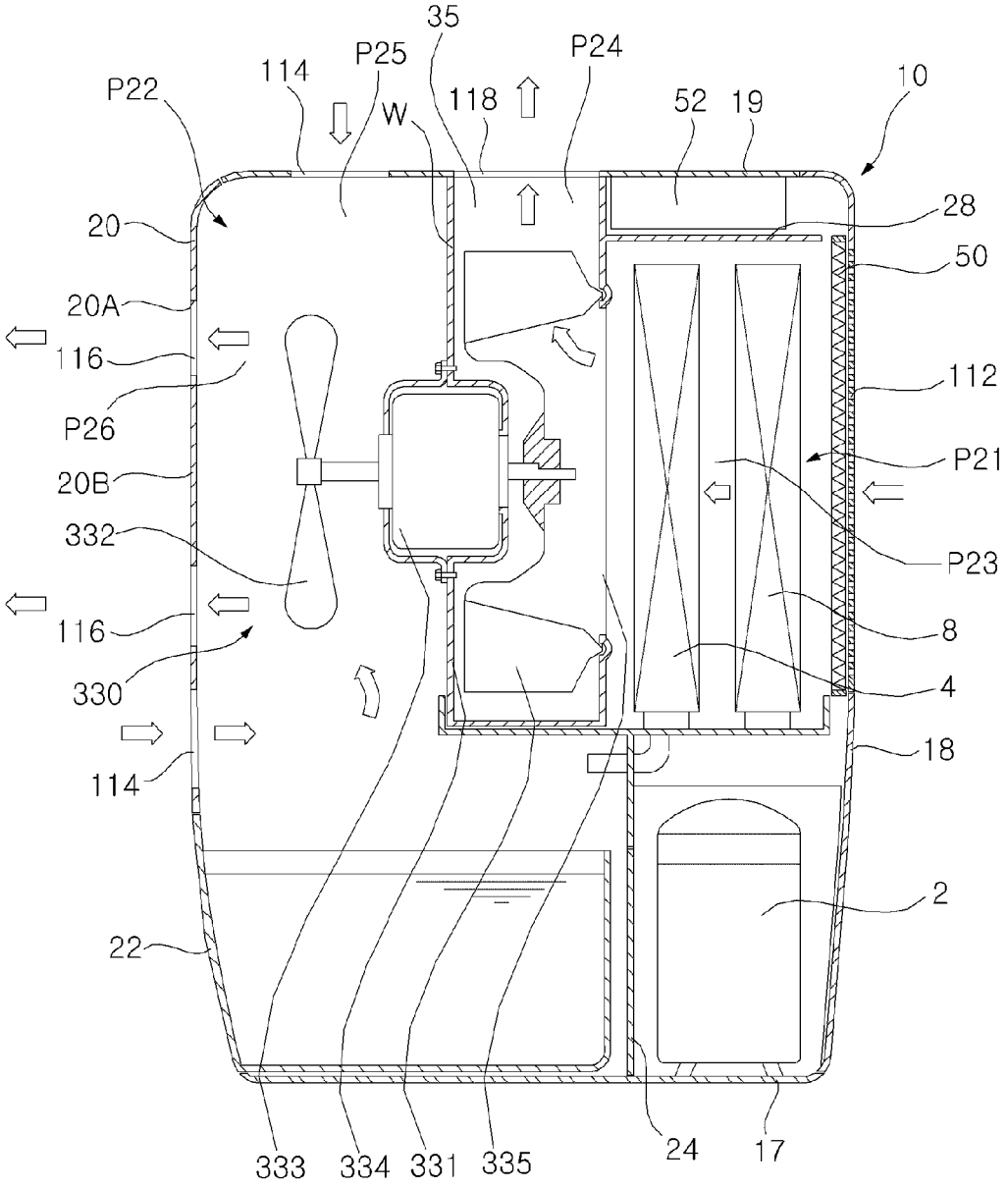
FIG. 26 is a schematic view illustrating a dehumidifier in accordance with a fifth preferred embodiment of the present invention, showing an air flow when a compressor is stopped and a fan is driven.

FIG. 25 is a schematic view illustrating a dehumidifier in accordance with a fifth preferred embodiment of the present invention, showing an air flow when a compressor and a fan are driven, and FIG. 26 is a schematic view illustrating a dehumidifier in accordance with a fifth preferred embodiment of the present invention, showing an air flow when a compressor is stopped and a fan is driven.

Alike the fourth embodiment of the present invention, the embodiment suggests mounting a fan 330 having two impellers 331 and 332 rotated by one common motor 333, and including a dehumidifying passage P21 and a fan passage P22. Since configurations and operations of the dehumidifier in accordance with a fifth preferred embodiment of the present invention are the same or similar to the fourth embodiment of the present invention except the dehumidifying passage P21 and the fan passage P22, the same reference numerals will be used and description of the same or similar configurations and operations will be omitted.

The first impeller 331 of the fan 330 may be positioned at the dehumidifying passage P21. The first impeller 331 of the fan 330 may be positioned between the condenser 4 and the second air outlet 118 in an air flow direction of the dehumidifying passage P21.

The second impeller 332 of the fan 330 may be positioned at the fan passage P22. The second impeller 332 of the fan 330 may be positioned between the second air inlet 114 and the first air outlet 116 in an air flow direction of the fan passage P22.

The dehumidifying passage P21 may be formed such that the air drawn into the first air inlet 112 is discharged to the second air outlet 118 passed through the evaporator 8, the condenser 4 and the first impeller 331. The dehumidifying passage P21 may include, in an air flow direction of the air drawn into the first air inlet 112, a dehumidifying suction flow passage P23 between the first air inlet 112 and the second air outlet 118, and a dehumidifying discharge flow passage P24 between the first impeller 331 and the second air outlet 118. The dehumidifying passage P21 may further include a fan inside flow passage for guiding the air flowed by the first impeller 331.

The fan passage P22 may be formed such that the air drawn into the second air inlet 114 is discharged to the first air outlet 116 passed through, not the evaporator 8 and the condenser 4, but the second impeller 332. The fan passage P22 may include, in an air flow direction of the air drawn into the second air inlet 114, a fan suction flow passage P25 between the second air inlet 114 and the second impeller 332, and a fan discharge flow passage P26 between the second impeller 332 and the first air outlet 116.

The dehumidifying passage P21 and the fan passage P22 may be partitioned by a partition wall W positioned between the dehumidifying passage P21 and the fan passage P22. The partition wall W may block the air flowed by the first impeller 331 and the air flowed by the second impeller 332 from each other. The partition wall W may function as an air guide which has one side for guiding the air passing through the dehumidifying passage P21, and the other side for guiding the air passing through the fan passage P22. The fan 330 may further include a fan housing 334 which encloses one of the first impeller 331 and the second impeller 332. The fan 330 may further include an orifice 335 for guiding the air being drawn into the fan housing 334. The fan housing 334 may have a portion thereof which functions as a partition wall W which blocks the air flowed by the first impeller 331 and the air flowed by the second impeller 332 from each other.

The dehumidifying suction flow passage P23 may make the evaporator 8 and the condenser 4 to be arranged in a flow direction of the air flowed by the first impeller 331. The dehumidifying suction flow passage P23 may be formed between the first air inlet 112 and the orifice 335 in an air flow direction. The dehumidifying suction flow passage P23 may be formed between the drain pan 26 and the flow passage guide 28. The air may be drawn into the first impeller 331 passed through between the drain pan 26 and the flow passage guide 28.

The fan inside flow passage may be formed between the orifice 335 and the fan housing 334.

The dehumidifying discharge flow passage P24 may be formed at an outlet portion of the fan housing 334. The dehumidifying discharge flow passage P24 may be in communication with the second air outlet 118.

The fan suction flow passage P25 may be formed between the second air inlet 114 and the second impeller 332 in an air flow direction. The fan suction flow passage P25 may be constructed of the front panel 20 and the fan housing 334. The fan suction flow passage P25 may be constructed of a rear side of the front panel 20 and a front side of the fan housing 334. The fan suction flow passage P25 may be constructed of the front side of the fan housing 334.

The operation of the embodiment will be described.

If the compressor 2 and the fan 330 are driven, as shown in FIG. 25, the air may be drawn into the dehumidifier from the outside of the dehumidifier distributed to the first air inlet 112 and the second air inlet 114. The air drawn into the first air inlet 112 from the outside of the dehumidifier may be dehumidified as the air passes through the evaporator 8, and, thereafter, may have a temperature thereof elevated by the refrigerant passing through the condenser 4 as the air passes through the condenser 4. The air passed through the condenser 4 may be drawn into the first impeller 331. The air drawn into the first impeller 331 after passed through the condenser 4 thus may be blown to the second air outlet 118, and may be discharged to the outside of the dehumidifier through the second air outlet 118. The air drawn into the second air inlet 114 from an outside of the dehumidifier may be drawn into the second impeller 332 bypassed the evaporator 8, the condenser 4, and the first impeller 331, may be blown to the first air outlet 116 by the second impeller 332, and may be discharged to the outside of the dehumidifier through the first air outlet 116. If the first air outlet 116 is the front air outlet, and the second air outlet 118 is the rear air outlet, the dehumidifier may discharge dehumidified air to the second air outlet 118, and non-dehumidified air to the front side of the first air outlet 116. If the first air outlet 116 is the front air outlet, the second air outlet 118 is the rear air outlet, and the compressor 8 and the fan 330 are driven, the dehumidifier may be in a rear dehumidifying and front fan mode. If the flow rate of the dehumidifier is classified into two stages, the dehumidifier may be in a rear low flow rate dehumidifying and front low flow rate fan mode. If the flow rate of the dehumidifier is classified into three stages, and a flow rate being discharged to the first air outlet 116 is higher than a flow rate being discharged to the second air outlet 118, the dehumidifier may be in a rear low flow rate dehumidifying and front medium flow rate fan mode.

In the meantime, if the compressor 2 is stopped and the fan 330 is driven, as shown in FIG. 26, the air may be drawn into the dehumidifier from the outside of the dehumidifier distributed to the first air inlet 112 and the second air inlet 114. The air drawn into the first air inlet 112 from the outside of the dehumidifier may be drawn into the first impeller 331 passed through the evaporator 8 and the condenser 4 without heat exchange therewith, may be blown to the second air outlet 118, and may be discharged to the outside of the dehumidifier through the second air outlet 118. The air drawn into the second air inlet 114 from the outside of the dehumidifier may be drawn into the second impeller 332 bypassed the evaporator 8, the condenser 4, and the first impeller 331, may be blown to the first air outlet 116 by the second impeller 332, and may be discharged to the outside of the dehumidifier through the first air outlet 116. If the first air outlet 116 is the front air outlet, and the second air outlet 118 is the rear air outlet, the dehumidifier may discharge non-dehumidified air to the second air outlet 118, and non-dehumidified air to the front side of the first air outlet 116. If the first air outlet 116 is the front air outlet, the second air outlet 118 is the rear air outlet, and the compressor 2 and the fan 330 are driven, the dehumidifier may be in a rear fan and front fan mode. If the flow rate of the dehumidifier is classified into two stages, the dehumidifier may be in a rear low flow rate fan and front low flow rate fan mode. If the flow rate of the dehumidifier is classified into three stages, and the flow rate of the air being discharged to the first air outlet 116 is higher than the flow rate of the air being discharged to the second air outlet 118, the dehumidifier may be in a rear low flow rate fan and front medium flow rate fan mode.

Figure 27:
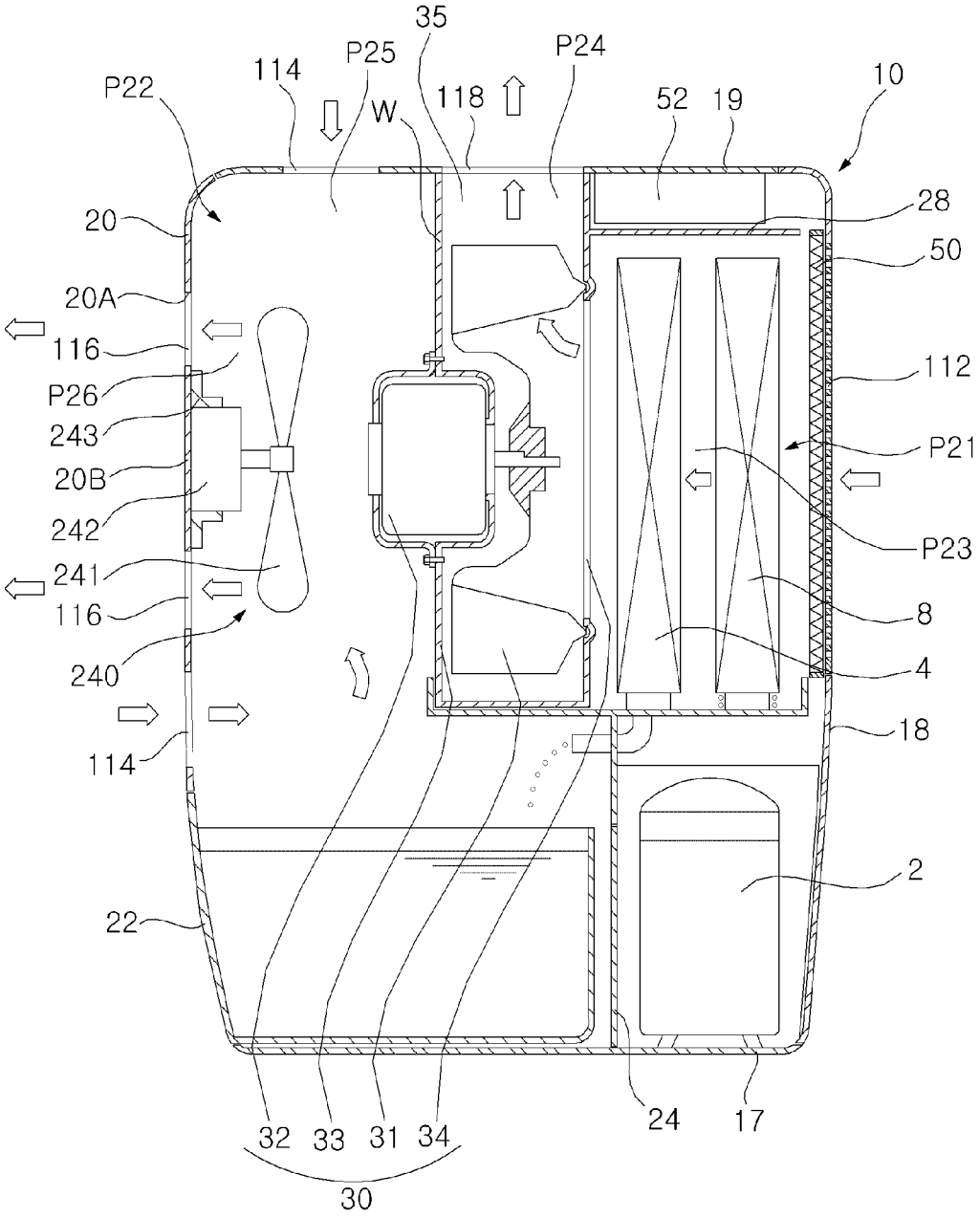
FIG. 27 is a schematic view illustrating a dehumidifier in accordance with a sixth preferred embodiment of the present invention, showing an air flow when all of a compressor, a first fan and a second fan are driven.
Figure 28:
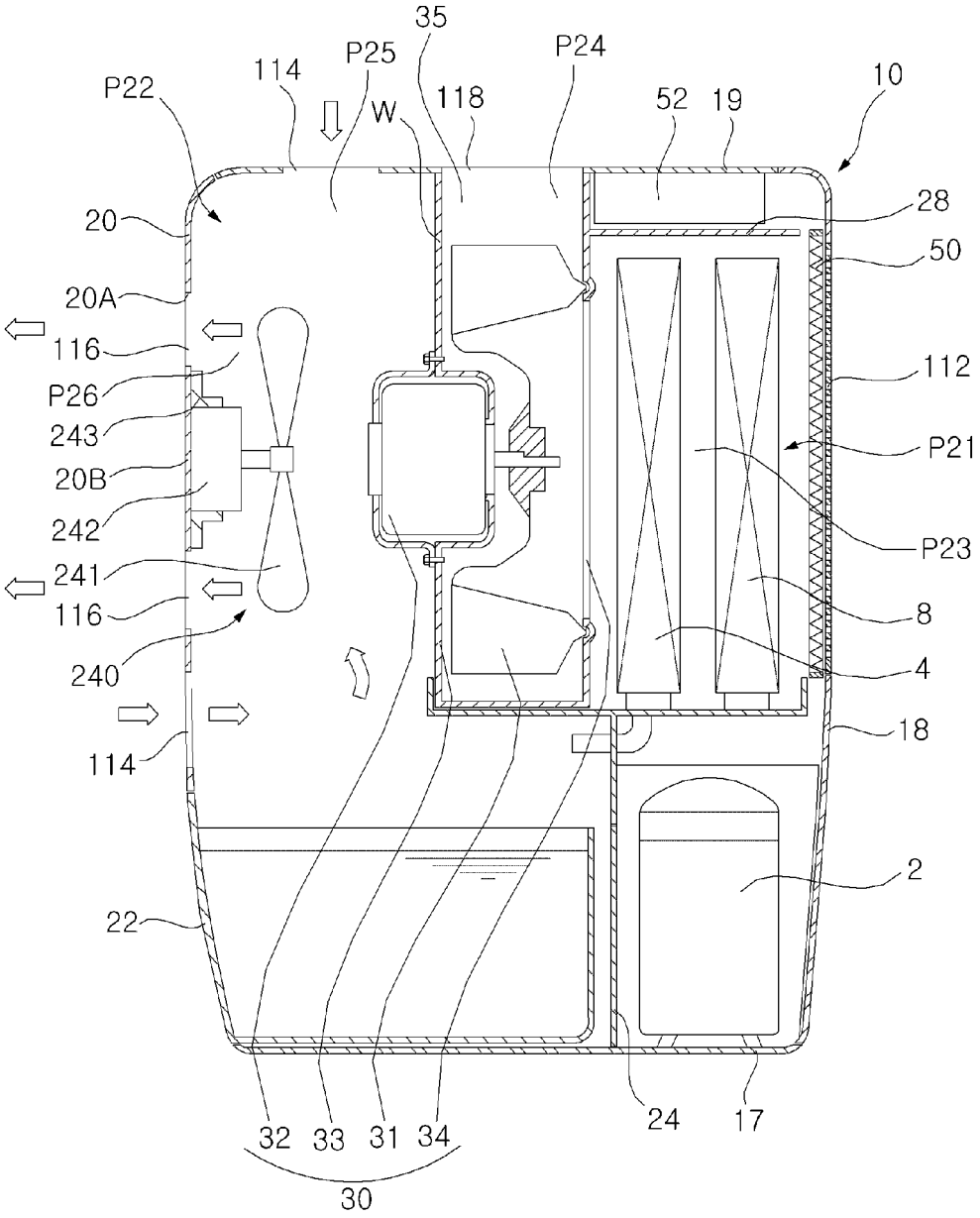
FIG. 28 is a schematic view illustrating a dehumidifier in accordance with a sixth preferred embodiment of the present invention, showing an air flow when a compressor and a first fan are stopped and a second fan is driven.
Figure 29:
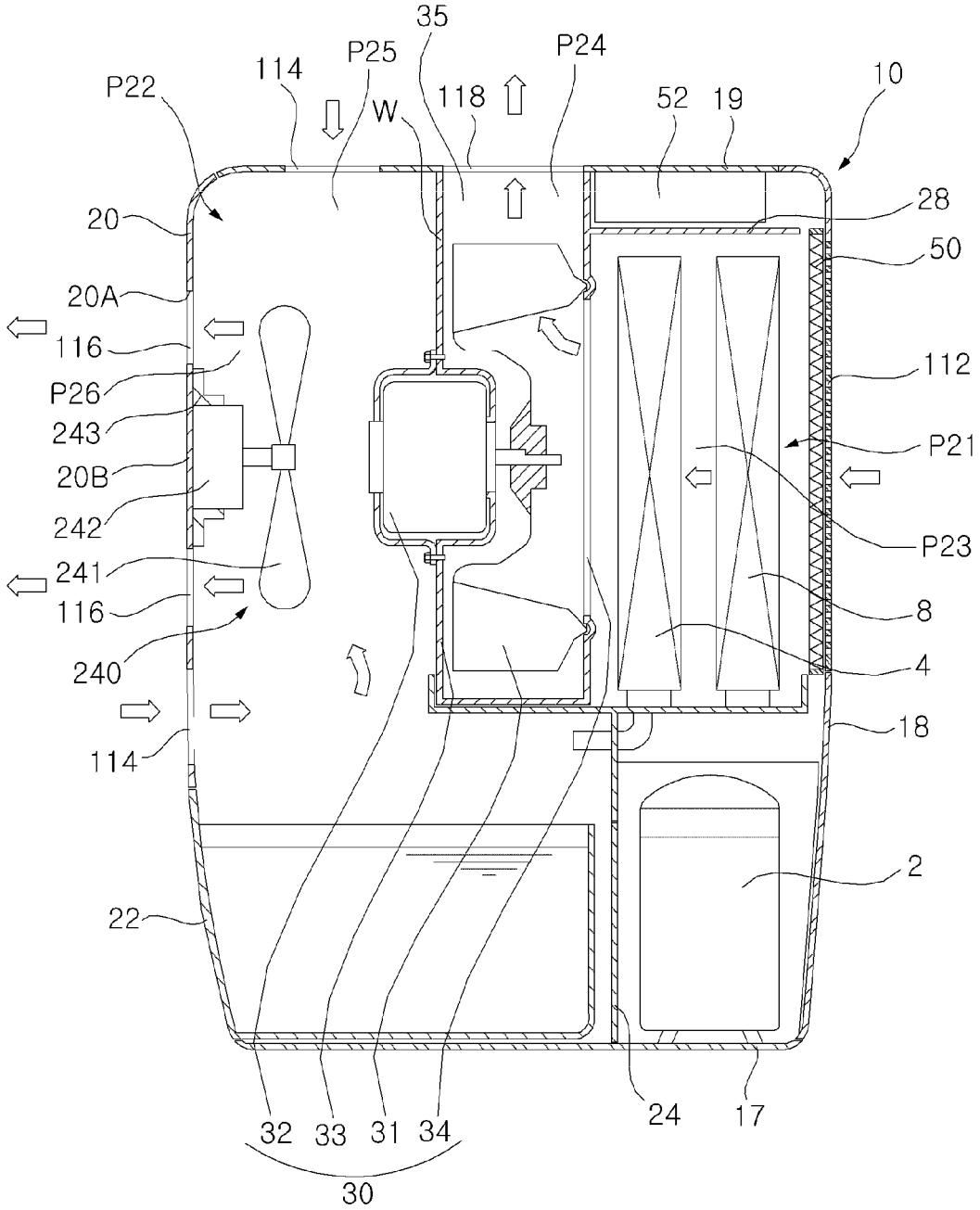
FIG. 29 is a schematic view illustrating a dehumidifier in accordance with a sixth preferred embodiment of the present invention, showing an air flow when a compressor is stopped, and both a first fan and a second fan are driven.
Figure 30:
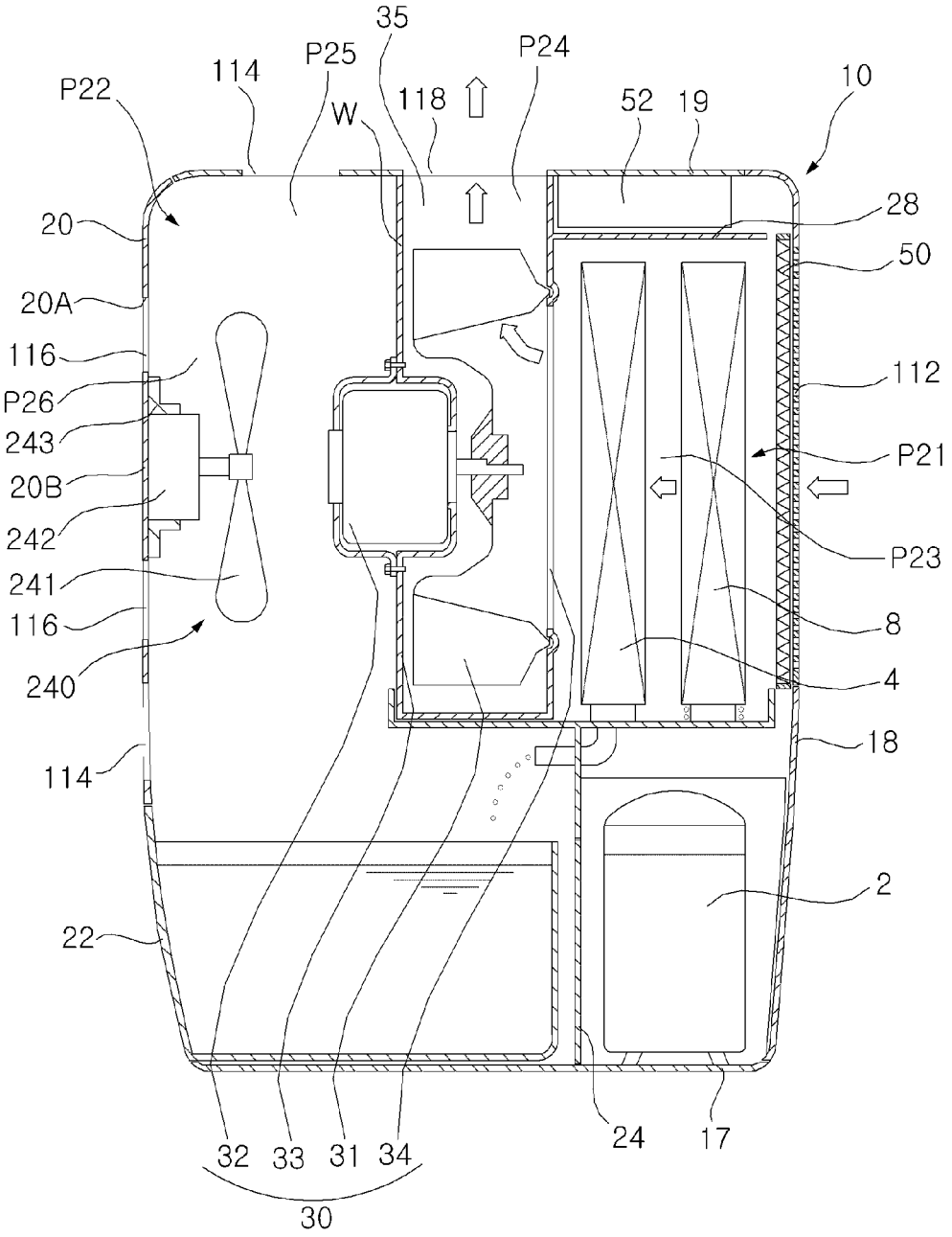
FIG. 30 is a schematic view illustrating a dehumidifier in accordance with a sixth preferred embodiment of the present invention, showing an air flow when a compressor and a first fan are driven and a second fan is stopped.
Figure 31:
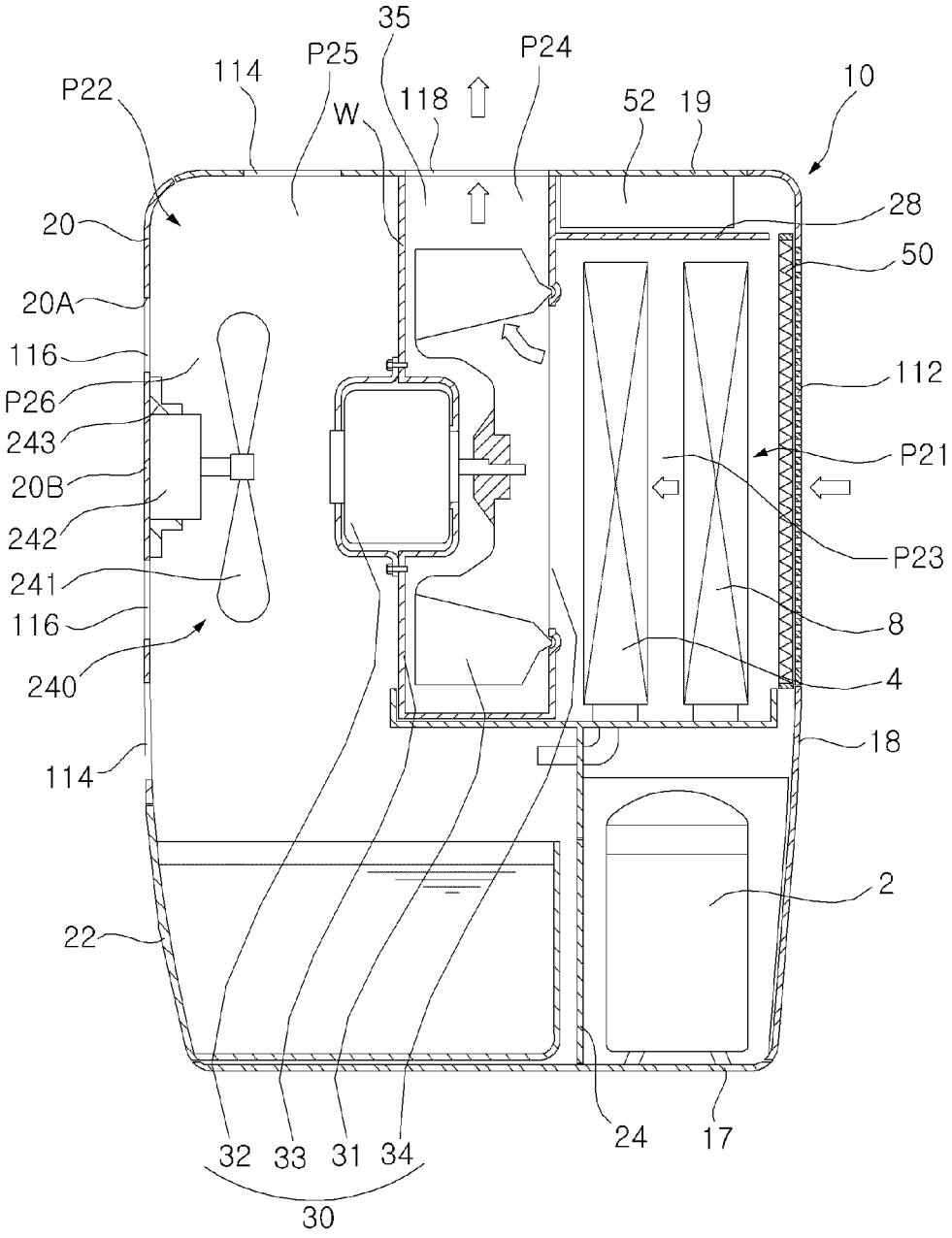
FIG. 31 is a schematic view illustrating a dehumidifier in accordance with a sixth preferred embodiment of the present invention, showing an air flow when a compressor and a second fan are stopped and a first fan is driven.

FIG. 27 is a schematic view illustrating a dehumidifier in accordance with a sixth preferred embodiment of the present invention, showing an air flow when all of a compressor, a first fan and a second fan are driven, FIG. 28 is a schematic view illustrating a dehumidifier in accordance with a sixth preferred embodiment of the present invention, showing an air flow when a compressor and a first fan are stopped and a second fan is driven, FIG. 29 is a schematic view illustrating a dehumidifier in accordance with a sixth preferred embodiment of the present invention, showing an air flow when a compressor is stopped, and both a first fan and a second fan are driven, FIG. 30 is a schematic view illustrating a dehumidifier in accordance with a sixth preferred embodiment of the present invention, showing an air flow when a compressor and a first fan are driven and a second fan is stopped, and FIG. 31 is a schematic view illustrating a dehumidifier in accordance with a sixth preferred embodiment of the present invention, showing an air flow when a compressor and a second fan are stopped and a first fan is driven.

The embodiment suggests including a dehumidifying passage P21 and a fan passage P22 like the fifth embodiment, and using a first fan 30 and a second fan 140 of the second embodiment of the present invention or a first fan 30 and a second fan 240 of the third embodiment of the present invention instead of the fan 330 of the fifth embodiment of the present invention. Since configurations and operations of the dehumidifier, such as the dehumidifying passage P21 and the fan passage P22, in accordance with a sixth preferred embodiment of the present invention are the same or similar to the fifth embodiment of the present invention except the first fan 30 and the second fan 240, the same reference numerals will be used and description of the same or similar configurations and operations will be omitted.

The first fan 30 may form a portion of the dehumidifying passage P21, and may be positioned between a condenser 4 and a second air outlet 118 in an air flow direction.

The second fan 240 may be positioned at the fan passage P22, and may be positioned between the second air inlet 114 and the first air outlet 116 in an air flow direction.

The dehumidifying passage P21 and the fan passage P22 may be made partitioned by a partition wall W positioned between the dehumidifying passage P21 and the fan passage P22. The partition wall W may block the air flowed by the first fan 30 and the air flowed by the second fan 240 from each other. The partition wall W may function as an air guide which has one side for guiding the air passing through the dehumidifying passage P21, and the other side for guiding the air passing through the fan passage P22. The first fan 30 may include a first impeller 31, a motor 32 for rotating the first impeller 31, and a fan housing 33 which encloses the first impeller 31. The first fan 30 may further include an orifice 34 for guiding the air drawn into the fan housing 33. It is possible that the dehumidifier may have the partition wall W constructed separate from the fan housing 33, and it is possible that a portion of the fan housing 33 functions as a partition wall W for blocking the air flowed by the first fan 30 and the air flowed by the second fan 240 from each other.

The operation of the present invention having the foregoing configuration will be described.

If the compressor 2, the first fan 30, and the second fan 240 are driven together, as shown in FIG. 27, the air may be drawn into the dehumidifier from an outside of the dehumidifier distributed to the first air inlet 112 and the second air inlet 114. The air drawn into the first air inlet 112 from the outside of the dehumidifier may be discharged to the second air outlet 118 passed through the first fan 30 after dehumidified at the evaporator 8, and heated at the condenser 4. The air drawn into the second air inlet 114 from an outside of the dehumidifier may be discharged to the first air outlet by the second fan 240 without passed the evaporator 8, the condenser 4 and the first fan 30. If the first air outlet 116 is a front air outlet, and the second air outlet 118 is a rear air outlet, the dehumidifier may discharge dehumidified air blown by the first fan 30 to the second air outlet 118, may discharge non-dehumidified air blown by the second fan 240 to a front side of the first air outlet 116, and may be in a rear dehumidifying and front fan mode. If a flow rate of the dehumidifier is classified into two stages, the dehumidifier may be in a rear low flow rate dehumidifying and front low flow rate fan mode. If the flow rate of the dehumidifier is classified into three stages, and the flow rate of the second fan 240 is higher than the flow rate of the first fan 30, the dehumidifier may be in a rear low flow rate dehumidifying and front medium flow rate fan mode.

In the meantime, if the compressor 2 and the first fan 30 are stopped, and the second fan 240 is driven, as shown in FIG. 28, the air may be drawn into the dehumidifier from an outside of the dehumidifier, not through the first air inlet 112, but through the second air inlet 114. The air drawn into the second air inlet 114 from an outside of the dehumidifier may be discharged to the first air outlet 116 by the second fan 240 without passed the evaporator 8, the condenser 4 and the first fan 30. If the first air outlet 116 is the front air outlet, and the second air outlet 118 is the rear air outlet 118, the dehumidifier may discharge non-dehumidified air blown by the second fan 240 to the front side of the first air outlet 116, and may be in a front fan mode. If the flow rate of the dehumidifier is classified into two stages, the dehumidifier may be in a front low flow rate fan mode. If the flow rate of the dehumidifier is classified into three stages, and the flow rate of the second fan 240 is higher than the flow rate of the first fan 30, the dehumidifier may be in a front medium flow rate fan mode.

In the meantime, if the compressor 2 is stopped and the first fan 30 and the second fan 240 are driven together, as shown in FIG. 29, the air may be drawn into the dehumidifier from an outside of the dehumidifier distributed to the first air inlet 112 and through the second air inlet 114. The air drawn into the first air inlet 112 from an outside of the dehumidifier may be discharged to the second air outlet 118 by the first fan 30 after passed through the evaporator 8 and the condenser 4 in succession without heat exchange therewith. The air drawn into the second air inlet 114 from an outside of the dehumidifier may be discharged to the first air outlet 116 by the second fan 240 without passed the evaporator 8, the condenser 4 and the first fan 30. If the first air outlet 116 is the front air outlet, and the second air outlet 118 is the rear air outlet, the dehumidifier may discharge non-dehumidified air blown by the first fan 30 to the second air outlet 118, the non-dehumidified air blown by the second fan 240 to the front side of the first air outlet 116, and may be in a rear fan and front fan mode. In this case, the dehumidifier may function as a multi-fan in which one apparatus blows the non-dehumidified air in many directions. If the flow rate of the dehumidifier is classified into two stages, the dehumidifier may be in a rear low flow rate fan and front low flow rate fan mode. If the flow rate of the dehumidifier is classified into three stages, and the flow rate of the second fan 240 is higher than the flow rate of the first fan 30, the dehumidifier may be in a rear low flow rate fan and front medium flow rate fan mode.

In the meantime, if the compressor 2 and the first fan 30 are driven, and the second fan 240 is stopped, as shown in FIG. 30, the air may be drawn into the dehumidifier from an outside of the dehumidifier, not through the second air inlet 114, but through the first air inlet 112. The air drawn into the first air inlet 112 from the outside of the dehumidifier may be discharged to the second air outlet 118 passed through the first fan 30 after dehumidified at the evaporator 8, and heated at the condenser 4. If the first air outlet 116 is the front air outlet, and the second air outlet 118 is the rear air outlet, the dehumidifier may discharge dehumidified air blown by the first fan 30 to the second air outlet 118, and may be in a rear low flow rate dehumidifying mode.

In the meantime, if the compressor 2 and the second fan 240 are stopped, and the first fan 30 is driven, as shown in FIG. 31, the air may be drawn into the dehumidifier from an outside of the dehumidifier, not through the second air inlet 114, but through the first air inlet 112. The air drawn into the first air inlet 112 from the outside of the dehumidifier may be discharged to the second air outlet 118 by the first fan 30 after passed through the evaporator 8, the condenser 4 in succession without heat exchange therewith. If the first air outlet 116 is the front air outlet, and the second air outlet 118 is the rear air outlet, the dehumidifier may discharge non-dehumidified air blown by the first fan 30 to the second air outlet 118, and may be in a rear low flow rate fan mode.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier having a compressor, a condenser, an expansion device, and an evaporator through which refrigerant is circulated, comprising:

a casing having a first air inlet, a second air inlet, and an air outlet formed thereon;

a first fan and a second fan installed in the casing;

a first passage that extends from the first air inlet to the air outlet to guide air drawn through the first air inlet through the evaporator, the condenser, the first fan, and the second fan in succession such that air is dehumidified while passing through the evaporator and the condenser, and discharged through the air outlet when the first fan is operated; and a second passage that extends from the second air inlet to the air outlet to guide air drawn through the second air inlet to bypass the evaporator, the condenser, and the first fan and pass through the second fan such that non-dehumidified air, which does not pass through the evaporator and the condenser, is discharged through the air outlet when the second fan is operated, wherein the second air inlet is disposed above the first air inlet, wherein the first fan is a centrifugal fan which sucks the air drawn through the first air inlet in a horizontal direction from a rear side and then blows the air upward, wherein the second fan is an axial fan disposed above the first fan, and wherein the second fan discharges the air blown by the first fan through the first passage and/or the air drawn through the second passage forward or upward.

2. The dehumidifier of claim 1, wherein the second passage is joined with the first passage between the first fan and the second fan, the first fan is positioned between the condenser and the second fan in the first passage, and the second fan is positioned between the first fan and the air outlet in the first passage.

3. The dehumidifier of claim 1, further comprising a second air inlet for non-dehumidified air flow formed inside the casing that allows air drawn into the second passage to flow toward the second fan without passing through the evaporator and the condenser.

4. The dehumidifier of claim 1, further comprising an air guide arranged between an outlet portion of the first fan and the casing to guide the air to the air outlet to be discharged.

5. The dehumidifier of claim 1, further comprising a flow passage guide provided near the air inlet to separate the first passage and the second passage near the air inlet.

6. The dehumidifier of claim 1, wherein the air inlet includes a first air inlet for the first passage, and a second air inlet for the second passage.

7. The dehumidifier of claim 1, wherein the second fan has an axis of rotation parallel to an axis of rotation of the first fan, and the air outlet is provided on a front or rear surface of the casing.

8. A dehumidifier, having a compressor, a condenser, an expansion device, and an evaporator through which refrigerant is circulated, comprising:

a casing having a first air inlet, a second air inlet, a first air outlet, and a second air outlet formed thereon;

a first fan and a second fan installed in the casing;

a first passage that guides air drawn through the first air inlet through the evaporator, the condenser, the first fan, and the second fan in succession before being discharged through the first air outlet such that dehumidified air blown by the first fan and non-dehumidified air blown by the second fan are mixed through the first passage, and discharges through the first air outlet;

a second passage that guides air drawn through the second air inlet through the second fan to be discharged through the first air outlet bypassing the evaporator, the condenser, and the first fan such that air passes through the second passage without being dehumidified and discharges through the first outlet; and a third passage that guides air drawn through the first air inlet through the evaporator, the condenser, and the first fan in succession to be discharged through the second air outlet bypassing the second fan such that air is dehumidified while passing through the evaporator and the condenser, and discharged through the second air outlet, wherein the first fan is a centrifugal fan and the second fan is an axial fan, each of the first fan and the second fan has a horizontal rotating axis, wherein the first fan sucks the air in a horizontal direction from a rear side and then blows the air upward, and the second fan discharges the air blown by the first fan and/or the air drawn through the second air inlet forward through the first air outlet.

9. The dehumidifier of claim 8, wherein the third passage is separated from the first passage between the first fan and the second fan, and the second passage is joined with the first passage between the first fan and the second fan.

10. The dehumidifier of claim 8, wherein the first fan is positioned between the condenser and the second fan in the first passage and between the condenser and the second air outlet in the third passage, and the second fan is positioned between the first fan and the first air outlet in the first passage and between the second air inlet and the first air outlet in the second passage.

11. The dehumidifier of claim 8, further comprising an air guide positioned between the first fan and the second air outlet in the third passage that guides air flow toward the second air outlet.

12. The dehumidifier of claim 8, wherein the first fan is provided in a first compartment of the casing and the second fan is provided in a second compartment of the casing, and wherein an opening is provided between the first and second compartments in the first passage.

13. The dehumidifier of claim 12, further comprising a flow passage control device for opening the opening while closing the second air outlet, and for closing the opening while opening the second air outlet.

14. The dehumidifier of claim 8, wherein the second fan has an axis of rotation parallel to an axis of rotation of the first fan, the first air outlet is provided on a front or rear surface of the casing, and the second air outlet is provided on a surface of the casing to discharge the air in a direction different from the first air outlet.

15. The dehumidifier of claim 8, wherein the first air outlet faces a fan housing of the first fan.

16. A dehumidifier, having a compressor, a condenser, an expansion device, and an evaporator through which refrigerant is circulated, comprising:

a casing having a first air inlet, a second air inlet, a first air outlet, and a second air outlet formed thereon;

a first fan and a second fan that is rotated by one common motor;

a first passage that guides air drawn through the first air inlet through the evaporator, the condenser, the first fan, and the second fan in succession before being discharged through the first air outlet such that dehumidified air blown by the first fan and non-dehumidified air drawn through the second inlet by the second fan are mixed, and discharged through the first air outlet;

a second passage that guides air drawn through the second air inlet through the second fan to be discharged through the first air outlet bypassing the evaporator, the condenser, and the first fan such that air is passed through second passage without being dehumidified, and discharged through the first air outlet; and a third passage that guides air drawn through the first air inlet through the evaporator, the condenser, and the first fan in succession to be discharged through the second air outlet bypassing the second fan such that air is dehumidified while passing through the evaporator and the condenser, and discharged through the second air outlet, wherein the first fan is a centrifugal fan and the second fan is an axial fan, each of the first fan and the second fan has a horizontal rotating axis, wherein the first fan sucks the air in a horizontal direction from a rear side and then blows the air upward, and the second fan discharges the air blown by the first fan and/or the air drawn through the second air inlet forward through the first air outlet.

17. The dehumidifier of claim 16, wherein the first fan is positioned between the condenser and the second fan in the first passage and between the condenser and the second air outlet in the third passage, and the second fan is positioned between the first fan and the first air outlet in the first passage and between the second air inlet and the first air outlet in the second passage.

18. The dehumidifier of claim 16, wherein the first fan is provided in a first compartment of the casing and the second fan is provided in a second compartment of the casing, and wherein an opening is provided between the first and second compartments in the first passage.

19. The dehumidifier of claim 18, further comprising a flow passage control device that opens the opening while closing the second air outlet, and closes the opening while opening the second air outlet.

* * * * *